US007422531B2

(12) United States Patent
Tarng et al.

(10) Patent No.: US 7,422,531 B2
(45) **Date of Patent: *Sep. 9, 2008**

(54) KILLER APPLICATIONS OF GOLH, GOLFISHING, GOLFRISBEE, GOLFBALL, BASEDISC, GOLFRISBEE BASKET

(75) Inventors: Min Ming Tarng, San Jose, CA (US); Mei-Jech Jane Lin, San Jose, CA (US); Eric Yu-Shiao Tarng, San Jose, CA (US); Alfred Yu-Chih Tarng, San Jose, CA (US); Angela Yu-Shiu Tarng, San Jose, CA (US); Jwu-Ing Tarng, San Jose, CA (US); Huang-Chang Tarng, San Jose, CA (US); Shun-Yu Nieh, San Jose, CA (US)

(73) Assignee: Tang System, San Jose, CA (US)

( * ) Notice: Subject to any disclaimer, the term of this patent is extended or adjusted under 35 U.S.C. 154(b) by 88 days.

This patent is subject to a terminal disclaimer.

(21) Appl. No.: 11/210,306

(22) Filed: Aug. 24, 2005

(65) Prior Publication Data

US 2005/0282665 A1 Dec. 22, 2005

Related U.S. Application Data

(63) Continuation-in-part of application No. 10/842,739, filed on May 10, 2004, now Pat. No. 7,101,293, and a continuation-in-part of application No. 10/091,984, filed on Mar. 6, 2002, now abandoned.

(51) Int. Cl.
*A63B 67/00* (2006.01)

(52) U.S. Cl. ..... 473/446; 273/400; 273/129 K; 473/465

(58) Field of Classification Search ..... 473/465, 473/590, 588, 446; 273/400, 348.4; 446/46
See application file for complete search history.

(56) References Cited

U.S. PATENT DOCUMENTS 5,254,077 A * 10/1993 Nottingham et al. ..... 446/48

* cited by examiner

*Primary Examiner*—Eugene Kim
*Assistant Examiner*—M. Chambers

(57) ABSTRACT

The killer applications of golfrisbee are comprised of the golh club, golfrisbee disc, golfrisbee basket, golfrisbee target, golfishing, grenade, water golh gun club, etc. The golfishing is to throw the fishing line far away with flying object and monitoring the fishing activities with golfishing golfrisbee. The core technologies are the swiveling club throwing technology, wind-bell-chain or wind-chime reverted-umbrella golfrisbee basket and the universal direction wing flying disk technology. Swiveling the golh club, the flying object is thrown to fly into the golfrisbee basket. The golfrisbee basket has either the wind-bell-chain or the wind-chime reverted umbrella structure to protect the golfrisbee from damage. The flying object is the golfball, golfrisbee disk, golfring, disk-ring, boomerang, polygon boomerang, multi-boomerang ring, multi-boomerang disk-ring, golfishing, golh hunting practice, grenade, gun golh club, water grenade, water gun golh club, etc. The golfrisbee further comprises a slotted skirt made of rubber material to make it safe for playing in the park and the backbone made of the shock-resistant plastic material. The golh sport is the golf hybrid of the golfrisbee and golfball. Swiveling the golh club, the golfrisbee or the golfball is thrown to fly.

9 Claims, 66 Drawing Sheets

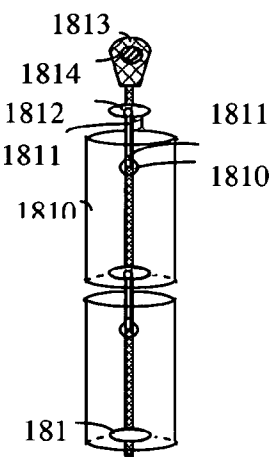
FIG.2L
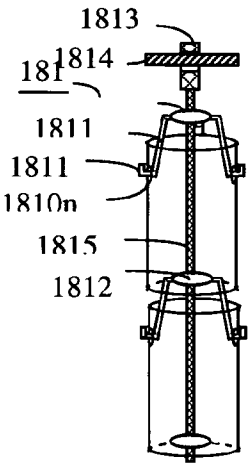
FIG.2K
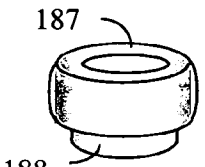
FIG.2N
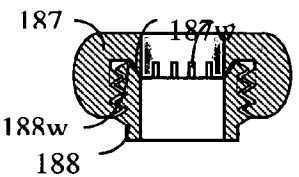
FIG.2M
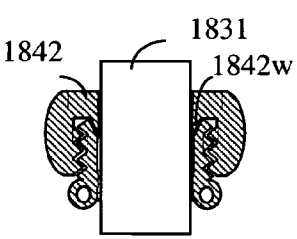
FIG.2P
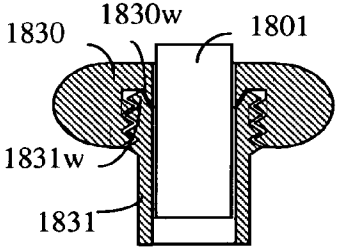
FIG.2O
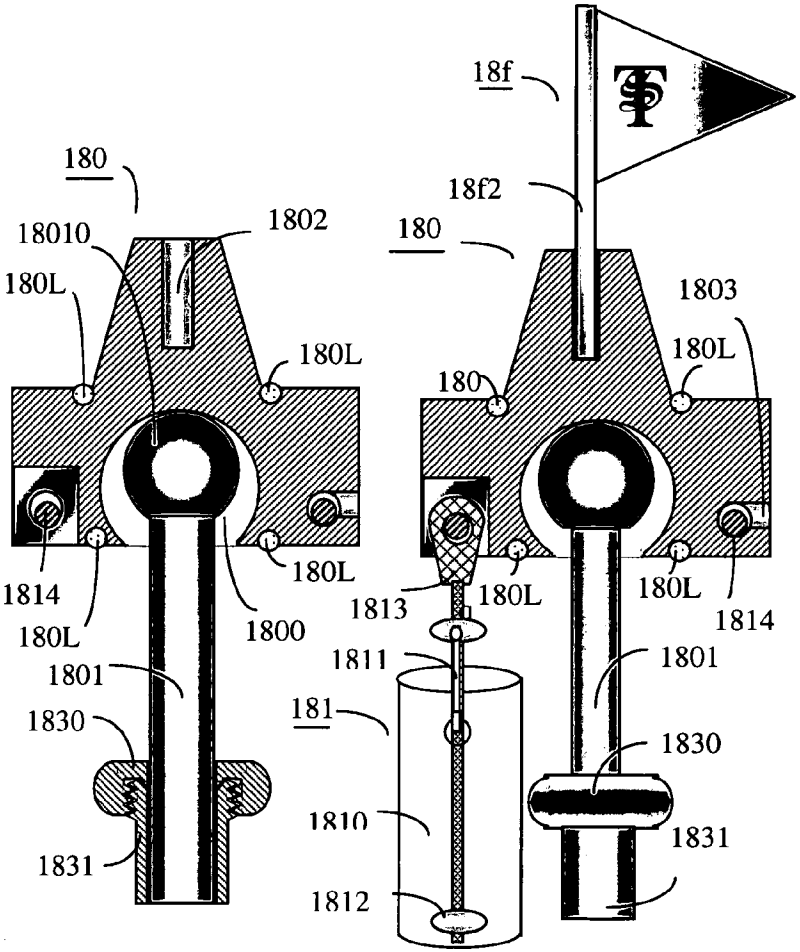
FIG.2J
FIG.2I

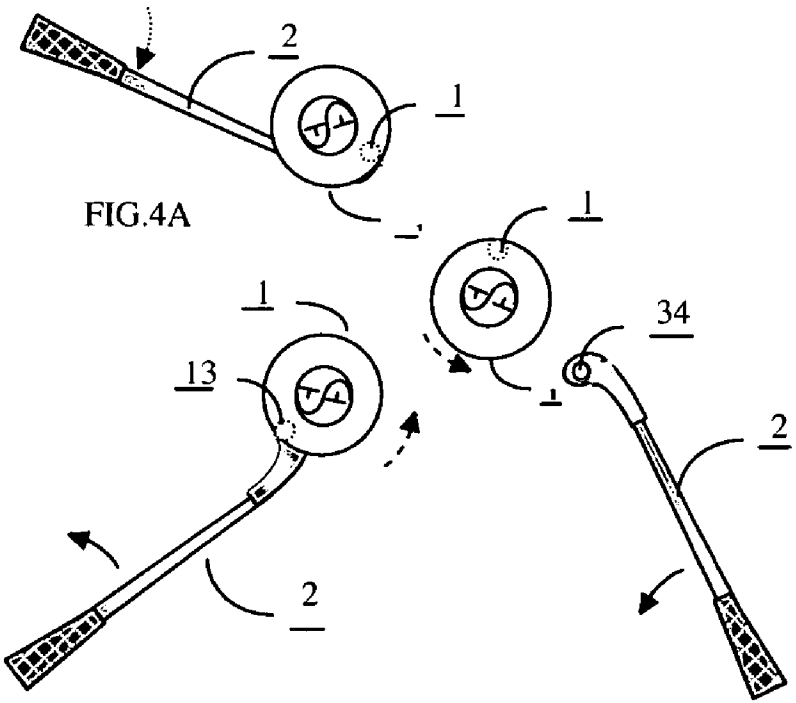
FIG.4A
FIG.4B
FIG.4C
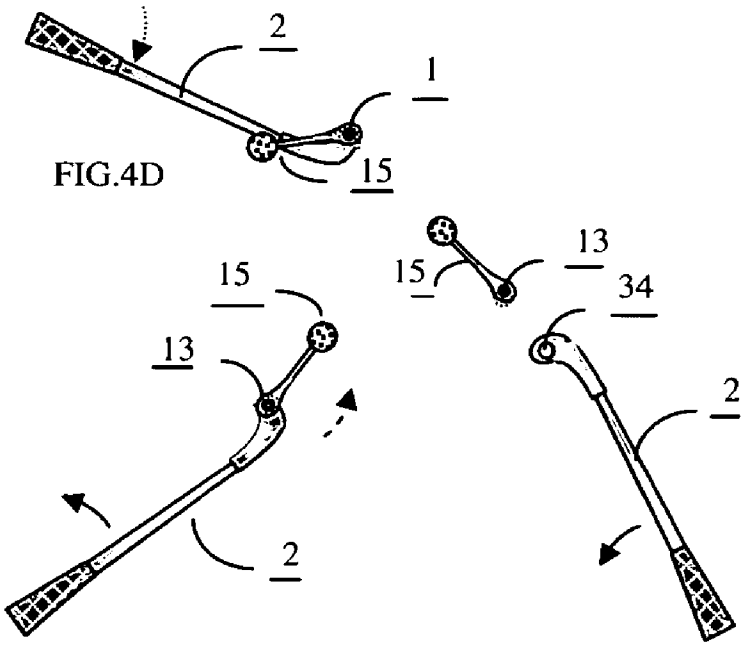
FIG.4D
FIG.4E
FIG.4F 13
12
15
151

13
12
15
152
1521
1511
151

153
13
12
15a
151
151a 36
34p
3
34
2
5

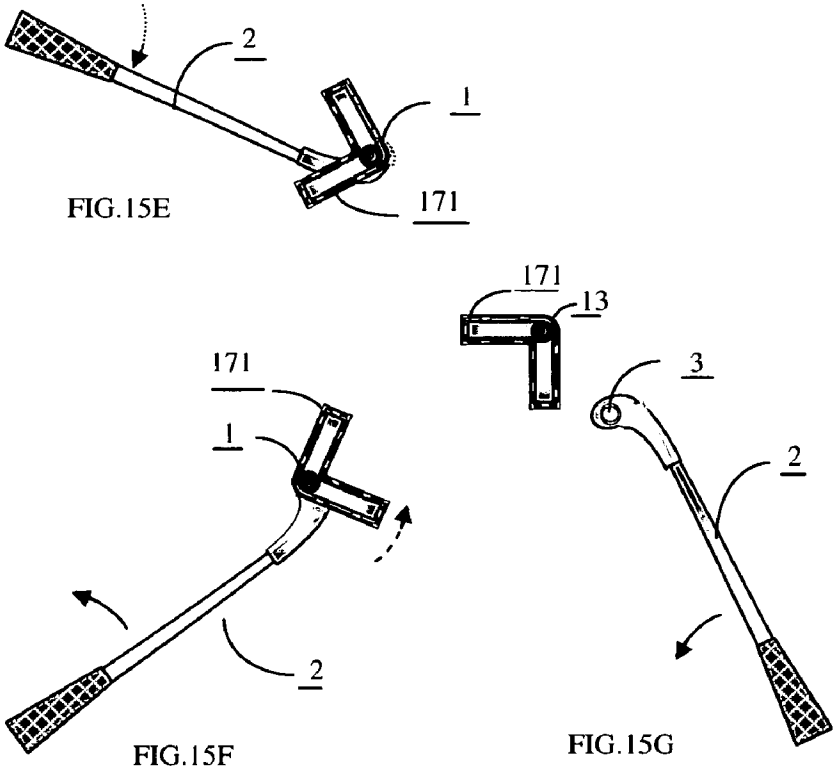
FIG.15E
FIG.15F
FIG.15G
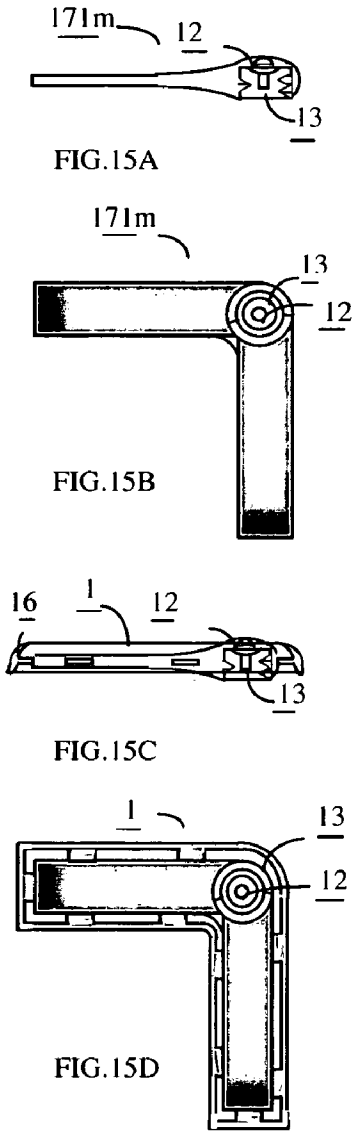
FIG.15A
FIG.15B
FIG.15C
FIG.15D 172
12
13

172
13

172
12
13

172
13

13
172

13
17
1

2
13
172

182
1
2

13
172
3
2

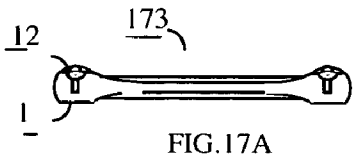
FIG.17A
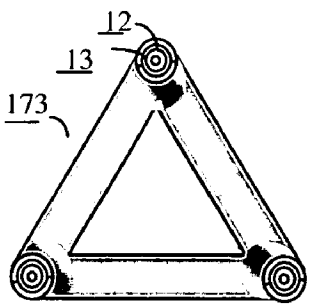
FIG.17B
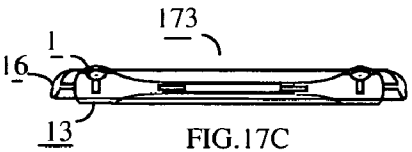
FIG.17C
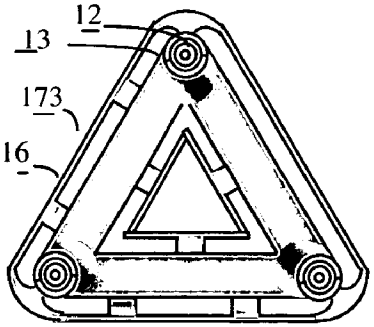
FIG.17D
FIG.17E
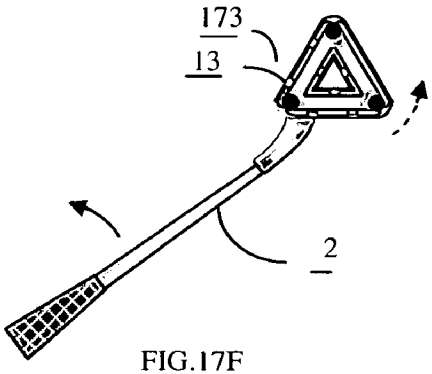
FIG.17F
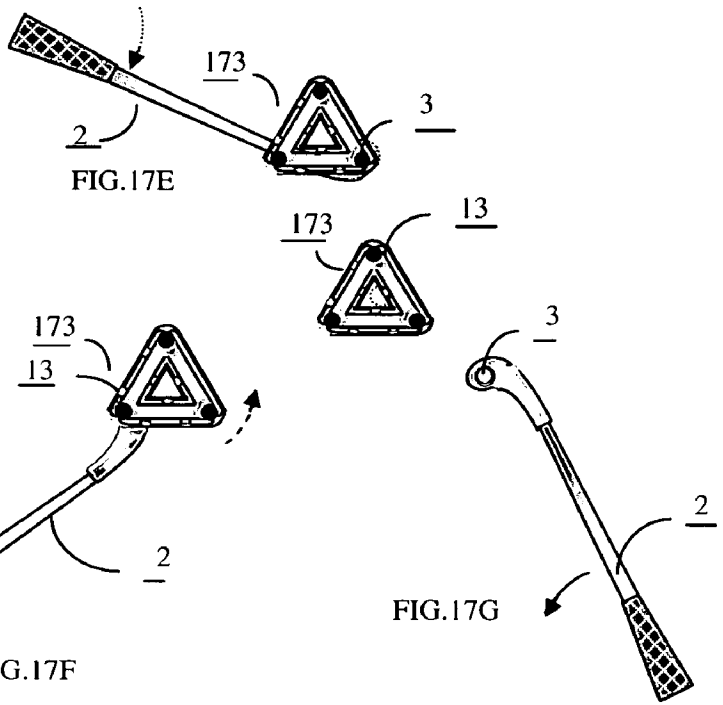
FIG.17G

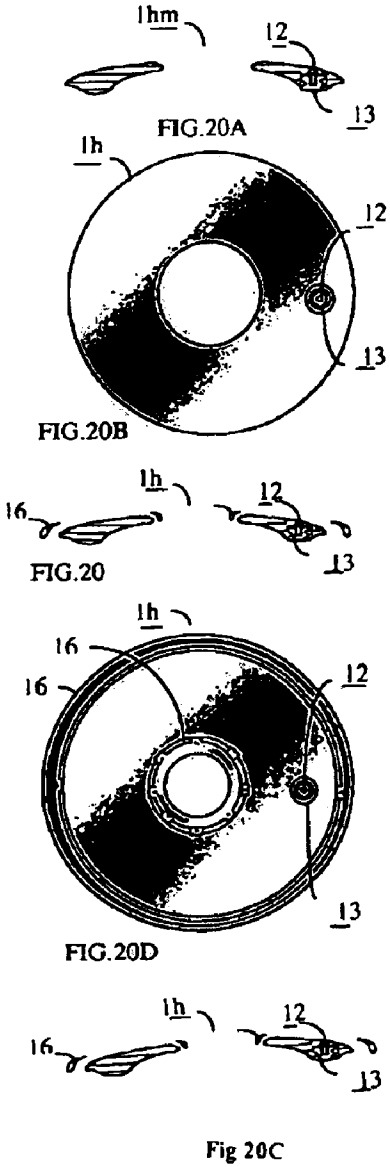
1hm
12
13
FIG.20A
1h
12
13
FIG.20B
1h
12
13
16
FIG.20
1h
12
13
16
16
FIG.20D
1h
12
13
16
Fig 20C
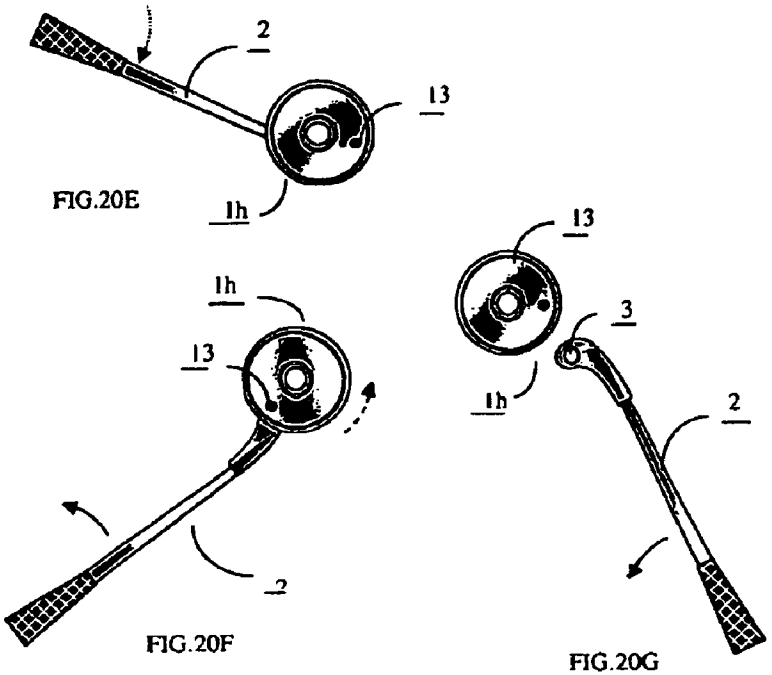
2
13
1h
FIG.20E
1h
13
2
FIG.20F
13
3
2
1h
FIG.20G

X
Y
1
16
161
13L
12
120
122
124
123
17
13R
41
42
4
121
132

X2
13R
41
42
132
13R

Y2
Y2
1
13L
16
161
X2

42
13L
131
161
16

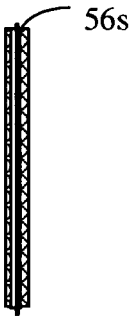
FIG.26J
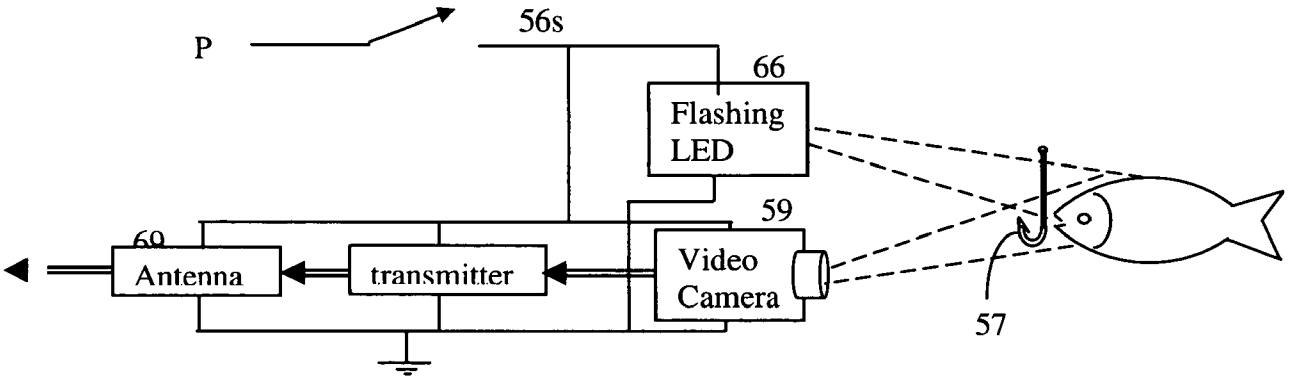
FIG.26I
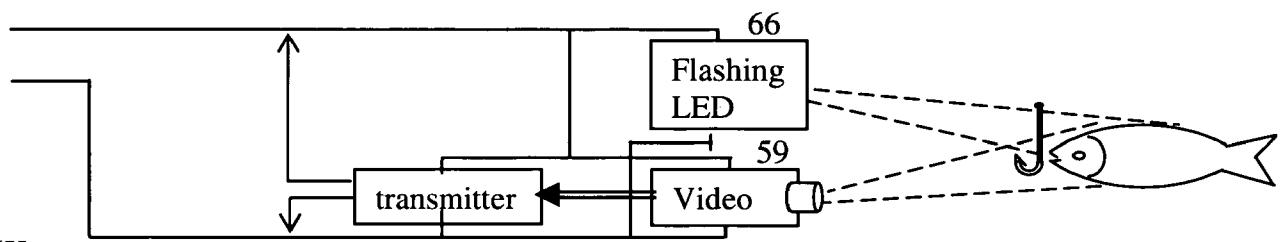
FIG.26K
FIG.26M
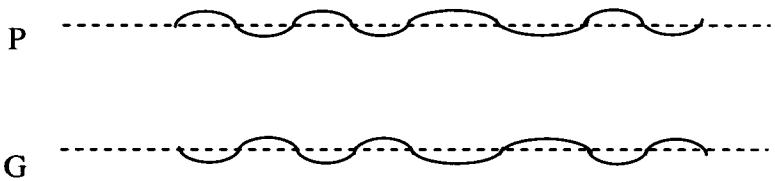
FIG.26L

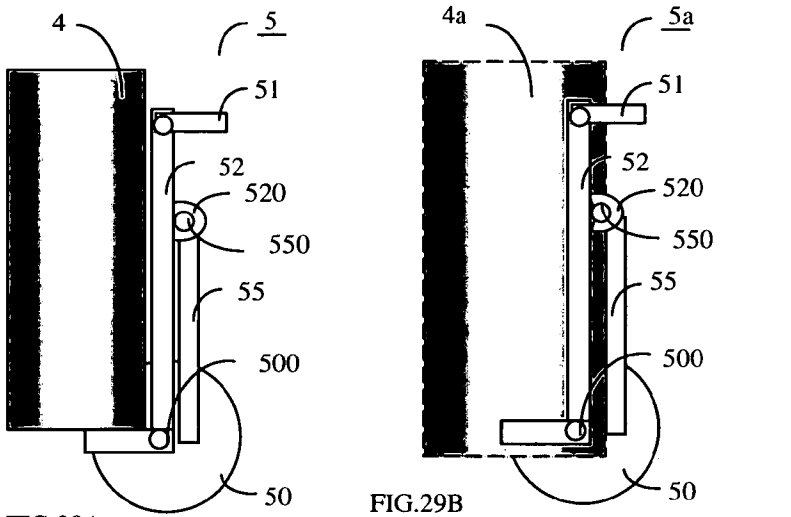
FIG.29B
FIG.29A
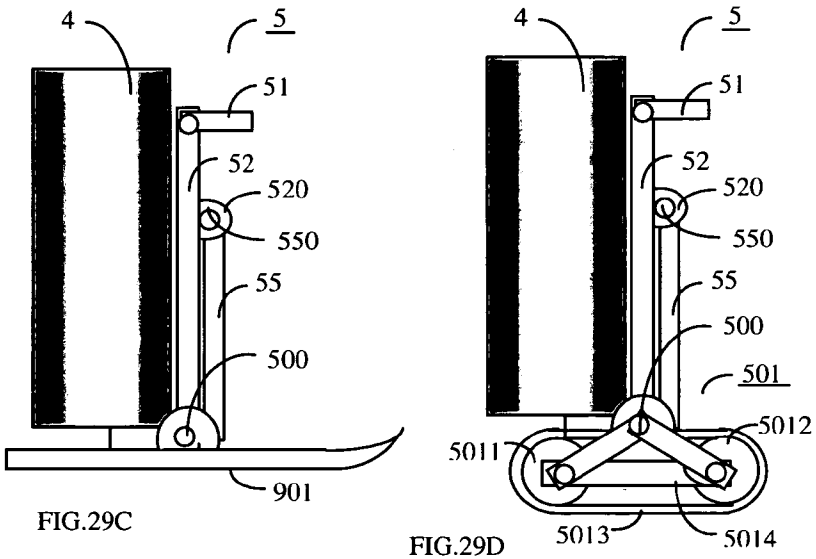
FIG.29D
FIG.29C
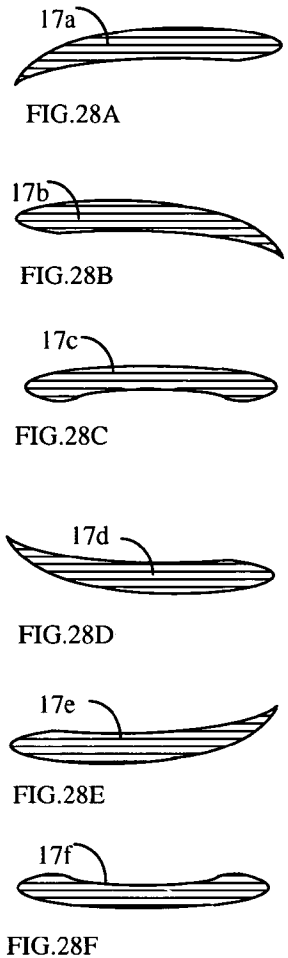
FIG.28A FIG.28B FIG.28C FIG.28D FIG.28E FIG.28F

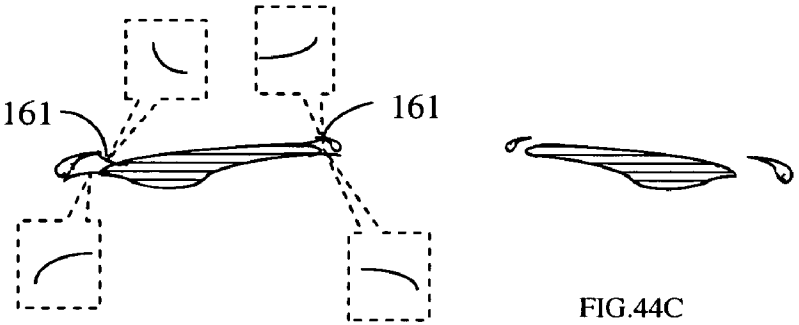
FIG.44C
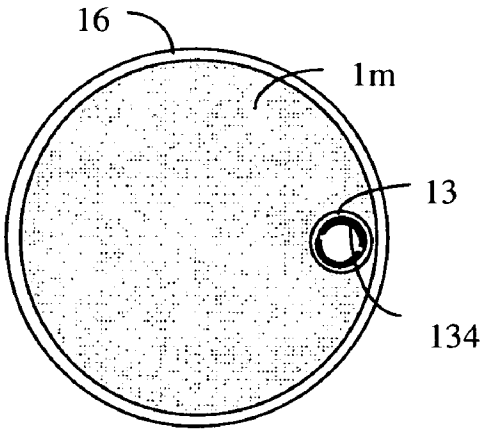
FIG.44A
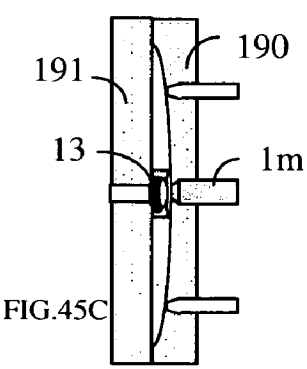
FIG.45A
FIG.45C
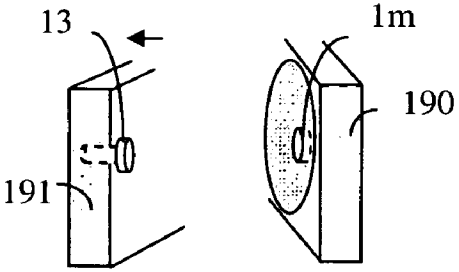
FIG.45B
FIG.45D
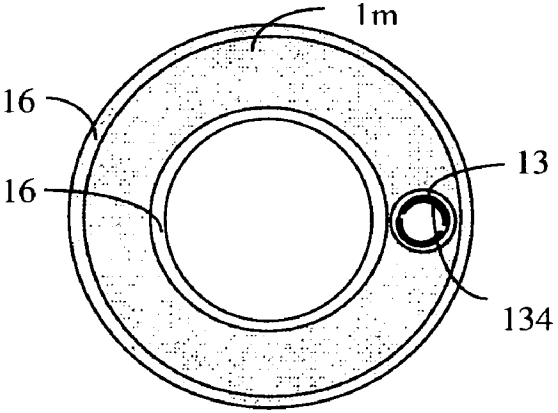
FIG.44B

KILLER APPLICATIONS OF GOLH, GOLFISHING, GOLFRISBEE, GOLFBALL, BASEDISC, GOLFRISBEE BASKET

This is a Continuation in Part application claims priority of U.S. patent application Ser. No. 10/091,984, filed Mar. 6, 2002, now abandoned, and U.S. patent application Ser. No. 10/842,739, filed May 10, 2004 now U.S. Pat. No. 7,101,293 which herein incorporated by reference in its entirety.

BACKGROUND FIELD OF INVENTION

After the Internet bubble, the industry starts to search the new killer applications to revive the economics. The killer applications of golh club and golfrisbee are the applications of the golh arts. In the killer applications, with the multi-disciplinary approach, we successfully apply the golfrisbee and basedisc art to the fields of fishing, hunting, sporting, battlefield, etc. For example, (1) using the golh club to throw the grenade, a new generation of grenade is formed; (2) shooting the flying golfrisbee ring as a target, a new way of hunting practice is formed; (3) using the golfrisbee to carry the fishing line and tiny video camera, a new smart fishing way, golfishing, is formed; (4) using the golfrisbee to play golf, the golf hybrid of golfrisbee and golfball sport is formed. In the golfishing, we combine the high technologies of nano-technology, wireless, APS (Active Pixel Sensor), LCD (Liquid Crystal Display), etc with the golh club and golfrisbee technologies, a new golfishing rod is formed. In the golh course, we combine the wind-chime, the reverted umbrella and tripod with the golh club and golfrisbee technologies, the portable golfrisbee baskets is formed. The golfball hole and golfrisbee basket are compatible in the golh course.

BACKGROUND

Description of Prior Art

The golh sport is to swivel the golh club to launch the golfrisbee to fly into the golfrisbee disk. The golher having the less number of swivels score will be the winner. Now the flying disk technology is comparable with the golf technology. The long-drive champion record for the golf ball is about 1236 feet. The hand-thrown ring has the flying range record to be 1,333 feet. Therefore, the golfball and flying disk can be compatible to share the same golf course. Furthermore, we make the innovation for golfrisbee. The golfrisbee will make the flying disk flying higher and longer distance. With the golfrisbee, golh club and professional training with the golh swing trainer, almost all the people can launch the golfrisbee as well as and as far as the long drive of golf ball. Golh sports will be the century sports for the 21st century. The golher plays the golfrisbee in the golfrisbee course according to the golf rules. As shown in FIG. 1A, FIG. 2A, FIG. 2Q and FIG. 2R, golh sport is to swivel the golh club 2 to launch the golfrisbee disk 1 to fly into the golfrisbee basket 18. The core technologies of golh sport are: golfrisbee 1, golh club 2 and golfrisbee basket 18.

As shown in FIG. 1A, the golh is the hybrid golf sport constituted of golfrisbee 1 and golfball 15. The golh sport is to swivel the golh club 2 to launch the golfrisbee 1 to fly or throw the golfball 15 to the hole. Then putt the ball 151 to roll into the hole or portable hole 6 with the golh club. The golfrisbee 1 is to be thrown into the golfrisbee basket 18 with the golh club 2. The long drive is played with the golfrisbee disk 1 and golfball 15. The flying distance of the golfrisbee 1 is compatible with the conventional golf ball. For safety purpose, the golh can be limited to (1) outside green, drive with the golfrisbee; and (2) on the green, putt with the golf ball 151.

OBJECTS AND ADVANTAGES

We combine the arts of golh with high technologies to form the killer applications. This combination adopts multi-disciplinary approach. The killer application is to revive the economics after the Internet bubble. The new life styles such as golh, golfishing, hunting practice, gun-golh-grenade, water-gun-golh-grenade, golfrisbee basket enabling golh courses, etc, are formed.

DRAWING FIGURES

FIG. 1 shows the versatile kill applications of the golfrisbee and basedisc; (A) the golh sport is constituted of the golfrisbee and golfball. Swiveling the golh club, the golfrisbee is thrown into the golh basket and the golfball is thrown and putt to roll into the hole; (B) the basedisc is the golfrisbee being played as the baseball; (C) is the golh pair-match game for the dating; (D) is the handisc sport which has the rules being similar to the football; (E) is the golh-arrow being played as the arrow does; (F) is golfishing with golfrisbee; (G) is shooting practice with the flying golfrisbees being targets; (H) is the grenade being thrown with golh club.

FIG. 2 is the official standard golfrisbee basket adopted by PGFA (Professional GolFrisbee Association); (A) shows the wind-bell-chain reverted-umbrella type portable golfrisbee basket; (B) is the wind-bell-chain of the golfrisbee basket; (C) is the sectional view of the reverted-umbrella type basket; (D) is the elevation view of the reverted-umbrella type basket; (E) is the sectional view of the stand; (F) is the elevation view of the stand; (G) is the elevation view of the wind-bell-chain; (H) is the sectional view of the alignment of the wind-bell-chain taken along the line H-H in FIG. 2G; (I) is the exposed sectional view of the wind-bell-chain hanger and support; (J) is the partial exposed elevation view of the wind-bell-chain hanger and support; (K) is the front view of the wind-bell-chain; (L) is the side view of the wind-bell-chain; (M) is the sectional view of a pole locker; (N) is the elevation view of a pole locker; (O) the pole locker is applied to the extension pole; (P) the pole locker is applied to the stand; (Q) is the fixed wind-bell-chain golfrisbee basket; (R) is the alternative design of the fixed golfrisbee basket; (S) the golfrisbee basket has the wind-bell-chain hanger with multiple hooks to hang the golfrisbee; (T) is the wind-bell-chain hanger having multiple hooks; (U) is the golfrisbee basket having the wind chime and foldable basket; (V) is the wind chime of the golfrisbee basket; (W) is the alternative design of wind chime for the golfrisbee basket; (X) is the basket made of the web of portable golfrisbee basket; (Y) is the alternative design of the basket made of the web of portable golfrisbee basket; (Z) is the alternative design of the tripod of portable golfrisbee basket.

FIG. 3 is the elevation view of mounting process of mounting the golfrisbee and golfball on the head of the golh club; (A) the golfrisbee is installed on the head of the golh club; (B) rotating the golfrisbee 180 degrees, the golfrisbee is engaged with the head and dangling on the head of golh club; (C) the golfball is installed on the head of the golh club; (D) rotating the golfball 180 degrees, the golfball is engaged with the head and dangling on the head of golh club.

FIG. 4 is the top view of swiveling golh club to launch the golfrisbee and golfball; swiveling golh club is similar to the swivel of the baseball pole; (A) after mounting the golfrisbee on the golh club, swiveling backward and upward to the position to be ready to swivel golh club forward to launch the golfrisbee; (B) swiveling forward to launch the golfrisbee; the golfrisbee rotates due to the eccentric force; (C) the golfrisbee takes off and flies in the sky; (D) after mounting the golfball on the golh club, swiveling golh club backward and upward to the position to be ready to swivel forward to throw the golfball; (E) swiveling forward to throw the golfball; the golfball rotates due to the eccentric force; (F) the golfball is thrown in the sky; (G) mounting the fishing golfrisbee on the golh club; (H) swiveling golh club to throw the fishing golfrisbee; (I) the fishing golfrisbee taking off to fly; (J) mounting the fishing golfrisbee on the golfishing rod; (K) swiveling golfishing rod to throw the fishing golfrisbee; (L) the fishing golfrisbee taking off from the golfishing rod to fly; (M) mounting the fishing golfrisbee on the golh club having extension fishing pole as shown in FIG. 4J; (N) swiveling golh club to throw the fishing golfrisbee having extension fishing pole as shown in FIG. 4K; (O) the fishing golfrisbee taking off to fly having extension fishing pole as shown in FIG. 4L; (P) After the golfrisbee falling on the water, put the fishing line in the fishing line guiding hooks; (Q) shows the fishing line in the guiding hook.

FIG. 5 The view of the rotating mechanism for the mounting and launching golfrisbee and golfball; (A) mounting the golfrisbee on the head of golh club; (B) rotating golfrisbee 180 degrees that the golfrisbee hangs and dangles on the head of the golh club; (C) swiveling the golh club, the golfrisbee rotates 180 degrees and takes-off from the head of golh club.

FIG. 6 The dynamic study of the launching angle of the golfrisbee; (A) is the dynamics of the golfrisbee at the launching point; (B) the angle position that golfrisbee is too early to launch properly; (C) the optimum launching angle to launch the golfrisbee; (D) the angle position that golfrisbee is too late to launch properly.

FIG. 7 Putting the golfrisbee and golfball; (A) putting a golf ball into the portable hole; (B) putting the golfrisbee to roll into a cave.

FIG. 8 is the basic set of golh including golh club, golfrisbee, golfball and dust cover; (A) is the elevation view of the golfrisbee disk; (B) is the side view of the golfball; (C) is the right-hand golfrisbee club having the right hand screw on the club head; (D) is the left-hand golfrisbee club having the left hand screw on the club head.

FIG. 9 (A) is the side section view of the golfrisbee disk; (B) is the side section view of the golfball; (C) is the section view of the right-hand golfrisbee club having the right-hand screw on the golh head; (D) is the section view of the left-hand golfrisbee club having the left-hand screw on the golh head; (E) is the partial exposed sectional view of the golh head with the dust cover; (F) is the top view of the golh head having the dust cover; (G) is the top view of the dust cover for the golh head; (H) is the section view of the alternative design of the adjustable golh club head; (I) is the top view of the alternative design of the adjustable golh club head; (J) is the side view of the fast golh club head; (K) is the top view of fast golh club head; (L) is the fast golh club head holding the pole to throw the pole; (M) is the fast golh club head holding the golfrisbee ring; (N) swiveling the fast golh club, the golfrisbee ring pivotally rotates around the axle of fast golh club head; (O) the golfrisbee is released and slides over the slope to disengage with the fast golh club head; (P) is the golfrisbee ring taking off from the fast golh club head to fly; (Q) is the golf club with the alternative design of golh club head; (R) is the fast golf club; (S) is the combinatory golh club having the adjustable golh club head and the fast golh club head.

FIG. 10 The fundamental principles of the universal directional flying wing of the golfrisbee; (A) is the conventional wing flying in the forward direction; (B) is the conventional wing flying in the backward direction; (C) is the overlap of the wing flying in the forward direction as shown in FIG. 10A and the wing flying in the backward direction as shown in FIG. 10B; (D) is the bi-directional flying wing which is the envelope of the wing overlapped as shown in FIG. 10C; the bi-directional flying wing has the bi-directional flying capability which is the overlap composition of the uni-directional flying wings; (E) is the conventional wing having the slat and flap flying in the forward direction; (F) is the conventional wing having the slat and flap flying in the backward direction; (G) is the overlap of the wing having the slat and flap flying in the forward direction as shown in FIG. 10E with the wing having the slat and flap flying in backward direction as shown in FIG. 10F; (H) is the bi-directional flying wing with the skirt having the functions of both slat and flap; the skirt of the bi-directional flying wing is the composite envelop of the overlapped slat and flap of the overlapped uni-directional wings.

FIG. 11 The application of the bi-directional flying wing to the design of the golfrisbee disk having the universal directional flying capability; (A) is the sectional view of the golfrisbee having the sectional view of bi-directional wing; (B) is the isometric view of the golfrisbee disk; (C) is the aerodynamic analysis for the golfrisbee.

FIG. 12 The application of the bi-directional flying wing to the design of the golfrisbee ring-disk having the ring shape with the universal directional flying capability; (A) is the sectional view of the golfrisbee ring having the sectional view of the bi-directional wing; (B) is the isometric view of the golfrisbee ring disk.

FIG. 13 The application the bi-directional flying wing to the design of the disk-ring type golfrisbee having the hybrid of disk and ring shape with the universal directional flying capability; (A) is the sectional view of the disk-ring type golfrisbee having the sectional view of the bi-directional wing; (B) is the isometric view of the disk-ring type golfrisbee.

FIG. 14 The killer applications of the golh club throwing golfball to the golh-grenade, golh-gun, water-golh-grenade and water-golh-gun; (A) is the golfball being thrown with the golh club as shown in FIG. 14D; (B) is the section view of the golfball with the fast release latch; (C) the golf-arrow is the golfball with the arrowhead; (D) is the golh club being swiveled to throw golfball; (E) is the golh-grenade; (F) is the block diagram of the smart golh-grenade; (G) is one implementation of the smart golh-grenade; (H) is the water-golh-grenade; (I) is the water golh-gun; (J) is the golh-gun; (K) is the alternative design and operation of the golh-gun.

FIG. 15 is the application of the golh club to throw the boomerang; (A) is the sectional view of the boomerang with the adaptor for the golh head to be thrown with the golh club; (B) is the top view of the boomerang with the adaptor being thrown with the golh club; (C) is the sectional view of the boomerang with the bi-directional wing segment to be thrown with the golh club; (D) is the top view of the boomerang with the bi-directional wing segment to be thrown with the golh club; (E) after mounting the golfrisbee on the golh club, swiveling backward and upward to the position to be ready to swivel forward to launch the golfrisbee made of boomerang; (F) swiveling forward and downward to launch the golfrisbee made of boomerang; (G) the golfrisbee made of boomerang takes off and flies in the sky.

FIG. 16 is the application of the golh club to throw the multi-boomerang; (A) is the sectional view of the odd-boomerang with the adaptor being thrown with the golh club; (B)

is the top view of the odd-boomerang with the adaptor being thrown with the golh club; (C) is the sectional view of the odd-boomerang with the bi-directional wing segment to be thrown with the golh club; (D) is the top view of the odd-boomerang with the bi-directional wing segment to be thrown with the golh club; (E) is the top view of the even-boomerang with the adaptor being thrown with the golh club; (F) is the top view of the even-boomerang with the bi-directional wing segment to be thrown with the golh club; (G) after mounting the tri-boomerang golfrisbee on the golh club, swiveling backward to the position to be ready to swivel forward to launch the tri-boomerang golfrisbee; (H) swiveling forward to launch the tri-boomerang golfrisbee; (I) the tri-boomerang golfrisbee takes off and flies in the sky.

FIG. 17 is the application of the golh club to throw the polygon-boomerang; (A) is the sectional view of the polygon-boomerang with the adaptor of golh club head being thrown with the golh club; (B) is the top view of the polygon-boomerang with the adaptor of golh club head being thrown with the golh club; (C) is the sectional view of the polygon-boomerang with the bi-directional wing segment being thrown with the golh club; (D) is the top view of the polygon-boomerang with the bi-directional wing segment being thrown with the golh club; (E) after mounting the triangle-boomerang golfrisbee on the golh club, swiveling backward to the position to be ready to swivel forward to launch the golfrisbee made of triangle-boomerang; (F) swiveling forward to launch the triangle-boomerang golfrisbee; (G) the tri-boomerang golfrisbee takes off and flies in the sky.

FIG. 18 is the application of the golh club to throw the universal directional flying wing golfrisbee disk; (A) is the sectional view of the golfrisbee disk having the universal directional flying wing and screw adaptor to be thrown with the golh club; (B) is the top view of the golfrisbee disk having the universal directional flying wing and adaptor being thrown with the golh club; (C) is the sectional view of the golfrisbee disk having the multi-segment of universal direction flying wing to be thrown with the golh club; (D) is the top view of the golfrisbee disk having the multi-segment of universal direction flying wing to be thrown with the golh club; (E) after mounting the golfrisbee disk on the golh club, swiveling backward to the position to be ready to swivel forward to launch the golfrisbee made of disk; (F) swiveling forward to launch the golfrisbee disk; (G) the golfrisbee disk takes off and flies in the sky.

FIG. 19 is the application of the golh club to throw the golfrisbee ring having the universal directional wing; (A) is the sectional view of the golfrisbee ring with the screw adaptor to be thrown with the golh club; (B) is the top view of the golfrisbee ring with the screw adaptor to be thrown with the golh club; (C) is the sectional view of the golfrisbee ring having the multi-segment universal directional wing to be thrown with the golh club; (D) is the top view of the golfrisbee ring having the multi-segment universal directional wing to be thrown with the golh club; (E) after mounting the golfrisbee ring on the golh club, swiveling backward to the position to be ready to swivel forward to launch the golfrisbee ring; (F) swiveling forward to launch the golfrisbee ring; (G) the golfrisbee ring takes off and flies the sky; (H) is the sectional view of the flying golfrisbee target; (I) is the top view of the flying golfrisbee target; (J) the sectional view of the flying golfrisbee target having the skirt; (K) is the top view of the flying golfrisbee target having the skirt; (L) mounting the golfrisbee target on the golh club; (M) swiveling golh club to launch the golfrisbee target; (N) is the golfrisbee target taking off to fly; (O) is the target paper.

FIG. 20 is the application of the golh club to throw the golfrisbee disk-ring; (A) is the sectional view of the golfrisbee disk-ring with the screw adaptor to be thrown with the golh club; (B) is the top view of the golfrisbee disk-ring with the screw adaptor to be thrown with the golh club; (C) is the sectional view of the golfrisbee disk-ring with the multi-segment universal directional wing to be thrown with the golh club; (D) is the top view of the golfrisbee disk-ring with the multi-segment universal directional wing to be thrown with the golh club; (E) after mounting the golfrisbee disk-ring on the golh club, swiveling backward to the position to be ready to swivel forward to launch the golfrisbee disk-ring; (F) swiveling forward to launch the golfrisbee disk-ring; (G) the golfrisbee disk-ring takes off and flies in the sky.

FIG. 21 is the application of the golh club to throw the multi-boomerang golfrisbee ring and disk-ring; (A) is the partial exposed elevation view of the multi-boomerang golfrisbee ring and disk-ring with the screw adaptor to be thrown with the golh club; (B) is the top view of the odd-boomerang golfrisbee ring and disk-ring with the screw adaptor to be thrown with the golh club; (C) is the partial exposed elevation view of the multi-boomerang golfrisbee ring and disk-ring having the multi-segment universal directional wing to be thrown with the golh club; (D) is the top view of the odd-boomerang golfrisbee ring and disk-ring having the multi-segment universal directional wing to be thrown with the golh club; (E) after mounting the multi-boomerang golfrisbee ring and disk-ring on the golh club, swiveling backward to the position to be ready to swivel forward to launch the tri-boomerang golfrisbee ring or disk-ring; (F) swiveling forward to launch the tri-boomerang golfrisbee ring or disk-ring; (G) the tri-boomerang golfrisbee ring or disk-ring takes off and flies in the sky; (H) is the top view of the even-boomerang golfrisbee ring and disk-ring with the screw adaptor to be thrown with the golh club; (I) is the top view of the even-boomerang golfrisbee ring and disk-ring having the multi-segment universal directional wing to be thrown with the golh club; (J) the golfrisbee boomerang polygon is derived from the combination of boomerangs in FIG. 16 and FIG. 17; it is similar to the boomerang disk ring; (K) the boomerang polygon golfrisbee has the same structure as the golfrisbee as shown in FIG. 23A with the edge numbers of polygon to be infinite; (L) is the top view of the golfrisbee with the arrowhead.

FIG. 22 is the implementations of the boomerang golfrisbee ring and disk-ring; (A) is the partial exposed elevation view of the golfrisbee boomerang ring-disk or disk-ring with the screw adaptor to be thrown with the golh club; (B) is the sectional view of the boomerang golfrisbee disk-ring with the disk type multi-segment universal directional wing; (C) is the boomerang golfrisbee ring with the multi-segment universal directional wing.

FIG. 23 is the section view of the golfrisbee boomerang disk-ring as shown in FIG. 8A; (A) is the bottom view of the golfrisbee taken at the horizontal line X-X in FIG. 23B; (B) is the horizontal section view of the golfrisbee taken at the horizontal center line in FIG. 23A; (C) is the vertical section view of the golfrisbee taken at the vertical center line Y-Y in FIG. 23A; (D) is the bottom view of the alternative design of golfrisbee with the slotted skirt enveloping the edge of golfrisbee taken at the horizontal line X1-X1 in FIG. 23E; (E) is the horizontal section view of the golfrisbee with the slotted skirt enveloping the edge of the golfrisbee edge taken at the horizontal center line in FIG. 23D; (F) is the vertical section view of the golfrisbee with slotted skirt enveloping the edge of the golfrisbee edge taken at the vertical center line Y1-Y1 in FIG. 23D.

FIG. 24 is the section view of the golfrisbee having the punched through fitting screw cap and the boomerang wing segment with the angle of attack being adjustable; (A) is the bottom view of the golfrisbee taken at the horizontal line W-W in FIG. 24B; (B) is the horizontal section view of the golfrisbee taken at the horizontal center line in FIG. 24A; (C) is the vertical section view of the golfrisbee taken at the vertical center line Z-Z in FIG. 24A.

FIG. 25 is the section view of the golfrisbee disk-ring; (A) is the bottom view of the golfrisbee taken along the line X2-X2 in FIG. 25B; (B) is the horizontal section view; (C) is the vertical section view taken along the line Y2-Y2 in FIG. 25A.

FIG. 26 is the killer application of the arts of golfrisbee and golh club to golfishing. (A) is the bottom view of the golfrisbee taken along the X3-X3 line in FIG. 26B; the golfrisbee has the exchangeable screw cap and weight-balanced design; (B) is the horizontal section view; (C) is the vertical section view taken along the line Y3-Y3 in FIG. 26A; (D) is the sectional view of the fishing golfrisbee; (E) is the alternative design of the fishing golfrisbee; (F) is the sectional view of the smart fishing golfrisbee; (G) is the block diagram of the smart fishing golfrisbee with video camera; (H) is the block diagram of the smart fishing golfrisbee with sonar; (I) is the smart fishing golfrisbee with single power line; (J) is the fishing line with a single wire; (K) is the smart fishing golfrisbee a pair of wires; the pair of wires might be twisted pair; (L) the differential signal being transmitted on the power line of the (twisted) pair of wire; (M) the (twisted) pair of wires being embedded in the fishing wire; (N) the smart reel having the monitor and the reel; (O) the block diagram of the wireless smart reel; (P) the block diagram of the wired smart reel with the power line being the video signal transmission line, too; (Q) the golfrisbee fishing rod being rest on the fishing power station; (R) the block diagram of the wireless golfrisbee fishing; (S) the block diagram of the wired golfrisbee fishing; (T) the interior structure of the smart reel; (U) the block diagram of the smart reel as shown in FIG. 26T; (V) is the portable golfrisbee fishing in the rest mode; (W) is the portable golfrisbee fishing in the towing mode; (X) is the portable golfrisbee fishing in the pushing mode (Y) is the back view of the golfrisbee fishing in the towing mode; (Z) is the optical charging box for the fluorescence golfrisbee.

FIG. 27 is the golfrisbee static friction controller which has the multi-functions of air compressor, air cleaner and lubricant; (A) is the golfrisbee static friction controller at the idle position; (B) is the golfrisbee static friction controller in the air compression mode; (C) is the golfrisbee static friction controller at the air cleaning mode; (D) is the golfrisbee static friction controller in the lubrication mode; (E) is the inside of the female screw of golfrisbee being coated with the static friction coating; (F) is the outside of the male screw of golh club head being coated with the static friction coating.

FIG. 28 is the airfoil shape of the golfrisbee boomerang wings; (A) is the section view of an airfoil for the lift-upward motion for the right hand rotation golfrisbee; (B) is the section view of an airfoil for the lift-up motion for left hand rotation golfrisbee; (C)) is the section view of an airfoil as shown in FIG. 10D for the lift-upward notion; (D) is the section view of an airfoil for the diving-downward motion of the right hand rotation golfrisbee; (E) is the section view of an airfoil for the diving-downward motion of the left hand rotation golfrisbee; (F) is the section view of an airfoil as shown in FIG. 10D for the diving-downward motion.

FIG. 29 is the two-wheel golh trolley; (A) is the two-wheel golh-pulling trolley; (B) is the integrated two-wheel golh trolley with the golh bag; (C) is the ski type golh trolley; (D) is the belt type golh trolley.

FIG. 30 is three-wheel type portable personal golh cart; (A) is the side view of the portable personal golh cart; (B) the portable personal golh cart stands as standing bag; (C) is the back view of the portable personal golh cart; (D) is the side view of the portable personal golh cart haying the snow ski; (E) is the portable personal golh cart having the snow ski stands as stand-up bag; (F) is the back view of the portable personal golh cart having the snow ski.

FIG. 31 is two-wheel type foldable and portable personal golh cart; (A) is the side view of the personal golh cart; (B) is the personal golh cart stands as standing bag; (C) is the back view of the personal golh cart; (D) is the side view of the personal golh cart having the automatic ski capability; (E) is the personal golh cart having the automatic ski capability and also serving as standing bag; (F) is the back view of the personal golh cart having the automatic ski capability.

FIG. 32 shows the operation of the automatic ski system; (A) is on the hard ground, the ski is not engaged with the ground; (B) is the detailed mechanism of the automatic ski not engaged with the ground as shown in FIG. 32A; (C) is on the soft ground, the ski is engaged with the ground; (D) is the detailed mechanism of the automatic ski engaged with the ground as shown in FIG. 32C.

FIG. 33 shows the operation of the fast installment of the ski shoes of the golh cart; (A) is the shaft of wheel fed into the notch on the ski frame; (B) is the shaft of wheel fed into the guided slot of ski shoe; (C) the lock plate is closed to have the shaft of wheel sealed in the slot; (D) the hook of the spring is mounted on the shaft to have the automatic bias of the automatic operation of the snow ski.

Figure 43B:
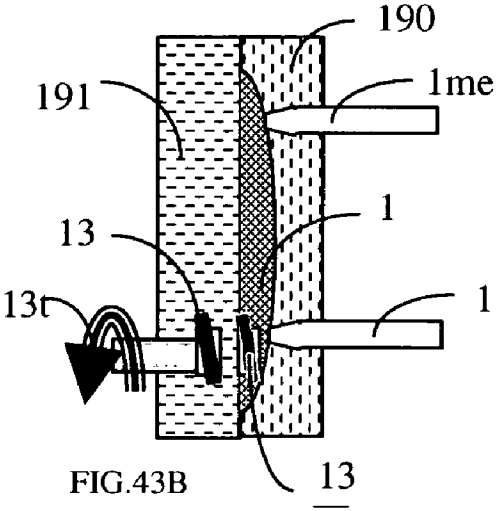
Figure 43A:
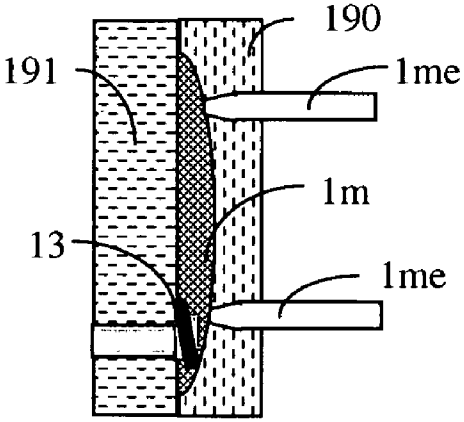
Figure 43C:
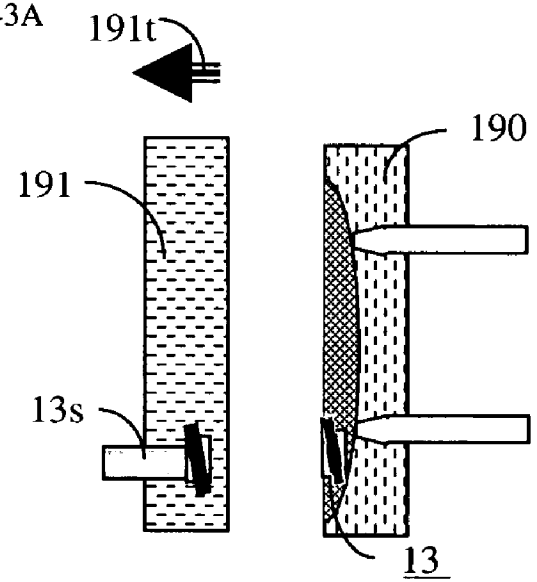
Figure 47A:
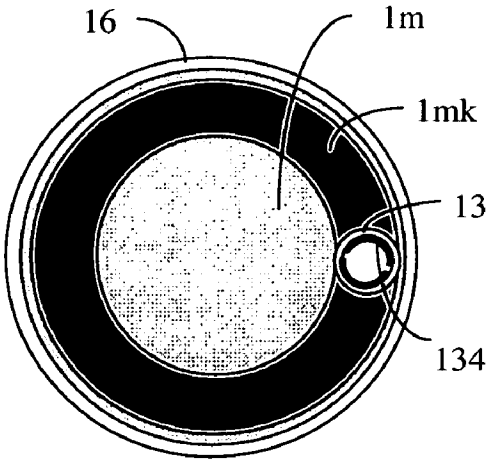
Figure 47C:
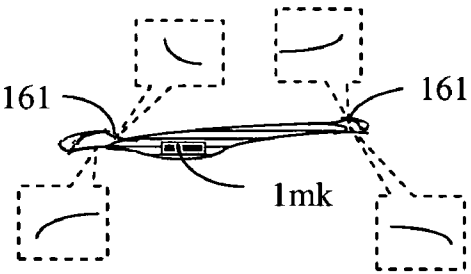
Figure 47C:
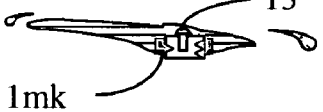

FIG. 43 The plastic injection module for the golfrisbee with double injection; (A) the plastic injection of the elastic material for the main plane which include the screw adaptor; (B) the retrieve and rotation of the screw module; (C) the open of the injection modules, the golfrisbee having no distortion is formed.

FIG. 44 The golfrisbee design for the plastic injection module with triple injection; (A) is the top view of the golfrisbee disk; (B) is the top view of the golfrisbee disk-ring made of three different plastic material; (C) is the sectional view of the golfrisbee disk-ring made of three different plastic material.

FIG. 45 The plastic injection module for the golfrisbee with triple injection; (A) the plastic injection of the elastic plastic material for the main disk; (B) as the module opens, the pore for the screw is formed; (C) the plastic injection of the hard plastic for the golfrisbee having screw; (D) as the module opens, the golfrisbee having screw is formed.

Figure 46A:
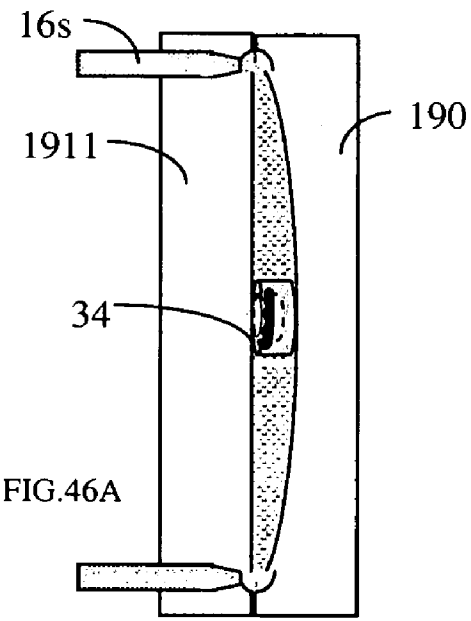
Figure 46B:
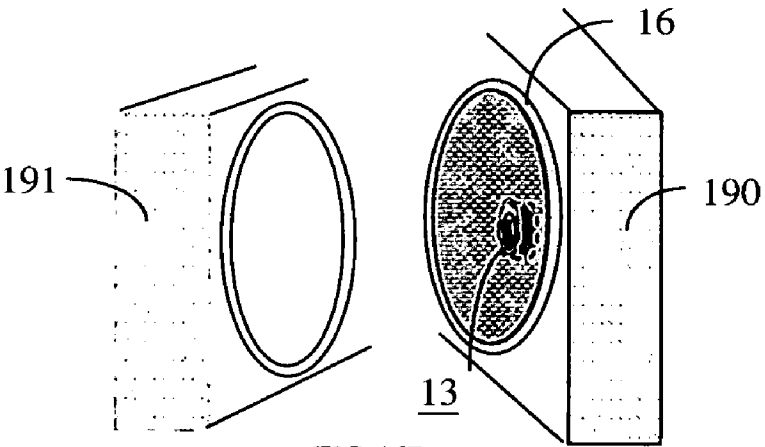

FIG. 46 The plastic injection for the skirt which can be integrated with the double injection or triple injection; (A) the plastic injection of the soft skirt plastic material; (B) the module opens and the golfrisbee is completed.

FIG. 47 The design of the golfrisbee having the backbone plate and it is injected with the triple injection plastic injection module; (A) is the top view of the golfrisbee disk having the backbone plate; (B) is the top view of the golfrisbee ring or disk-ring having backbone plate and it is made of three different plastic materials; (C) is the sectional view of the golfrisbee disk-ring having backbone plate and it is made of three different plastic materials.

Figure 48B:
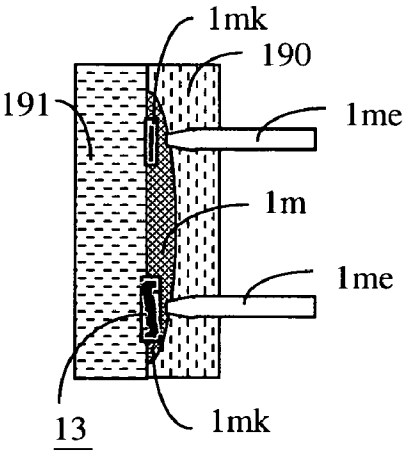
Figure 48A:
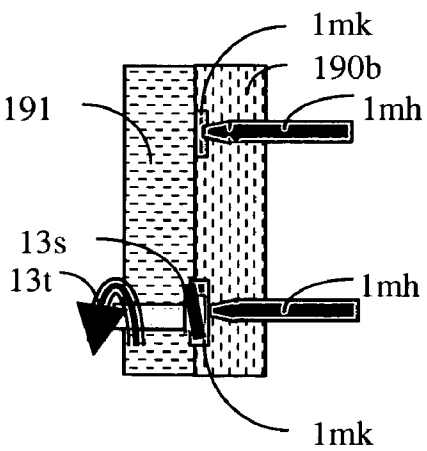
Figure 47B:
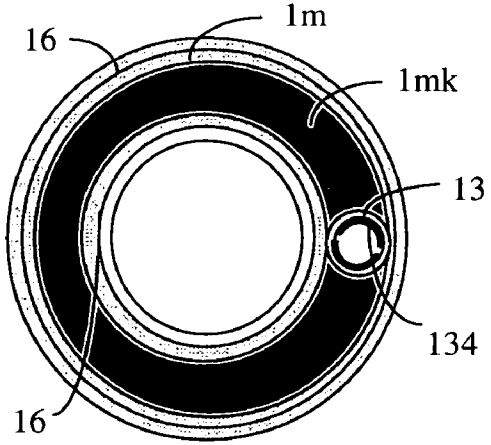

FIG. 48 The backbone plate is injected with the plastic injection which can be integrated with the double injection or triple injection manufacturing process; (A) is the plastic injection of the hard backbone plastic material; (B) is the plastic injection for the main body of golfrisbee having the backbone plate be embedded.

FIG. 49 is the ring-ring pair of golfrisbee; (A) is the top view of ring-ring pair; (B) is the sectional view of ring-ring pair taken at the line K-K in FIG. 49A; (C) is the sectional view of the backbone module of the ring-ring pair; (D) is the sectional view of the rubber/foam plastic module of the ring-ring pair; (E) two material two injection for the friction control screws.

FIG. 50 is the ring-disk pair of golfrisbee; (A) is the top view of ring-disk pair; (B) is the sectional view of ring-disk pair taken at the line L-L in FIG. 50A; (C) is the sectional view of the backbone module of the ring-disk pair; (D) is the sectional view of the rubber/foam plastic module of the ring-disk pair.

DESCRIPTION AND OPERATION

The killer applications of the golh sports and games are illustrated in FIG. 1. The golfrisbee killer application includes a swiveling golh club 2 and a flying golfrisbee 1. The golh club 2 comprises a pole, handle 5 and a golh head 3. The golh head comprises a pivotal axle for golfrisbee 1 to rotate. The golh head 3 and handle 5 are located at different ends of pole. Holding handle 5 to swivel the pole, the golfrisbee 1 pivotally rotates on golh head 3 and takes off from golh head to fly in sky. As shown in FIG. 1A, golh is the hybrid golf sport made of flying golfrisbee 1, golfball 15 and the rolling ball 151. Golfrisbee is the sport to swivel club 2 to launch flying disk 1 to fly. Golfball is the sport to swivel club 2 to throw ball 15. In golh sport, the long drive adopts the flying golfrisbee 1 or golfball 15 as shown in FIG. 1A; the putting adopts the basket 18 for disk 1 or the hole 6 for golfball 15 as shown in FIG. 1A and FIG. 7. The flag 18*f* is mounted at the top of the golfrisbee basket 18. The golh player needs to adjust the way to throw the golfrisbee to compensate the influence of the wind direction and wind speed. The flag 18*f* not only marks the destination and basket/hole number but also indicates the wind direction and wind speed.

Figure 1A:
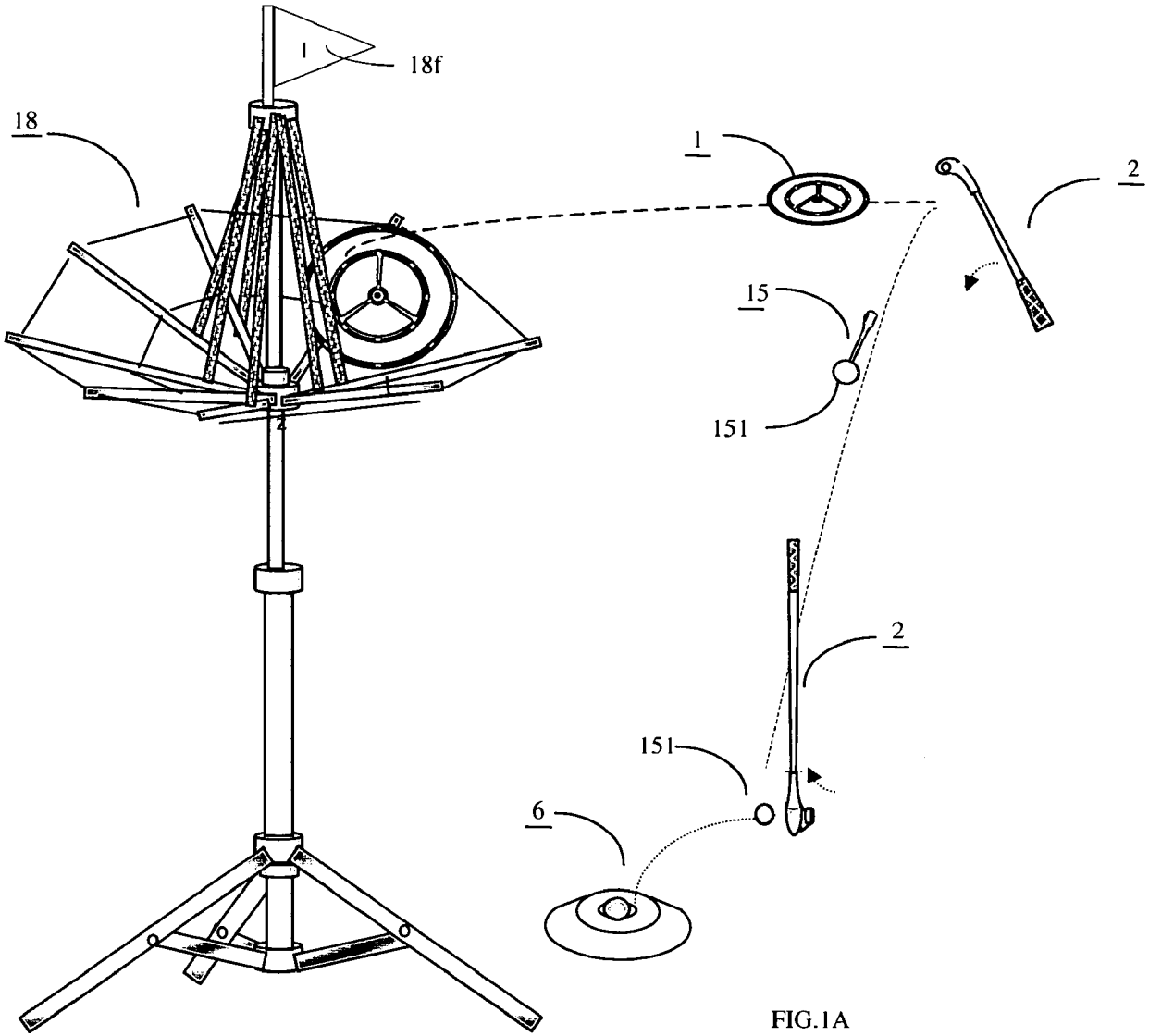
Figure 1B:
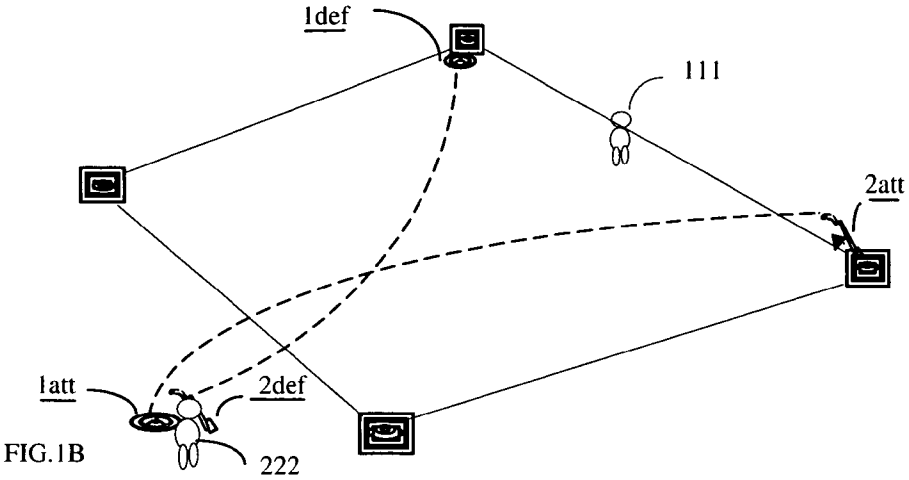
Figure 39:
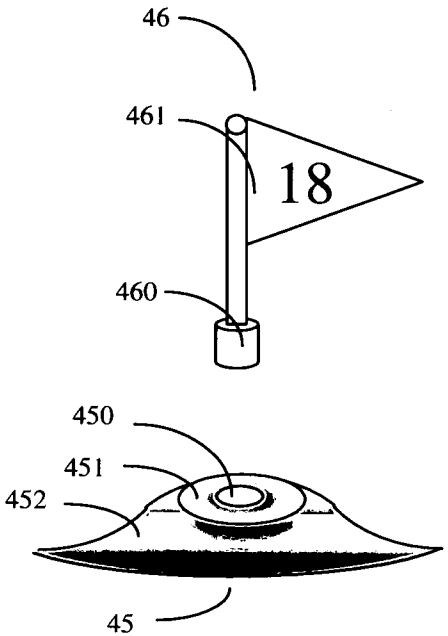
FIG. 39 is the portable base for the golh putting and base-disc.

As shown in FIG. 1B, the golfrisbee can be played as the baseball and is referred to be the basedisc. The attacker 111 swivels the golh club 2*att* to launch the basedisc 1*att* and runs. The defender 222 catches the basedisc 1*att* then swivels the golh club 2*def* to launch the basedisc 2*def* to block the attacker 111. As shown in FIG. 1A and FIG. 1B, to play the basedisc or golh in the park, we need to have the portable base or portable-putting hole. As shown in FIG. 39, the golh system pack includes the universal portable putting base 45 for both the basedisc and park golh. The specially designed golfrisbee adopted in the basedisc sport is referred as basedisc. The basedisc is smaller and heavier than golfrisbee adopts in the golh sport. The basedisc is the golfrisbee type-flying disk launched with the swivel of golh club. The basedisc 1*att* and 2*def* fly as fast as the baseball does.

Figure 1C:
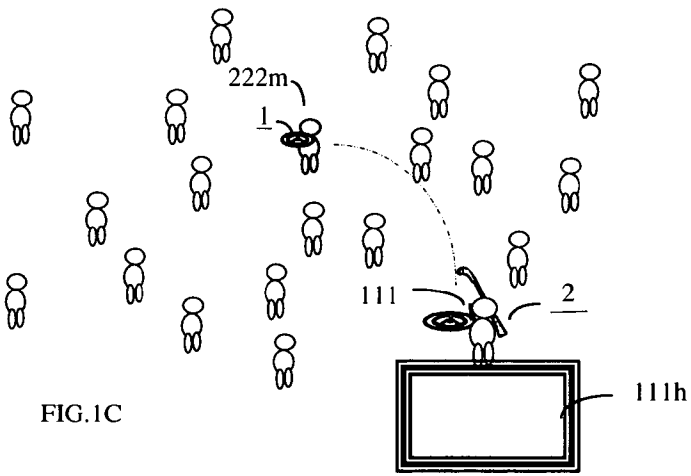

FIG. 1C shows the application of the golfrisbee on the match game of the date of boys and girls. The girl 111*w* stands on the high tower 111*h*. The boys 222*m* wish to be dated stand on the ground. As the girl 111*h* finds out the boy 222*m* who wishes to date, the girl 111*h* throws the golfrisbee 1 with the swivel of the golh club 2. The boy 222*m* catches the golfrisbee 1 and he has the right to ask for the date of the girl 111*h*. This is the match game with the golfrisbee. The girl picture may be stick to the golfrisbee as the target paper 88 in FIG. 19H does. The round target 88 can be stick to a glassy paper 882 with glue 881 to be printed with conventional color printer. Later the round target can be detached from the glassy paper 882 to attach on the golfrisbee 1*r*.

Figure 1D:
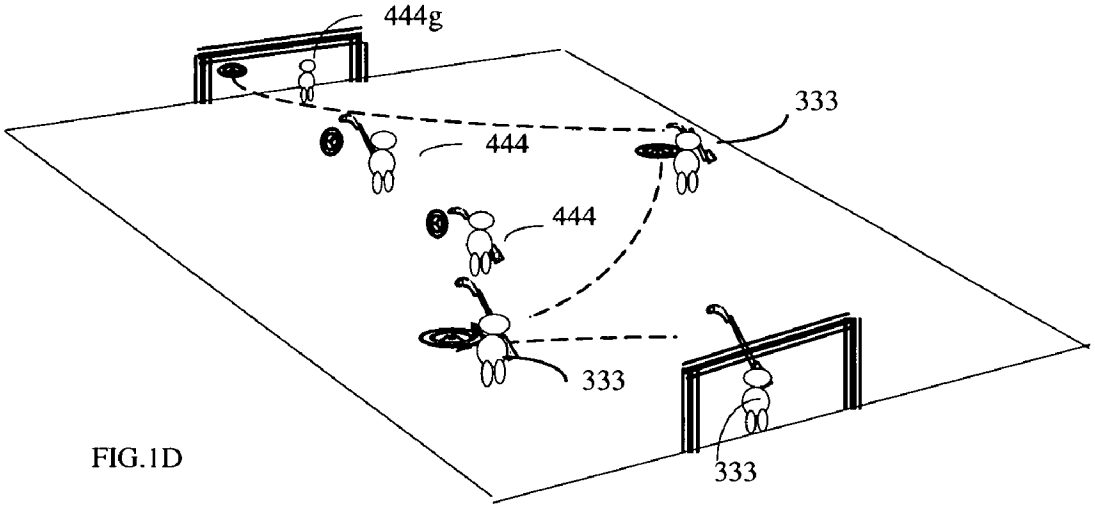

FIG. 1D shows the handisc sport to play the golfrisbee according to the football game rules. The gatekeeper 333*g* can use two hands to catch the golfrisbee. The gatekeeper 333*g* can use either hand or golh club 2 to pass the golfrisbee 1 to the player 333. Each team player 333 or the enemy's player 444 has one golfrisbee hang on the golh club 2. As soon as the player 333 or player 444 received the passed golfrisbee with left hand, the player 333 or 444 can swivel the golh club to launch the golfrisbee disk to pass or attack the gate. As the golfrisbee is thrown out, the player takes time to mount the golfrisbee on the club again. As shown in FIG. 1D, the golhers 333 pass golfrisbee and attack the gate; the enemy's gatekeeper 444*g* tries to catch the attacking disk.

Figure 1E:
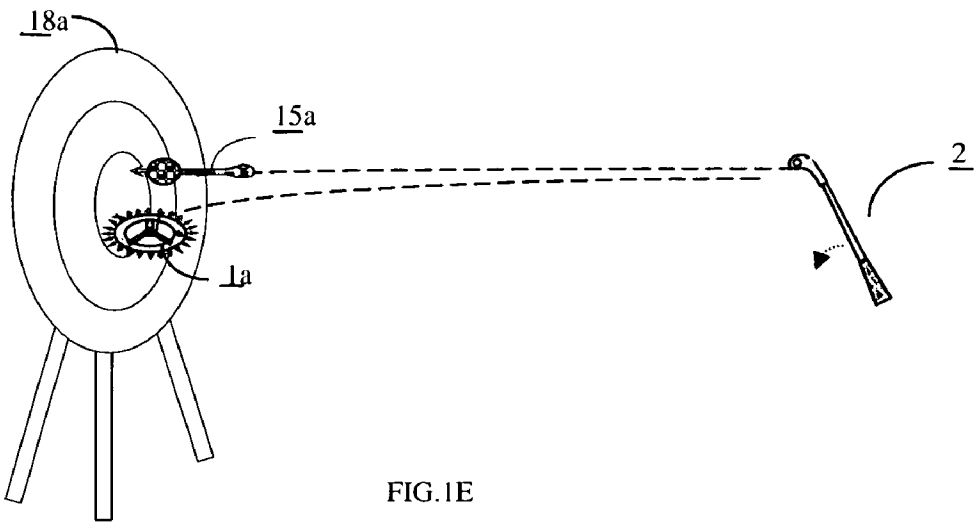
Figure 1F:
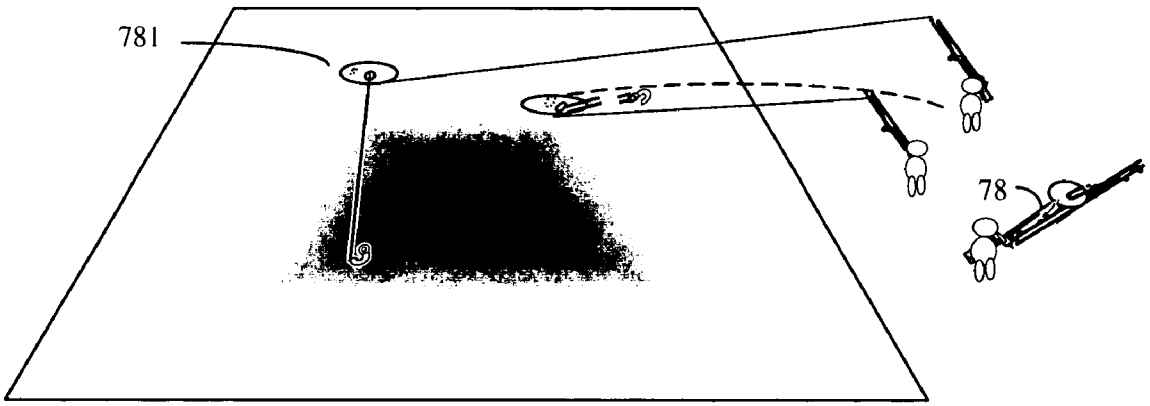
Figure 1G:
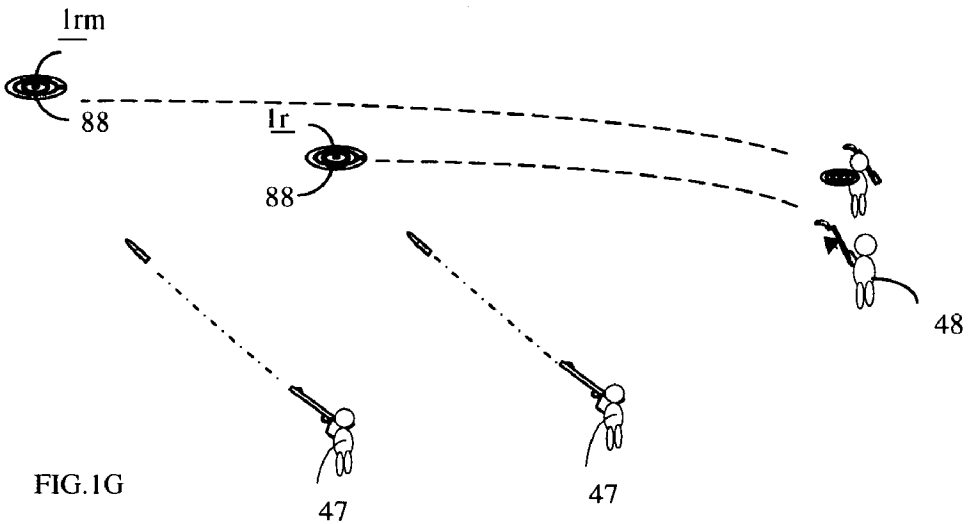
Figure 1H:
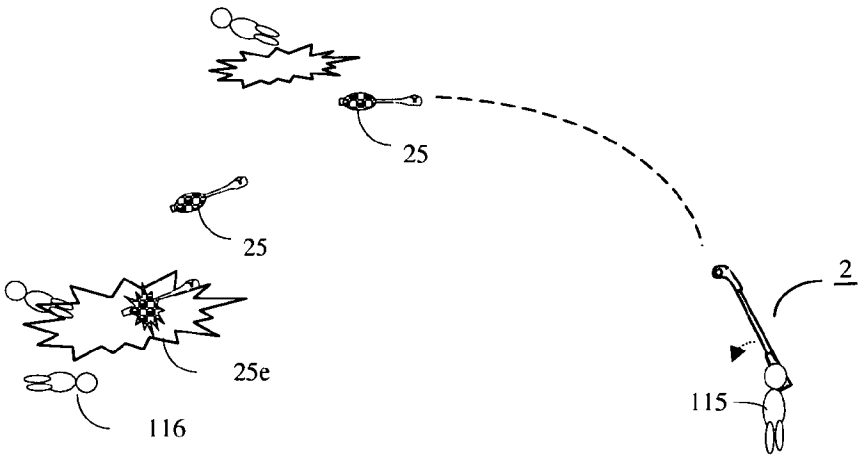

FIG. 1E shows the golh sport can play as the arrow shooting gain. Swiveling the golh club, the golfball type arrow 15*a* or the golfrisbee type arrow 1*a* is shot at the target 18*a*. FIG. 1F shows the golfishing with the fishing golfrisbee 781. FIG. 1G shows the shooting practice of hunting with the flying golfrisbees 1*r* being targets. Swiveling the golh club having the golfrisbee 1*r* been attached said target paper 88, golfrisbee 1*r* becoming a flying target 1*t* of hunt shooting practice. The hunter 47 shoots the flying target of golfrisbee 1*r* being thrown by the golher 48. The golhers 48 swivel the golh club 2 to launch the golfrisbee 1*r* to fly. The golfrisbee 1*r* has the target sheet 88. The hunters 47 fire the gun to shoot the flying target 88. FIG. 1H shows the soldier 115 throwing the grenade 25 to bombard the enemy 116. The golh club thrown grenade 15*g* is composed of a smart grenade 25 and the handle 15*h*. The golh grenade is pivotally mounted on golh club head with club head adapter 13. Swiveling the golh club, the golh grenade pivotally rotates due to eccentric force and takes off to fly to throw toward an enemy target. The exploding grenade 25*e* kills the enemy 116. FIG. 2 shows the standard golfrisbee basket 18*wcp* approved by the PGFA (Professional GolFrisbee Association). This is a portable type golfrisbee basket 18*wcp* to have the golf course converted to be the golh course. Instead of using hand-throwing disk as the disk golfer does, the golher swings the golh club 2 to launch the golfrisbee 1 to fly into the golfrisbee basket 18. On the golh course, there are many golfrisbee baskets 18. The golfrisbee basket 18 corresponds to the hole in the golf course. In golh sport, the golher launches the golfrisbee 1 to fly into the basket directly with the golh club 2. For the course golh, there is no tee-time requirement for the golfrisbee. The golher can play golh in the course any time and any place.

Figure 2S:
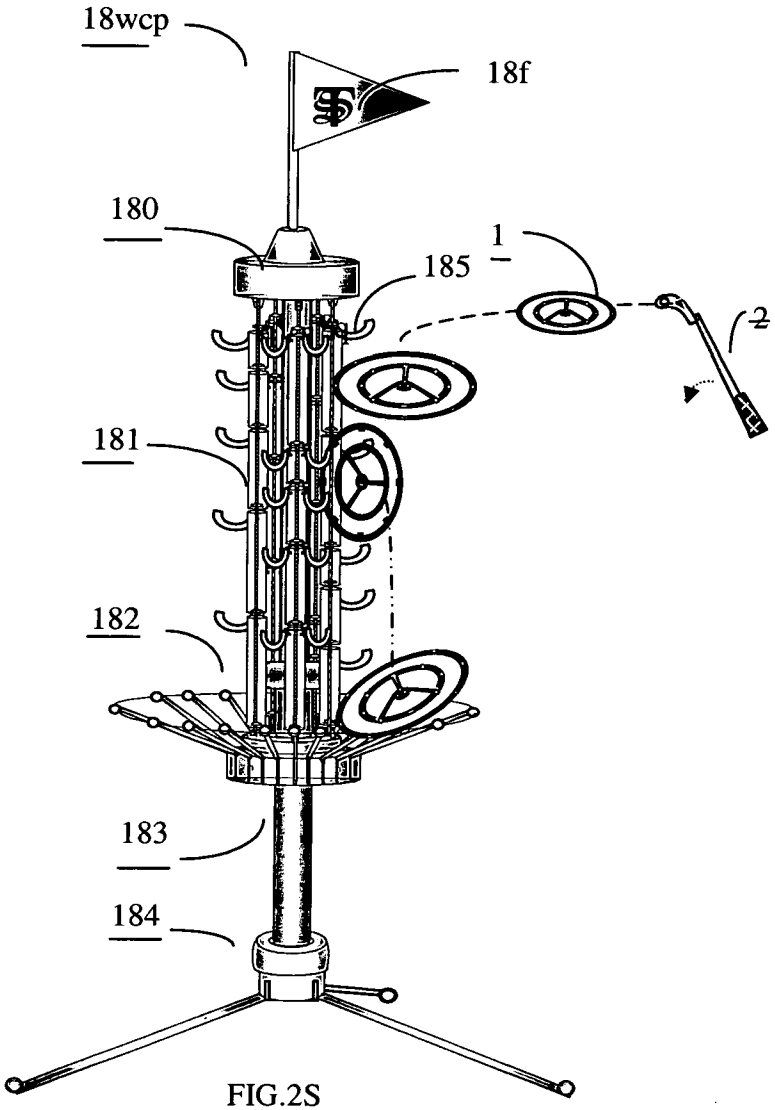
Figure 2A:
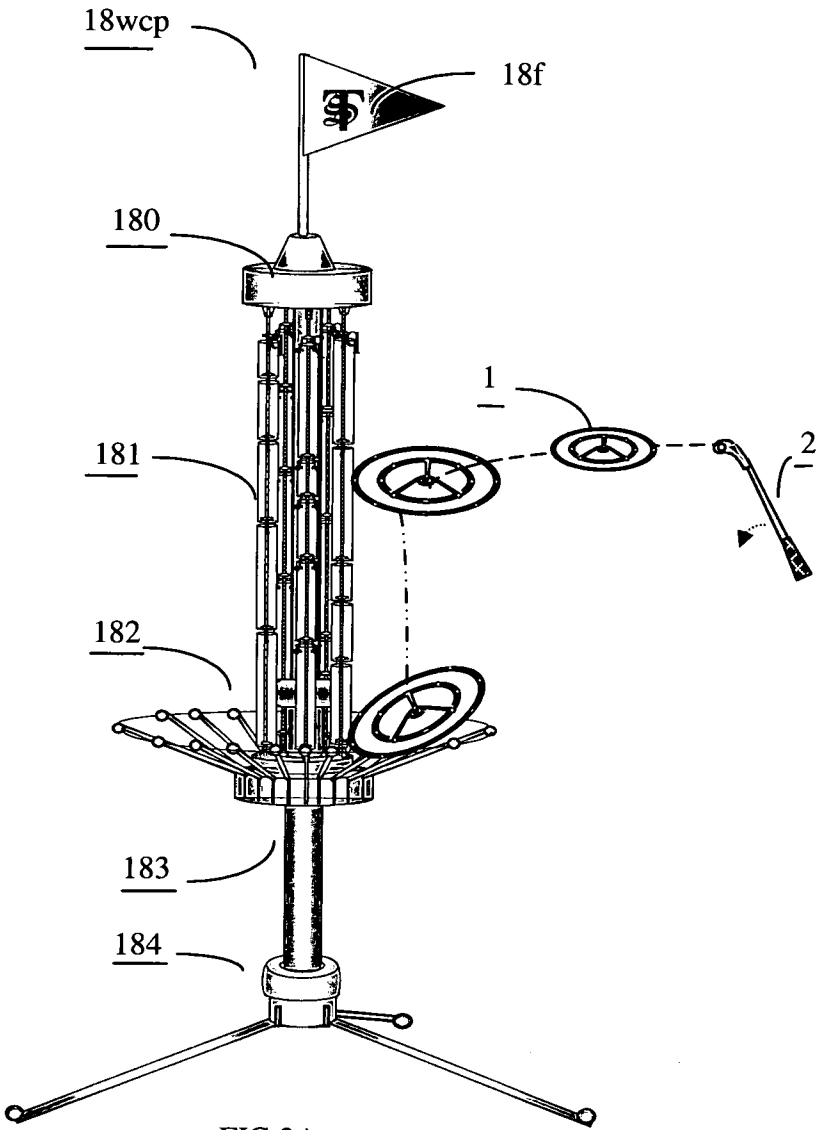
Figure 2T:
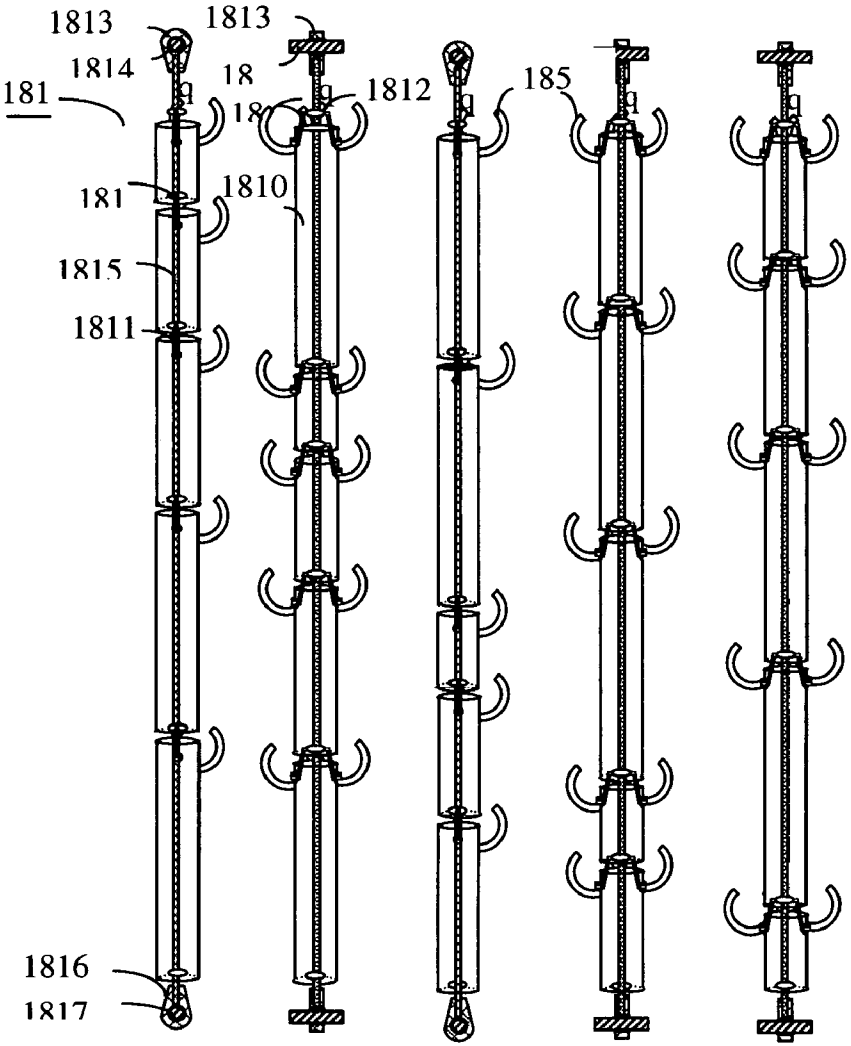
Figure 2B:
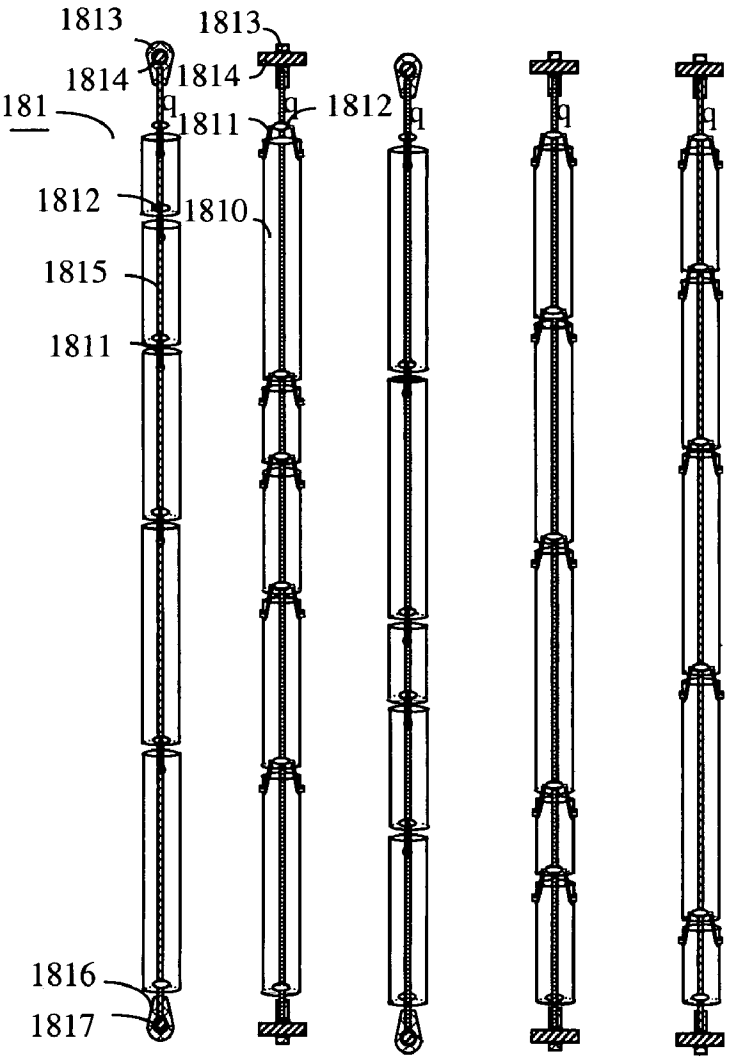
Figure 2G:
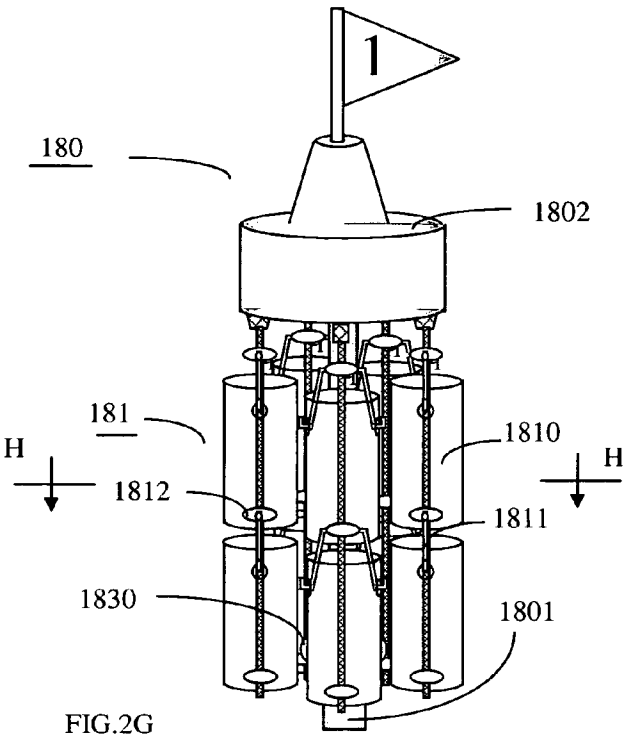
Figure 2H:
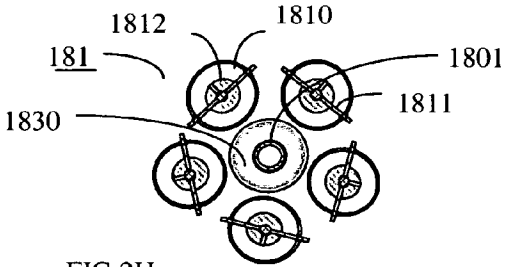
Figure 2C:
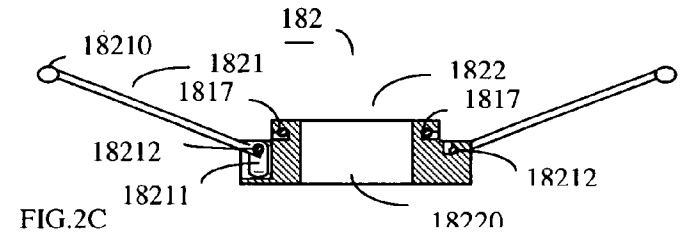
Figure 2D:
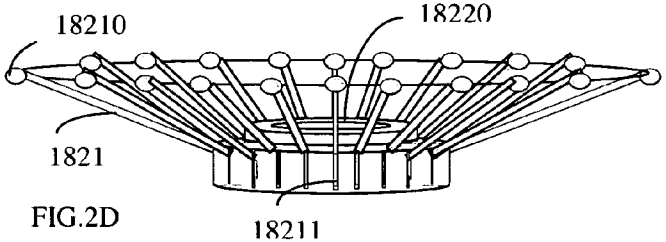
Figure 2E:
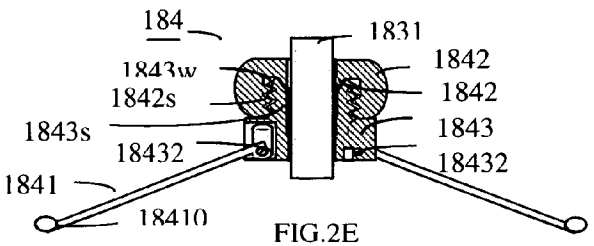
Figure 2F:
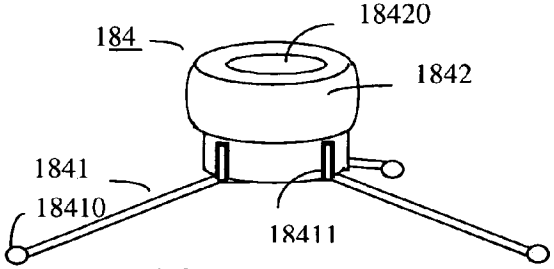
Figure 2R:
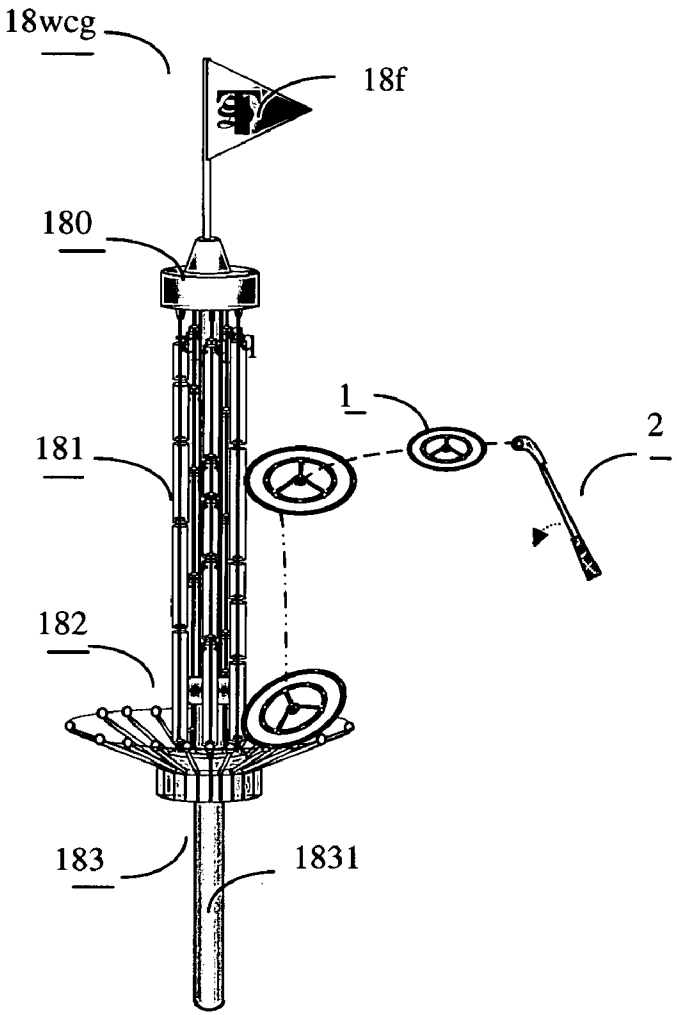
Figure 2Q:
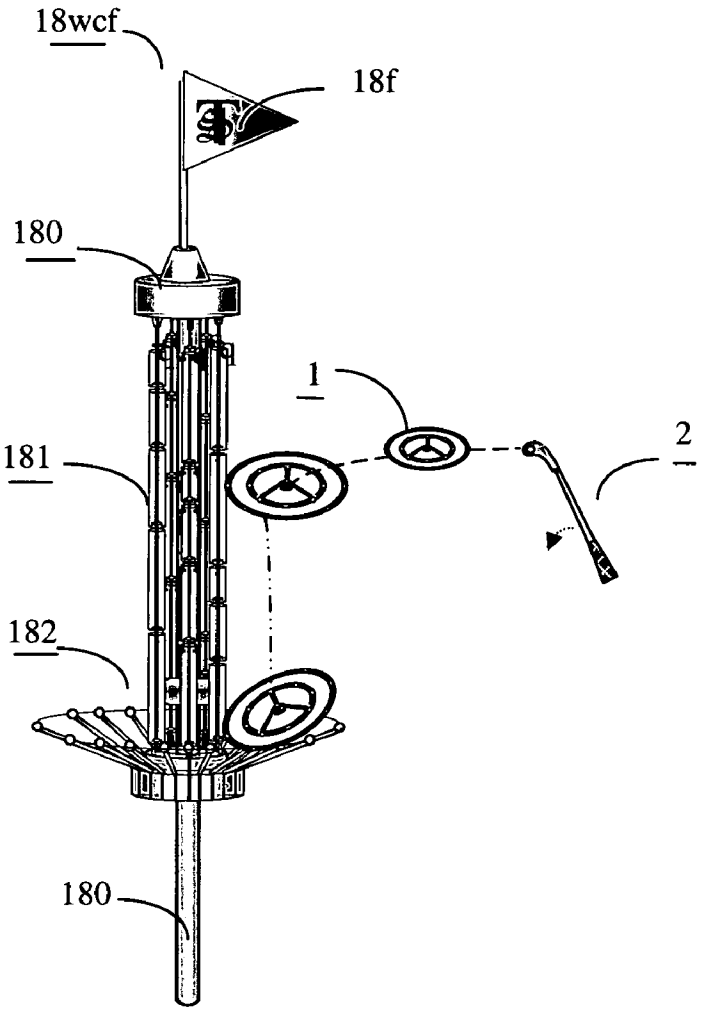

For the fixed type golfrisbee basket, there is no need for the stand 184 as shown in FIG. 2Q and FIG. 2R. The flag 18*f* gives golher the indications for the wind direction and the wind speed. As shown in FIG. 2A, in the golfrisbee sport, the golfrisbee 1 must be thrown by the golh club 2 to fly and fall into the basket 182 just as the ball rolls into the hole as the golf sport does. To absorb the impact of the golfrisbee 1 and increase the possibility of the golfrisbee 1 to fall into the basket 18*wcp* from any direction, the basket 18*wcp* adopts the wind-bell-chain 181 and the basket 182 having small diameter reverted umbrella structure.

The night golh and snow golh have the long drive with the flying golfrisbee 1 and putting with golfrisbee 1 or the rolling golf ball 151. The snow golh and night golh do not conflict with the existing golf sport activities. The snow golh and night golh can do the time-sharing with golf for the same golf course. So, the portable golfrisbee basket 18*wcp* is invented that the golh can time share with the golf of the conventional golf course. To make the putting of the golfrisbee 1 have the same difficulty as the putting of the golf ball does, the outside diameter of the bundle made of the wind-bell-chain 181 is small. However, the diameter becomes small, the golfrisbee is easily damaged. Therefore, the small cross section golfrisbee basket 18*wcp* has the special design to reduce the impact force. The special design is the wind-bell-chain 181. As the golfrisbee 1 hits on the wind-bell-chain 181 and/or falls in the reverted-umbrella basket 182, the wind-bell-chain 181 and the reverted-umbrella basket 182 swivel and generate the music sound of wind chain. The kinetic energy of the flying golfrisbee 1 is converted to the acoustic vibration energy of the wind chain 181. The swivel movement of the wind-bell-chain 181 serves as the buffer to protect the golfrisbee 1 from damage.

The wind-bell-chain 181 has a long dimension. The putting art of golfrisbee 1 is the golher has to control the force correctly. If the force is too large, the golfrisbee will bounce back and fall outside the reverted umbrella basket 182. As shown in FIG. 2B, the wind-bell-chain 181 is made of the multiple sections of wind-bell 1810. To have the harmonics of music, the wind-bell tube 1810 has the different length. Furthermore, to have the different harmonic combination, for different string of the wind-bell-chain 181, the different length wind-bells 1810 are aligned cyclically. As shown in FIG. 2G and FIG. 2H, the wind-bell-chains 181 are hanged around the supporting pole 1801. To make the wind-bell chain generate the music sound, the wind-bell-chain must be hanged near vertically. The tube 1810 only can hit on the dangling pan 1812. As the tube 1810 touches on dangling pan 1812, the sound cannot be generated. Therefore, the swivel amount of the wind-bell-chain 181 is small. Therefore, as shown in FIG. 2J, there is a pan 1830 to limit the swivel of the wind-bell-chain 181 and the basket 182. The conventional wind chain stands still. It is hit outside to generate sound. The conventional bell moves and is hit inside to generate sound. As shown in FIG. 2K and FIG. 2L, the wind-bell-chain 181 has the hybrid characteristics of both the bell and the wind chain. The tube 1801 of wind-bell-chain 180 swivels on the link 1811 and hit by the pan 1812 from inside the tube 1801 as the bell does. The pan 1812 clamps on the string 1815. The pan 1812 supports the fork 1811. The linkage of fork 1811 passes through the holes 1810*n* of the cylindrical tube 1810. The fork 1811 has the hook 1811*m* to hold the tube 1801. As the cylindrical tube 1810 dangles and swivels on the fork 1811, the bottom of the cylindrical tube 1810 hits on the pan 1812 and the music sound is generated. In the conventional bell and wind chain, the moving pan hits the walls of bell and wind chain. For the wind-bell-chain 181, the moving wall of the cylindrical bell 1810 hits the pan 1812. This operation is the reversed operation of the conventional bell and wind chain.

As shown in FIG. 2I and FIG. 2J, the wind-bell-chain 181 is hanged beneath the hanging cap 180. The string 1814 passes through the hole of hanger 1813 and the slot 1803 in the hanging cap 180 to hang up the wind-bell-chain 181. To increase the swivel of the wind-bell-chain, the hanging cap 180 is supported on the universal joint type ball 18010. To swivel only, the hanging cap 180 might be supported on one pinpoint. However, for the fixed golfrisbee basket, to keep the theft from stealing the wind-bell-chain 181, we need to use the ball joint to lock the wind-bell-chain 181 to the supporting pole 1801 as shown in FIG. 2Q. As the wind-bell-chain 181 swivels, the hanging cap 801 rolls on the ball joint 18010. There is a lot of space 1800 reserved for the free roll movement of the hanging cap 180. With the free roll mechanism of the hanging cap 180, the whole wind-bell-chain 181 can free to rotate as the conventional wind chain does.

The light 180L is for the night golf. In the night, the light 180L shines on the flag 18*f*, the wind-bell chain 181 and the reverted umbrella 182. With the lights 180L, the golher can see the golh basket 18*wcp* in the night and swivels the golh club 2 to launch the golfrisbee 1 to fly toward the golfrisbee basket 18*wcp*.

Without the free roll mechanism of the universal joint type ball 18010 of the cap 180, the wind-bell-chain 181 and the foldable basket 182 cannot swing. The wind-bell-chain absorption capability of the impact energy will be reduced a lot. Both the golfrisbee basket 182*cp* and the golfrisbee 1 will be damaged due to the hit impact of the golfrisbee 1. Therefore, the free roll mechanism of the universal joint type ball 18010 is the core technology of the golfrisbee basket 18*wcp*.

As shown in FIG. 2C and FIG. 2D, to be portable, the basket 182 is in the shape of the reverted umbrella. The L-shaped basket bone 1821 pivots on the string 18212 as the umbrella bone does. In the normal operation, the end 18211 leans against the wall of the basket ring 18220. In the portable mode, the L-shaped basket bones 1821 rotate and concentrate to be a bundle of ribs just as the umbrella does.

As shown in FIG. 2A, FIG. 2G, FIG. 2H, FIG. 2I and FIG. 2J, to be portable, the supporting pole 1801, the lock screw 1830 and the stand pole 1831 can pass the hole of the basket support 18220. The lock screw 1830 has the pan structure to hit the outside of tube 1810 as the conventional wind chain does. The lock screw 1830 is to limit the swing of the wind-bell-chain 181. As the dangling wind-bell-chain 181 hits on the pan of the lock screw 1830 with the impact force and the wind-bell-chain 181 will bounce back to swing in the reverse direction. The dangling tubes 1810 will continue swinging in the original moving direction that the tube 1810 hits on the pan 1812 on the inside of the tube wall. This process is similar to the emergency brake of the car, all the passengers continue moving forward and hit by the blockages.

Therefore, there are three different hit mechanisms to generate the music sound of the wind-bell-chain 181. The first hit mechanism is the flying golfrisbee 1 hit on the outside of tubes 1810 and the wind-bell-chain 181 begins to swing. The second hit mechanism is the pan of the lock screw 1830 hits on the outside of tubes 1810 of the swinging wind-bell-chain 181. The third hit mechanism is the dangling tubes 1810 hit on the pans on the inside wall of the tubes 1810 during the swinging wind-bell-chain 181 hitting on the pan of the lock screw 1830.

Since the tube 1810 swiveling only in one direction, as shown in FIG. 2H, the fork 1811 is aligned in the tangent direction of the circle. As shown in FIG. 2B, the upper hanger 1813 and the lower hanger 1816 keep the tubes of the wind-bell-chain in the correct direction. The upper hanger 1813 passes through the string 1814 inside the hanging cap 180 as shown in FIG. 2J; the lower hanger 1816 passes through the string 18212 as shown in FIG. 2C. The strings 1814 and 18212 are in circle shape.

As shown in FIG. 2E and FIG. 2F, the stand 184 of the portable wind-bell-chain golfrisbee basket 18*wcp* has the similar structure of the basket 182. The only difference is that the stand 184 has only three legs 1841 and the legs 1841 are much stronger than the rib 1821 of the basket 182. The stand legs 1841 pivotally rotate on the string 18432 and bears against the cylindrical wall 1843 of the stand 184.

As shown in FIG. 2M, the portable wind-bell-chain golfrisbee basket adopts the lock screw technology. There are a circular wedge 187*w* on the female screw 187 and a circular wedge slot 188*w* on the male screw. On the circular wedge 187*w*, there are multiple cut 187*c*. As the female screw 187 rotates in the engaging direction, the wedge slot 188*w* squeezes the wedge 187*w* toward the center of the screw 187 to lock the pole passing the screw. As shown in FIG. 20 and FIG. 21, the wedge slot 1831*w* squeezes the wedge 1830*w* to engage and lock the extension pole 1801. As shown in FIG. 2P and FIG. 2E, the wedge slot 1843*w* squeezes the wedge 1842*w* to engage and lock the stand pole 1831.

Releasing the lock of the compact lock crew mechanisms, the reverted umbrella golfrisbee basket 18*wcp* with the wind-bell-chain is easily retracted to a portable size. As shown in FIG. 2I, FIG. 2J and FIG. 2A, rotating the female screw 1830 in the disengaging direction, the lock of the supporting pole 1801 is released. The supporting pole 1801 can slide into the stand pole 1831. As shown in FIG. 2A and FIG. 2D, the ribs 1821 are retracted to a bundle as the umbrella does. As shown in FIG. 2E, FIG. 2F and FIG. 2A, rotating the female screw 1842 in the disengaging direction, the lock of the stand pole 1831 is released. As shown in FIG. 2A and FIG. 2F, the stand leg 1841 are rotated downward and retracted to a bundle as the umbrella does. Then the stand 184 can slide upward inside the wind-bell-chain 181. With the lock screw and the rotating ribs and stands, the golfrisbee basket is easy to collapse to be a small package to carry.

As shown in FIG. 2Q, we can easily modify the portable wind-bell-chain golfrisbee basket 18*wcp* to be the fixed golfrisbee basket 18*wcf*. For the fixed golfrisbee basket 18*wcf*, the stand 184 and the stand pole 183 are not needed. As shown in FIG. 2A, FIG. 2P and FIG. 2J, the support pole 1801 is making longer. The support pole 1801 is modified with the addition of a pan as the lock screw 1830 does.

As shown in FIG. 2R, it is the alternative way and the simplest way to modify the portable wind-bell-chain golfrisbee basket 18*wcp* to be the fixed golfrisbee basket 18*wcg*. It is just to take away the stand 184 and buries the stand pole 1831 in the ground directly.

Comparing our invention of the wind-bell-chain reverted umbrella golfrisbee basket 18*wcp* with the conventional disk golf basket, the conventional disk golf basket is very bulky and heavy. Without the free roll mechanism of the universal joint type ball 18010, the conventional disk golf basket is constituted of a large bundle of heavy steel chains. As the flying disk hit on the conventional disk golf basket, the impact will cause the damage of the disk. Therefore, the putting disk of the disk golf has thick rim to increase the contact area to reduce the damage of the disk. Our wind-bell-chain reverted umbrella golfrisbee basket is light and swiveling. It is light and foldable that it is easy to carry as the portable golfrisbee basket. The flying disk hits on the wind-bell-chain reverted umbrella golfrisbee basket; the flying disk will not have damage.

The large bundle of the steel chain of the conventional disk golf basket has no excitation as the putting of the golf ball. The thick rim of the putting disk reduces the performance of the flying disk's flying range a lot. With our wind-bell-chain invention, the section of the wind-bell-chain 181 is as small as the hole of the conventional golf sport does. The putting of golfrisbee disk is as exciting and challenging as the putting of the golf ball does. The golfrisbee 1 doesn't need to have the thick edge that the golfrisbee 1 doesn't lose the performance of flying range. The golher can have birdie eagle or hole-in-one/without the worry of the damage of the golfrisbee disk 1.

FIG. 2S shows the wind-bell-chain golfrisbee basket having the multiple hooks 185 on the wind-bell-chains 181. The wind-bell-chain golfrisbee basket with hooks can be played as game of fortune-teller. Depending on the different hooks the golfrisbees are hanged, there are different fortunes. There are many ways to implement the hooks 185. FIG. 2T shows the hooks 185 being made of the extension of the dangling wire 1811.

Figure 2X:
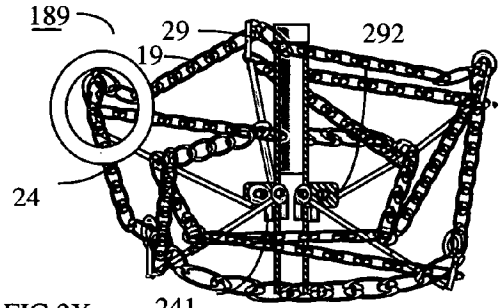
Figure 2Y:
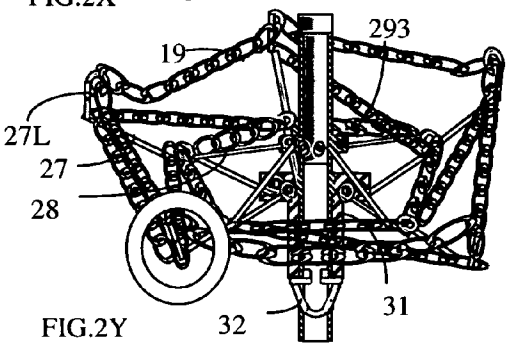
Figure 2Z:
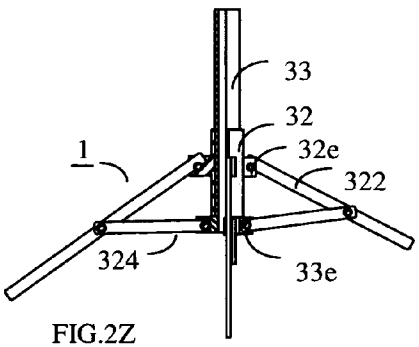
Figure 2U:
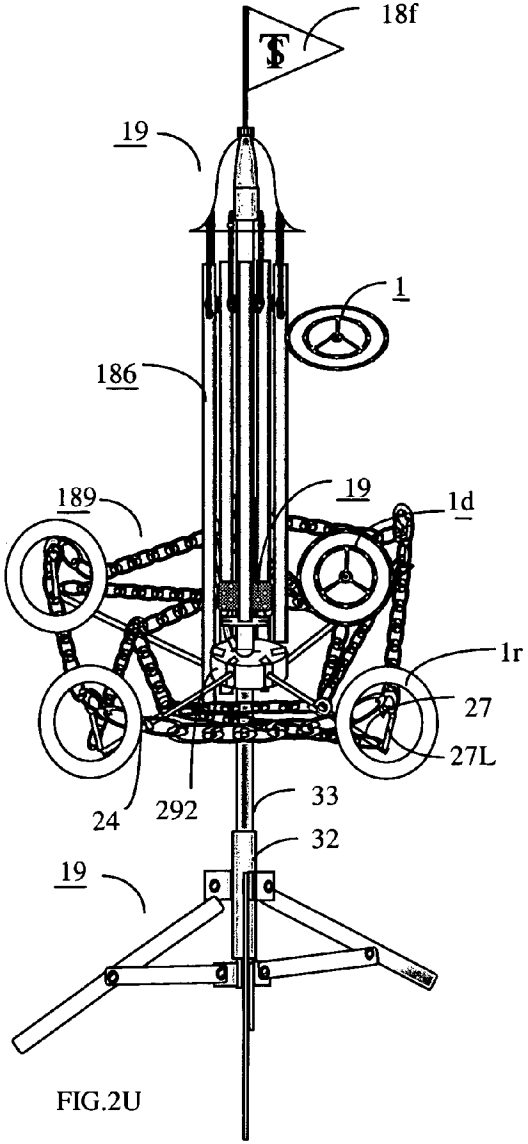
Figure 2W:
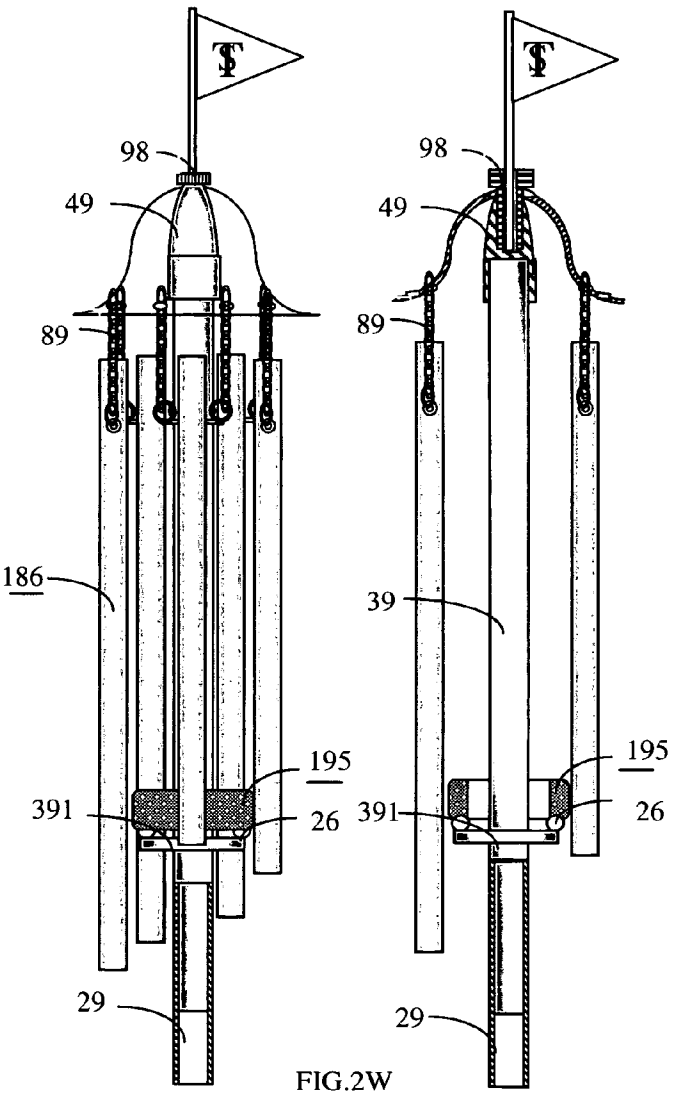
Figure 2V:
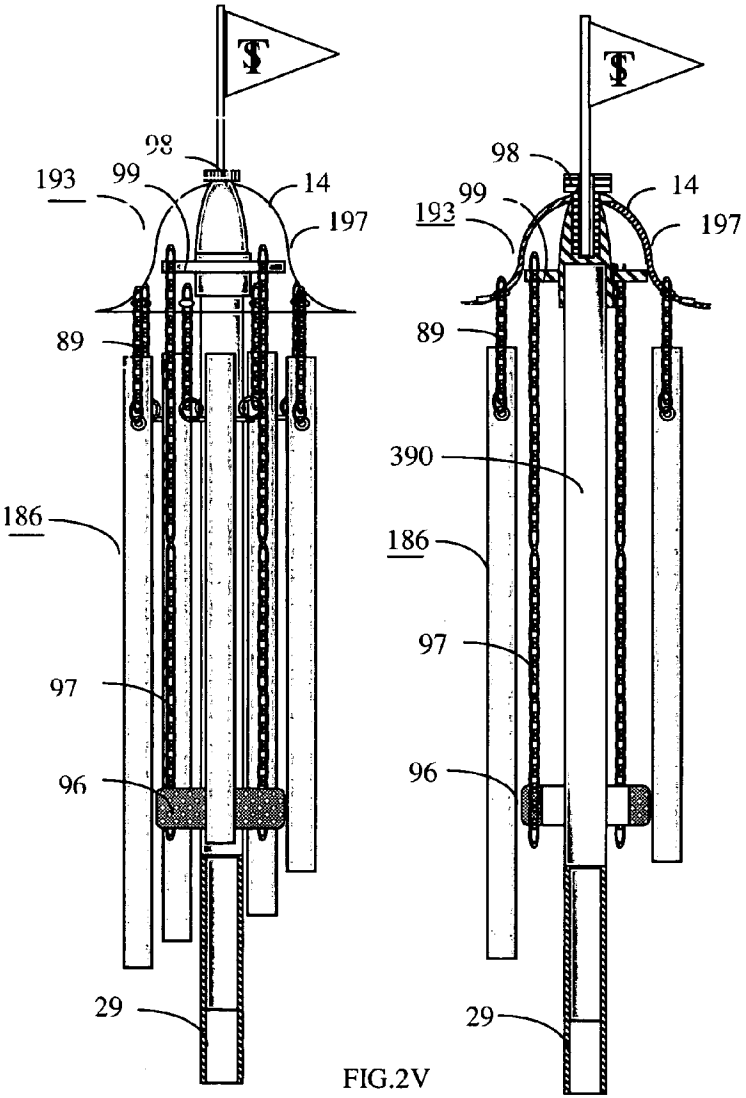
Figure 4L:
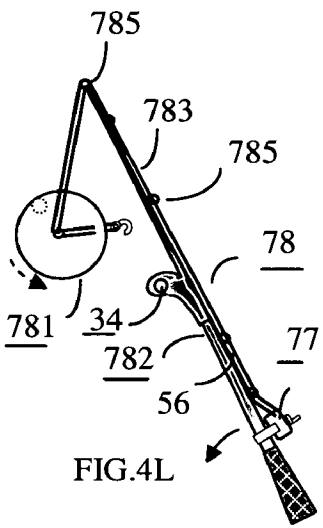
Figure 4J:
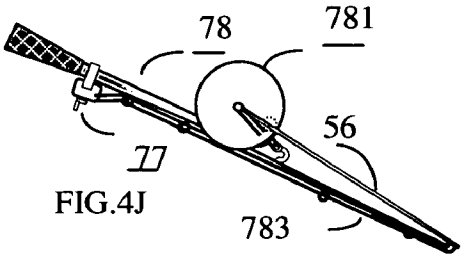
Figure 4K:
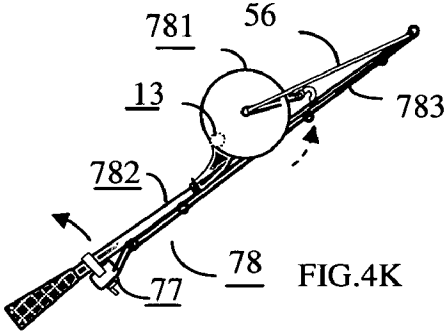
Figure 4I:
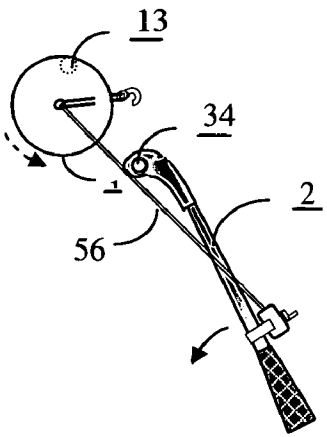
Figure 4G:
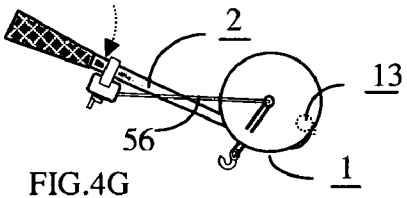
Figure 4H:
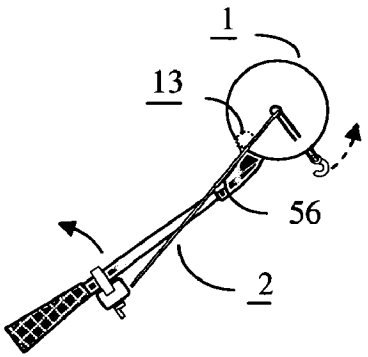
Figure 4M:
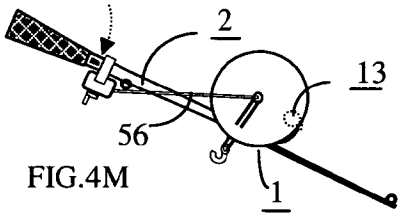
Figure 4N:
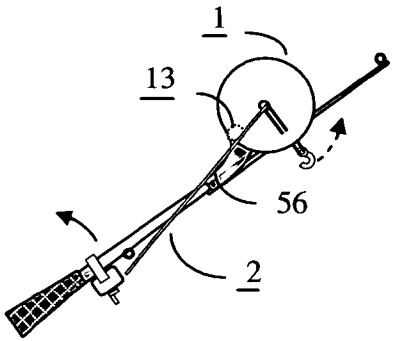
Figure 4O:
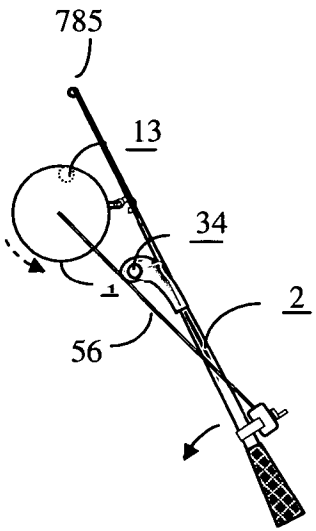
Figure 4P:
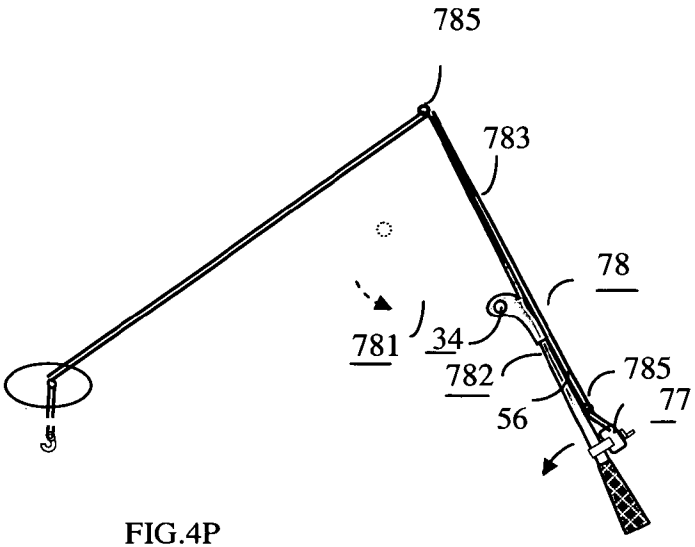
Figure 4Q:
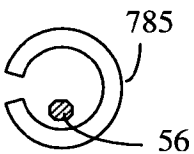

FIG. 2U shows the alternative design of the wind-chime golfrisbee basket. The golfrisbee throwing target of golfrisbee basket comprises wind chiming 186, top hat 193 and post 39 or 390. The top hat 193 installed on a top position of post 39. The wind chiming 186 or 181 comprising a plural of tubes hanging below the top hat 193 with strings 89 around post. The post 39 or 390 passes through the central hole of dangling block 96, 195, or 182. A free swiveling chime block 96 or 195 is to hit and to be hit by tubes of wind chiming 186. As the flying golfrisbee 1 hitting on the tubes of wind chiming 186 or 181, the tubes are hit by flying golfrisbee 1 swiveling to absorb impact energy of golfrisbee 1 and generating melody. As the hit tubes swiveling to hit on free swiveling chime block 96 or 195 or 182, the chime block 96 or 195 or 182 continues moving and hits other tubes. Then the other tubes swivel back and forth and hit on the chime block 96 or 195 or 182 again. This process continues until all the tubes swivel and generate harmonic melody altogether. The wind-chime golfrisbee basket is composed of the wind-chime 193, the web-basket 189 and the tripod 192. As shown in FIG. 2V, the wind-chime tubes 186 are hanged under the top cap 14. The left figure in FIG. 2V is elevation view; the right view in FIG. 2V is the partial exposed view. The top cap 14 is supported on the pole 390. The free swiveling dangling block 96 hangs below the rim 99 of the top cover 197. There is one big hole in the block 96 that the block dangles and hits on the wind-chime tube 186 to generate the melody. As the golfrisbee 1 hits on one wind-chime tube 186, this wind-chime tube 186 will swivel accordingly and hit on the dangling block 96. The dangling blocks 96 hits on the other wind-chime tubes 186 and generate the harmonica melodies. FIG. 2W shows the alternative design of the block 195. The ball bearings 26 are beneath the block 195. The block 195 slides on the platform 391. FIG. 2X shows the portable golfrisbee basket comprises a foldable web basket 189. The foldable basket 189 has a plural of links 24 with one end 241 being pivotally hinged on post 29. The link 24 is pivotally mounted on the flange 292. The link 24 has one end 241 biased against the pole 29. A plural of chains 19 are hooked to links 24 to form a web. The foldable basket 189 is open naturally with the weight of links 24 and web.

The hooked chains 19 are hooked to the link 24 to be web basket. Due to the gravity, the web basket 189 will open automatically. There is no need for the biasing force to open the web basket 189. FIG. 2Y shows the alternative design of foldable basket for the web basket being made of the reverted umbrella structure. The web and links 27 and 28 constitute of a portable basket. The foldable basket has a plural of trusses. The link 27 has an angle hook 27L. The golfrisbee ring 1*r* can be hung on the hook 27L. The golfrishee ring 1r can be hung on the hook 27L.The truss has a first link 27 with one end being pivotally hinged to post 29 and a second link 28 with one end being pivotally hinged to middle portion of the first link 27 and another end being pivotally hinged to a sliding tube 31. The trusses are in an umbrella type structure. A plural of chains 19 are hooked on links 27 to form a webs. Pushing the sliding tube 31 to open up the web and truss and locking it to post 29 to open the foldable basket. Releasing the locking with post 29, the foldable basket is in fold position due to weight of foldable basket. The links 27 are pivotally mounted on the sliding flange 31. The link 28 is hinged at the center of the link 27. Being similar to the umbrella, the web basket is biased to open with the spring lock 32. The alternative design of the partial exposed view of the tripod is shown in FIG. 2Z. The foot bar 322 is pivotally mounted on the sliding tube 32 with hinge 32*e*. The support 324 is pivotally hinged at the fixed flange 33*e*.

Figures 3A, 3B, 3C, 3D:
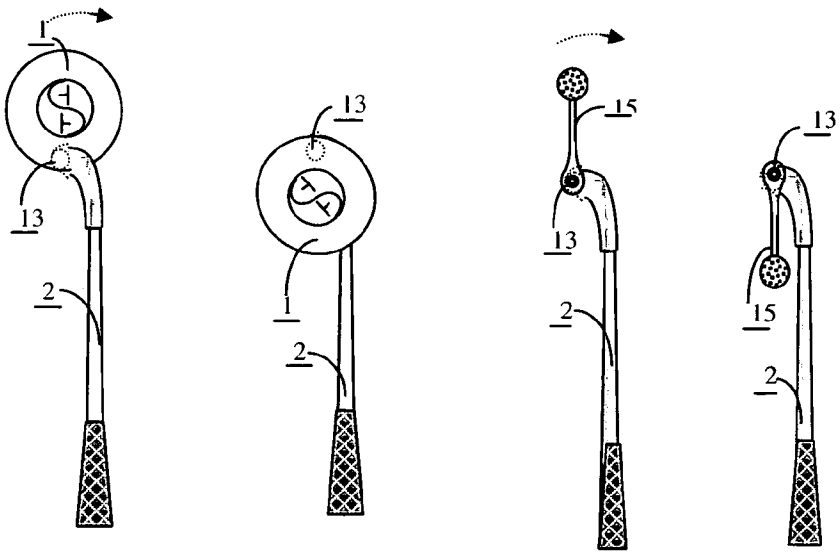

FIG. 3 is an elevation view of the mounting operations of the golfrisbee 1 and golfball 15. As shown in FIG. 3A, the golfrisbee 1 is mounted on the head 11 of golh club 2. Then the golfrisbee 1 is rotated 180 degrees to dangle on the head 3 of golh club 2 as shown in FIG. 3B. As shown in FIG. 3C, the golfball 15 is mounted on the head 3 of golh club 2 with the adaptor 13. Then the golfball 15 is rotated 180 degrees to dangle on the head 3 of golh club 2 as shown in FIG. 3D.

From FIG. 4 to FIG. 6, the mechanics of the golh club operations are analyzed in details. FIG. 4 is the top view of the swiveling operations of the golfrisbee 1 and the golfball 15. As shown in FIG. 4A, the golh club 2 is swiveled back to be ready to throw the golfrisbee 1. As shown in FIG. 4B, due to the eccentric force, the golfrisbee 1 rotates. As shown in FIG. 4C, the golfrisbee 1 takes off and flies in the sky. As shown in FIG. 4D, the golh club 2 is swiveled back to be ready to throw the golfball 15. As shown in FIG. 4E, due to the eccentric force, the golfball 15 pivotally rotates on the golh head. As shown in FIG. 4F, the golfball is thrown into the sky. From FIG. 4G to FIG. 4I, it shows the art of golfishing. The golfrisbee carries the fish line far away from the bank or boat to catch the big fish. In FIG. 4G, the fishing line is attached to the center of the golfrisbee 1. In FIG. 4H, swiveling the golh club 2, the golfrisbee 1 carries the fishing line 56 to rotate. In FIG. 4I, the golfrisbee 1 takes off and carries the fishing line 56 to fly. From FIG. 4J to FIG. 4L show the art of golfishing. The golfishing rod 78 is the combination of the golh club 782 and the fishing rod 783. In FIG. 4J, the fishing line 56 is attached to the center of the fishing golfrisbee 781. In FIG. 4K, swiveling the golfishing rod 782, the fishing golfrisbee 781 carries the fishing line 56 to rotate. In FIG. 4L the golfishing golfrisbee 781 takes off and carries the fishing line 56 to fly. To reduce the friction of the fishing line 56 to increase the flying distance of golfrisbee 13, the golfrisbee 13 is thrown to fly as FIG. 4G, FIG. 4H and FIG. 4K does. After the golfrisbee 13 falls on the water, then the fishing line 56 is hang up at the tip of the fishing pole 783 as shown in FIG. 4L. FIG. 4M, FIG. 4N and FIG. 4O show the golfrisbee 13 being thrown and the fishing line 56 doesn't pass through the hooks 785 to eliminate the friction force of hooks 785 on the fishing line 56. As shown in FIG. 4P and FIG. 4Q, after the golfrisbee 13 falling on the water, the fishing line 56 is put in the center of the hooks 785 through the notch of the hooks 785.

Figure 6A:
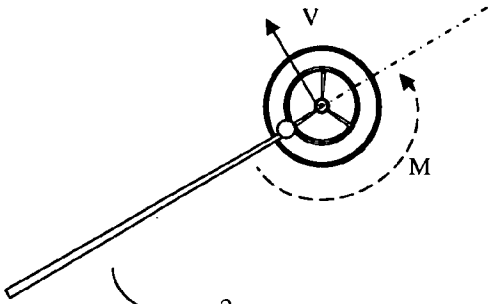
Figures 5A, 5B, 5C:
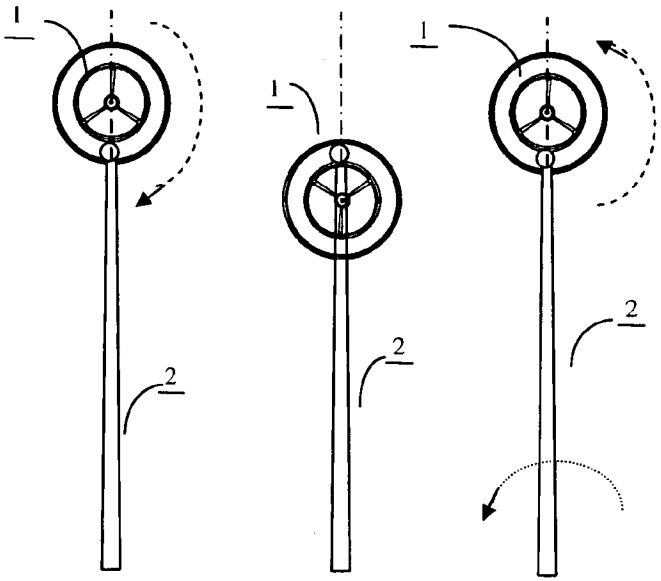

FIG. 6A is to illustrate the most important principle of the golh sport the mounting golfrisbee position is the same as the launching golfrisbee position which is at the vertical straight extension line of the golh club. FIG. 5A shows the golfrisbee 1 is mounted on the head of the golh club 2 at the extension of the vertical straight line of the golh club 2. FIG. 5B shows the golfrisbee 2 rotates 180 degrees and dangles on the head of golh club 2. FIG. 5C shows the golfrisbee rotates 180 degrees due to the eccentric force of the swiveling circle of golh club 2. The golfrisbee launches to fly at the same position of the mounting golfrisbee 1.

Why the golh club 2 throwing golfrisbee disk 1 has such superior ultra long range flying capability. For the other inventions, their poles usually have the moving mechanical part and the clamping force of the mechanical part causes the disk to have a tough take-off. Their disk flying direction is in the radial direction of the swiveling circle or in line with the swiveling pole. Our golfrisbee disk 1 flying direction is in the tangent direction of the swiveling circle of the golh club 2. Furthermore, their eccentric force of the pole swing doesn't generate the rotating momentum of the flying disk. This invention has the following six important characteristics. The first characteristic is to use the eccentric force of the swivel of the golh club to build up the angular momentum of the flying disk. The golfrisbee disk rotates as it takes off from the golh club. The second characteristic is the flying direction of the golfrisbee is in the tangent line direction of the swiveling circle of the golh club. The third characteristic is the clamp-free of the screw mechanism that the golfrisbee is easily to smoothly take off. The fourth characteristic is there are no moving mechanic parts in the engaging and releasing of the golh head and golfrisbee. The fifth characteristic is the golfrisbee-flying plane and rotating plane are in parallel to the golh club swiveling plane. The sixth characteristic is the golfrisbee flying plane and flying direction are in the plane of the golfrisbee disk plane. To be compatible with the superior ultra long range throwing capability, the golfrisbee disk must have the superior aerodynamic design of the rotating airfoil design. The superior launching way and the superior airfoil design of the golfrisbee design make the golh sport have the ultra-long flying distance and superior performances.

The golh is a sport comprising a swivel means of golh club 2, a flying means of golfrisbee 1 and a hanging means of golfrisbee basket 18*wcp*. The golfrisbee 1 is one kind of the flying object only. The golh club 2 can throw many different flying objects such as disk, ring, ball, boomerang, etc. The fitting screw is for flying object pivotally mounted on the club head of golh club 2. The pivotal mount is eccentric to the center of the flying object. The flying object pivotally rotates due to the eccentric force induced by the swivel of club 2. As shown in FIG. 3, the rotation of the flying object is in parallel to a plane of the swivel of the golh club. The fitting screw 13 is pivotally rotating on the club head 34 as the golh club 2 is swiveled with hands. The flying object with the fitting screw 13 is pivotally mounted on the club head 34. The fitting screw 13 has frictionless lock-and-release with club head 34. The flying object is launched to fly based on the directional relation between the club head 34 and fitting screw 13. The club head 34 is located at the end portion of the pole and the flying object is mounted at the end of the club 2. The flying object rotates due to the eccentric force of the swivel of club 2 that the fitting screw 13 pivotally rotates to a position to unlock the frictionless lock with the golh club head 34. The flying object is released and launched to fly.

The fitting screw 13 and club head 34 not only serve as a pivotally rotation but also serve as a directional lock and release. Based on the rotational direction, the pivotal mount of the flying object is locked or released. With the directional lock-and-release mechanism being embedded between the club head 34 and the fitting screw 13, swiveling the pole of golh club 2, the flying object automatically rotates toward outside of the swiveling circle due to the eccentric force. For the directional lock-and-release mechanism, the automatic rotation of the flying object changes the directional relation with the club head 34 from lock to release. The head 34 releases the fitting screw 13 to launch the flying object to fly.

FIG. 6A shows the dynamics of the swiveling golh club 2 at the launching point. At the launching position, the golfrisbee 1 has the tangential velocity V and the angular momentum M. As shown in FIG. 3, swivel the golh club 2 in a circle with hand. The golh club 2 transfers momentum and eccentric force to the flying object. It rotates the flying object to a new direction to release the lock. With the momentum transfer, the flying object is driven to fly in a long distance with a swivel of the golh club 2. The eccentric force causes the pivotal rotation and generates gyroscopic force to stabilize flying object's flying. The directional lock-and-release mechanism is made of fitting screw 13 and club head 34. The pivotal rotation of the flying object causes the lock-and-release mechanism from lock to release.

Figures 6B, 6C, 6D:
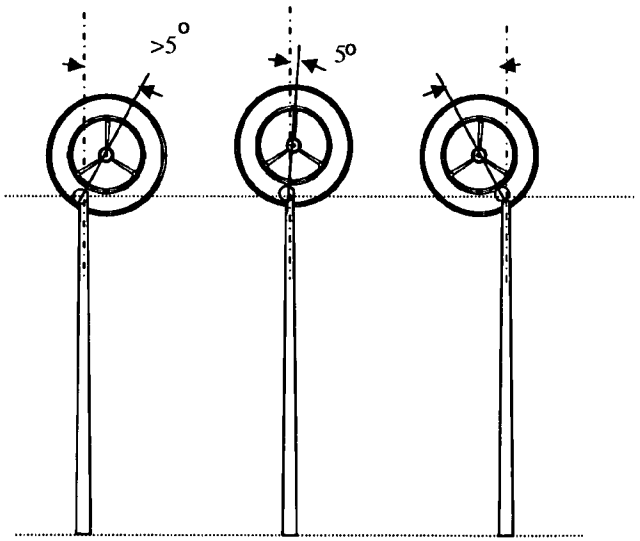

FIG. 6 illustrates the selection of the optimum launching point. As shown in FIG. 6B, the golfrisbee 1 launches before it arrives the extension line of the club pole more than 5 degrees. It is too early to launch the golfrisbee 1. As shown in FIG. 6C, if the golfrisbee launches within 5 degrees before it arrives the extension line of the golh club 2, it is the optimum point to launch the golfrisbee 1. As shown in FIG. 6D, if the golfrisbee launches after it arrives the extension line of club pole, it is too late to launch the golfrisbee 1. There is a very narrow window of 5 degrees for the optimum operation to launch the golfrisbee disk. Swiveling the golh club to launch the golfrisbee disk at the optimum point, which has only 5 degrees of optimum operational window, it is the art of the golh. As shown from the FIG. 9E to FIG. 9I, the pivotal axle 3 has a launching screw 34. The golfrisbee 1 has a fitting screw to mount golfrisbee 1 on launching screw 34. The launching screw 34 or 371 has a screw with its angular position being specified by a starting point of launching screw. The different golfrisbee has the fitting screw 13 with different starting point of launching screw 34. The launching screw 34 or 371 is fixed to the golh head with a fasten screw 35 or 372. The swiveling of the golh club the golfrisbee is released around a position of an extension line of golh club to launch the golfrisbee 1 to fly. To adapt to variance of different golfrisbees having different starting point of fitting screw, adjust the angular position of launching screw with releasing the fasten screw 35 or 372 to allow launching screw 34 or 371 free to rotate.

Figure 7A:
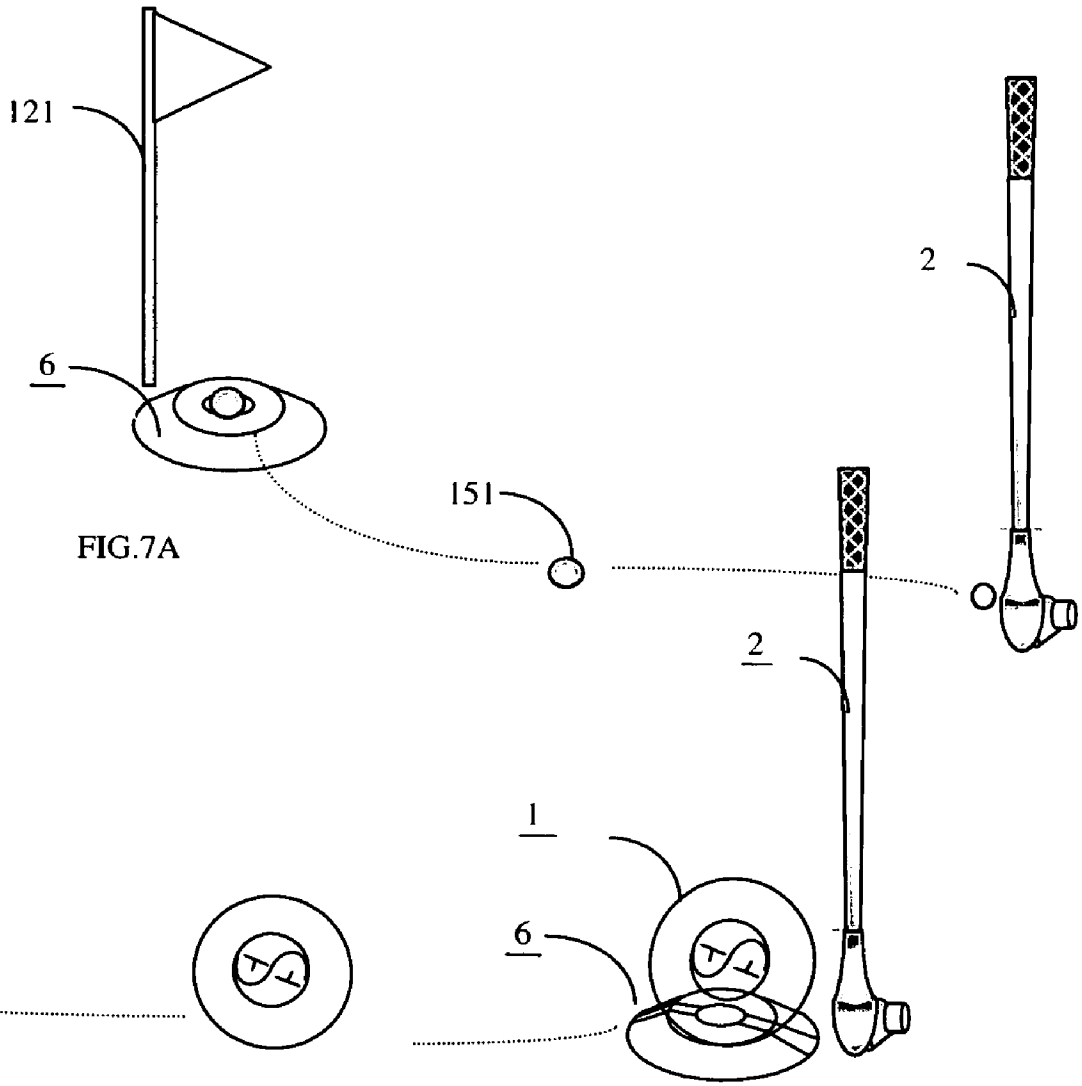
Figure 8A:
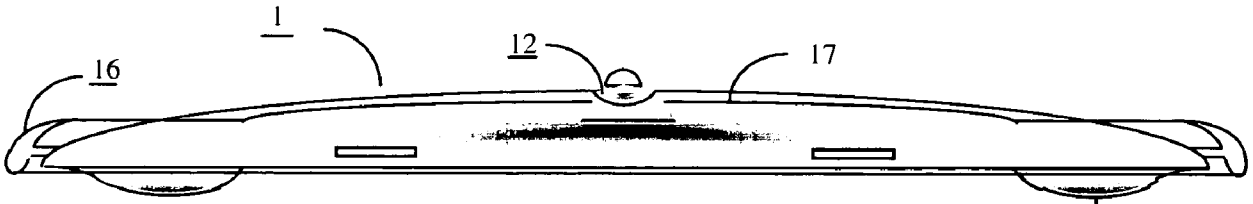
Figure 8B:
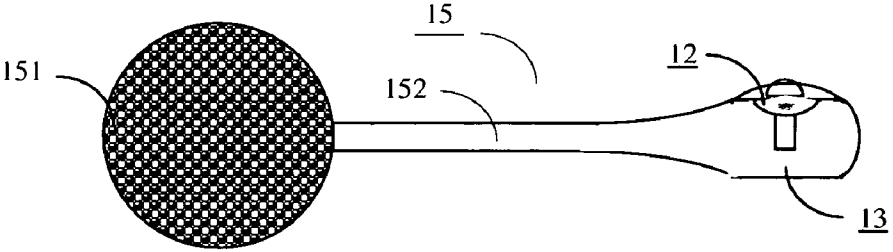

In the course golh, the golh is the hybrid sport constituted of the flying golfrisbee, flying golfball and rolling ball. The golh can also play in the park as the park golh. However, the park golh is limited to the flying golfrisbee and the rolling ball. Unless you are outside the plan grass area, you can use the flying disk to make the long drive to fly. If the golher putt with golfrisbee and the golfrisbee falls outside the golfrisbee basket in the Green area, then the golher has to putt the ball to roll into the hole, i.e. putting Green. In park golh, as the object flying in the sky, it is the flying disk. As the object rolling on the ground, it is the rolling ball. In the strong wind, the golher may use the golfball 15 as shown in FIG. 8B. To make the dogleg turn of the flying path, the golher may use the boomerang golfrisbee or boomerang. As shown in FIG. 1A and FIG. 7A, from long drive to putting, the golher changes the golfrisbee to golf ball.

Figure 7B:
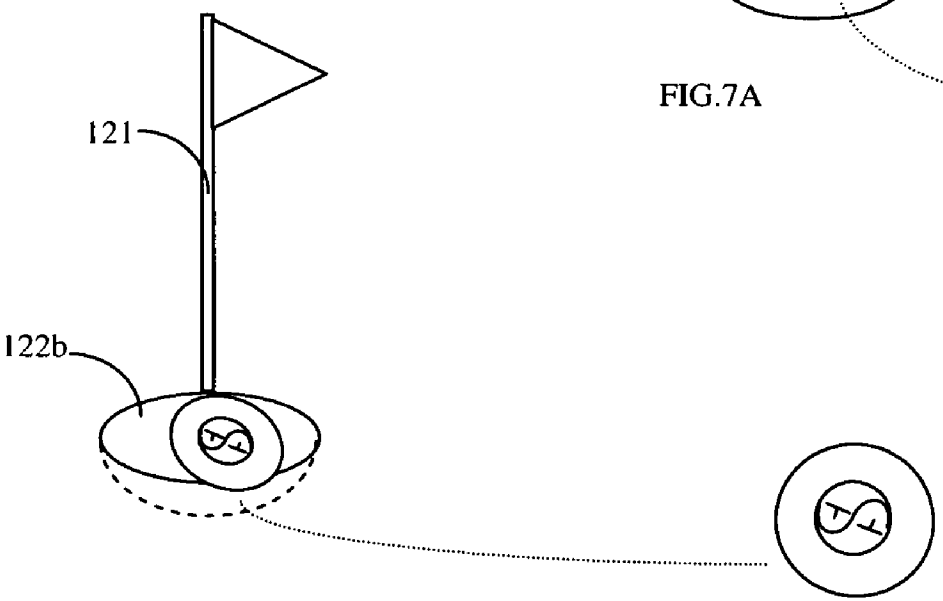

FIG. 7 shows the swiveling golh club 1 to putt the ball and golfrisbee to roll. The head of the golh club 2 is in the shape of the head of golf club. One side of the golh club head is to launch the flying objects to fly and the other side is to putt the ball 151 as conventional golf club does. FIG. 7A shows the ball being putted with club 2 to roll into a universal portable hole 6. In golf, from long drive to putting, the golfer changes from wood club to steel club. The golf ball does not change. In golh, from long drive to putting, the golher changes from golfrisbee to golf ball. FIG. 7B shows the golfrisbee 1 seating on the universal portable hole 6. The golfrisbee 1 is putted with golh club 2 to roll into a shallow cave 122*b*.

Figures 25A, 25B, 25C:
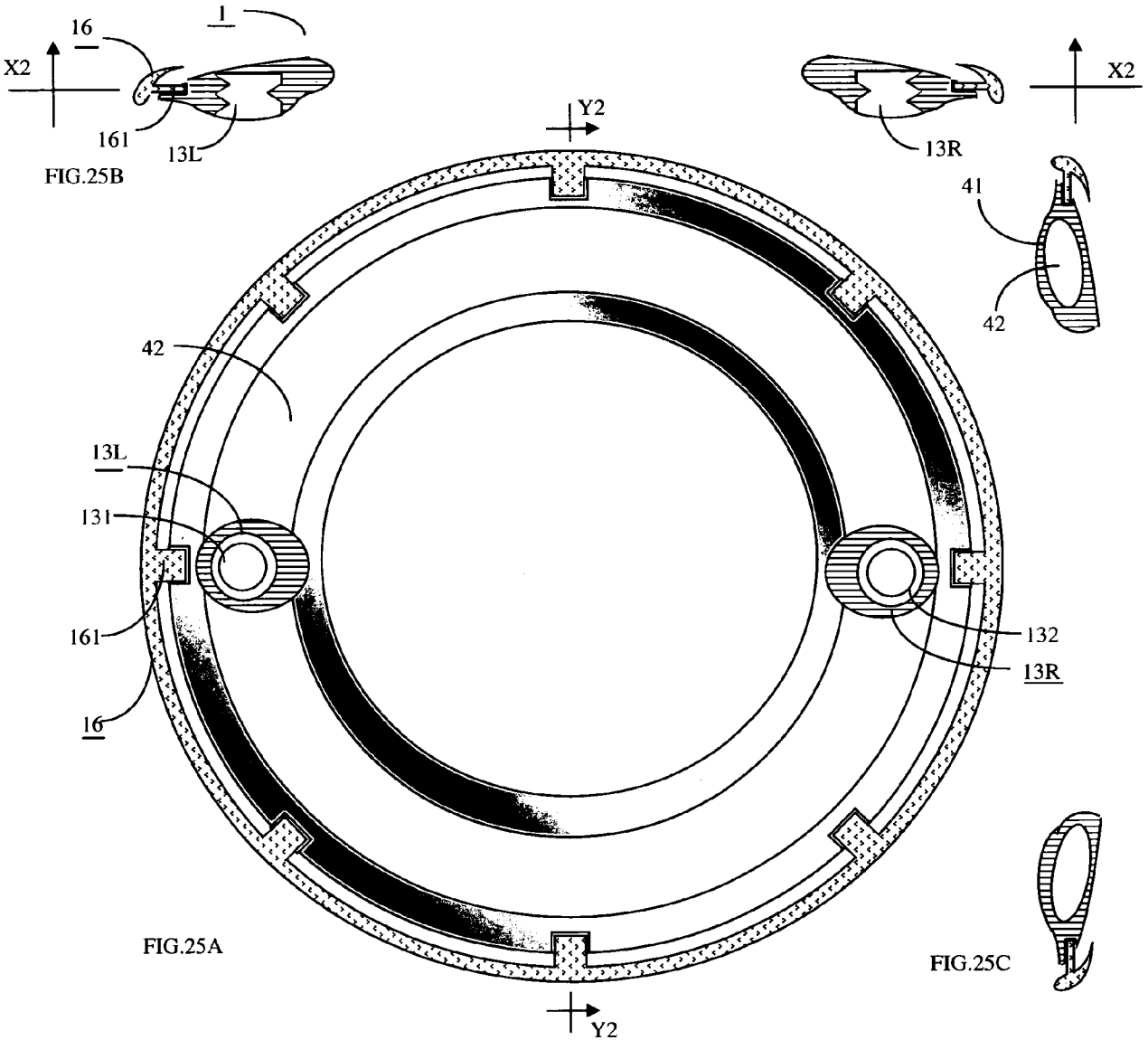

FIG. 8 and FIG. 9 show the basic golh set which includes the golfrisbee 1, golfball 15, golh club 2 and fast golh club head 38. The fast golh club head 38 has a duck-mouth 382. As shown in FIG. 8, it shows the basic set of the golh. The golh is the golf hybrid of flying disk and ball. The disk 1 in golh sport is referred as golfrisbee 1. The ball in golh sport is referred as golfball 15. The ball in the conventional golf sport is referred as golf ball. Both golfrisbee 1 and golfball 15 are derived from the same club-swiveling throw art. The golfrisbee 1 or golfball 15 is thrown into the sky with the golh club 2 swiveling. The golfrisbee has many kinds of different designs. As shown in the FIG. 23, it shows the helicopter type boomerang wing segment 17. As shown in FIG. 25, it shows the UFO disk type design.

FIG. 8B shows golfball 15 which uses the same launching mechanism as golfrisbee 1 does. The flying object is a golfball 15. The golfball 15 comprises a ball 151 and an arrow stick 152. The fitting screw 13 is mounted on one end of the stick 152. The other end of the stick 152 is inserted in the ball 151.

Figure 8C:
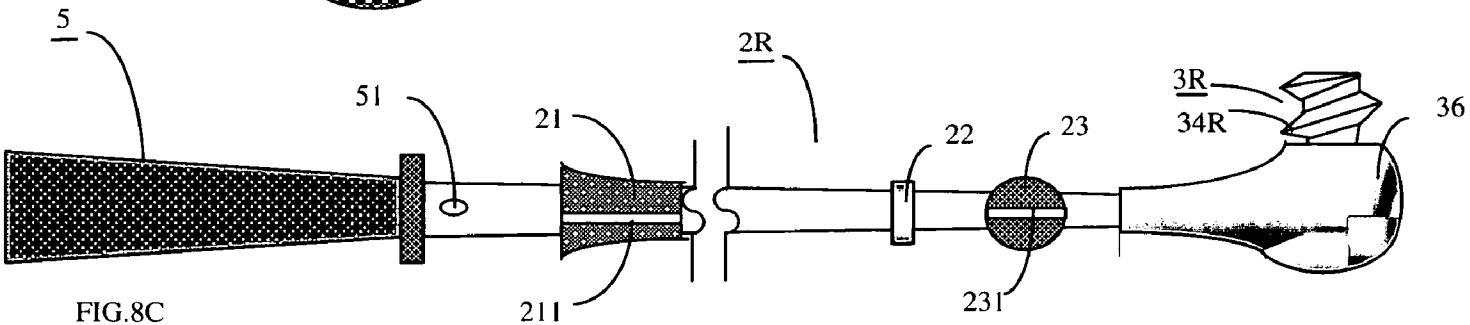
Figure 8D:
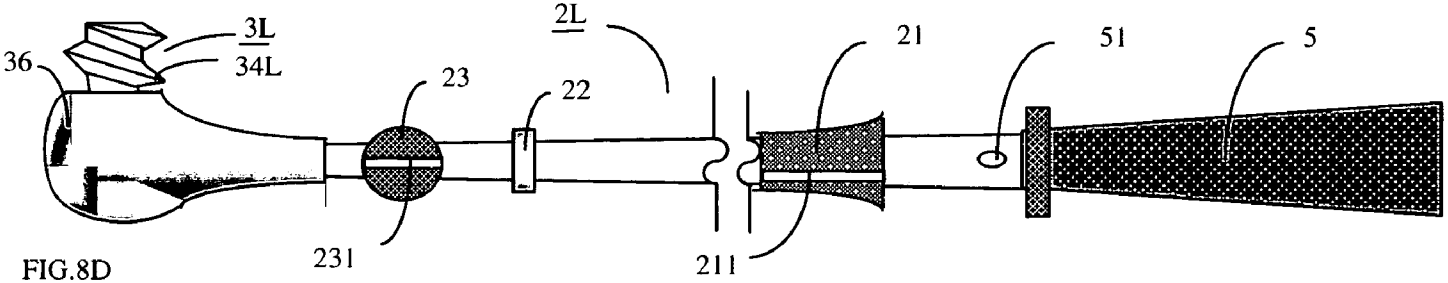

FIG. 8C is the right-hand golh club 2R; FIG. 8D is the left-hand golh club 2L. The weight 23 is to train the golher to develop the golh muscle. The slot 231 is to have the weight 23 to be mounted on the golh club. The fixed handle 5 is located at the end of the golh club. The sliding handle 21 is to have the natural slow-to-fast swing movement. The slot 211 is to have the sliding handle 21 to be mounted on the golh club.

FIG. 9 is the section view of the golfrisbee and the golh club. The golfrisbee is in the UFO shape with right-handed screw cap 13R and left-handed screw cap 13L. This is the basic model of the golfrisbee 1. Due to the co-existence of the screw caps 13R and 13L, the weight of golfrisbee 1 is well balanced. The dust cover 131 is to protect the screw 13R and 13L from the dust. Due to the weight balance, it does not have the wobbling phenomena that the flying distance is much longer than the unbalanced flying disk.

Figures 10A, 10B, 10C, 10D, 10E, 10F, 10G, 10H:
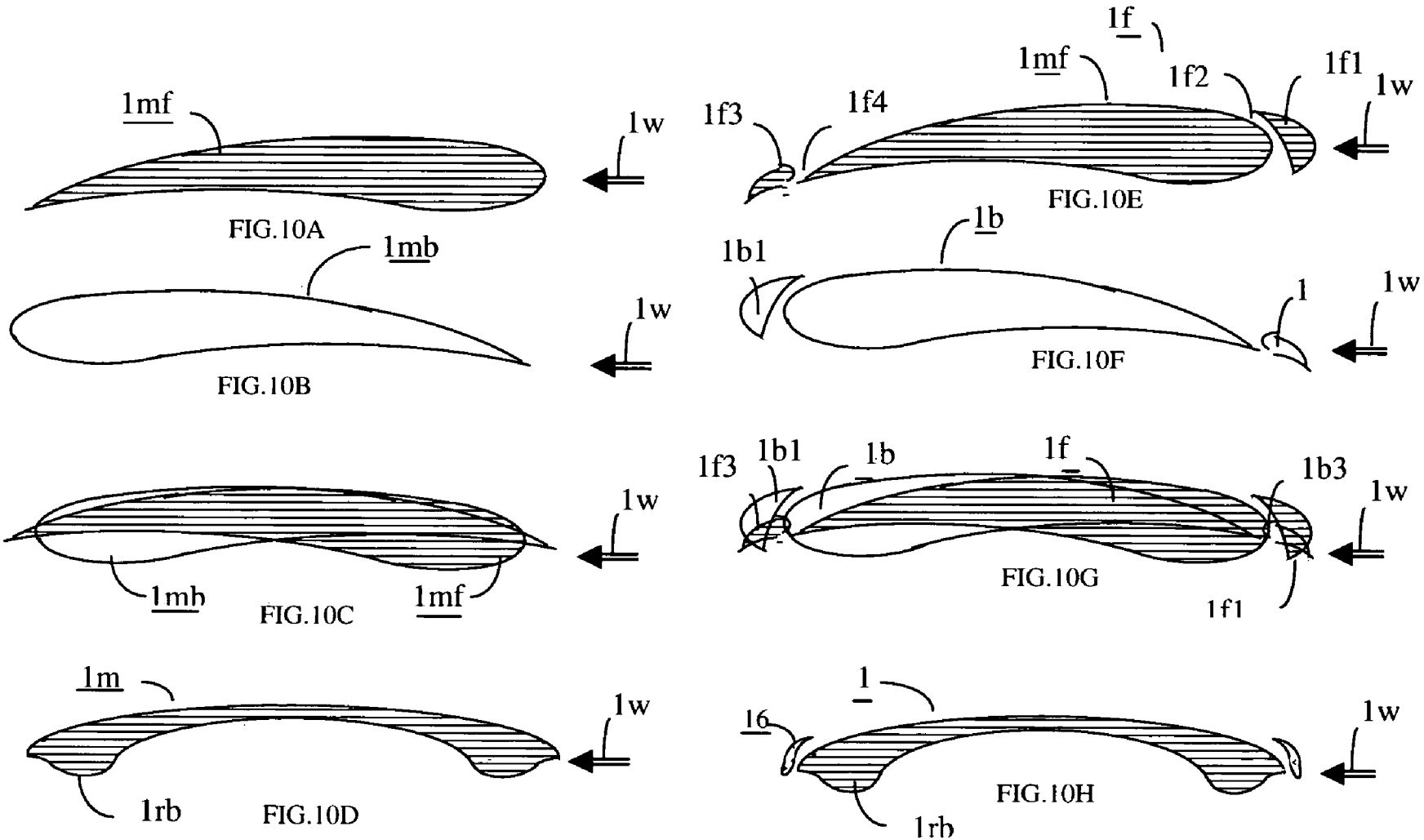

Furthermore, the screw caps 13R and 13L are embedded in the body itself. Since the screw cap 13R and 13L are located at the rim. To embed the screw cap 13R and 13L in the body of the golfrisbee, the rim of the golfrisbee has the ring band 1*rb* structure as shown in FIG. 10D and FIG. 10H. The ring band 1*rb* is generated from the universal directional wing as shown in FIG. 10. Since the golfrisbee is not thrown with hand, it is not necessary to have the edge for the hand holding and throwing. The golfrisbee is launched with the golh club; it does not need the hand holding vertical edge of flying disk. It has the smoothly curved design in the middle portion of the bottom of golfrisbee. It reduces the aerodynamic drag force that the golfrisbee can fly longer and further. The left-hand screw 34L is fit in the left-hand cap 13L; the right-hand-screw 34R is fit in the right-hand cap 13R. Except the left-hand screw 34L, the structure and operation of the left-hand golh club 2L are the same as the right-hand golh club 2R.

The right-handed screw 3R has the right-handed screw 34R notched on its top end. The bottom of the right-handed screw stub 3R is pivotally mounted in the club head 36. The screw 3R is locked with the locking screw 35. For the fixed cap 13R of one golfrisbee 1, the rotation of launching screw 3R is to adjust for the optimum launching position as shown in FIG. 6C. To launch the golfrisbee with golh club properly, the allowance of angle of the screw 3R rotation is only 5 degrees.

Figure 9A:
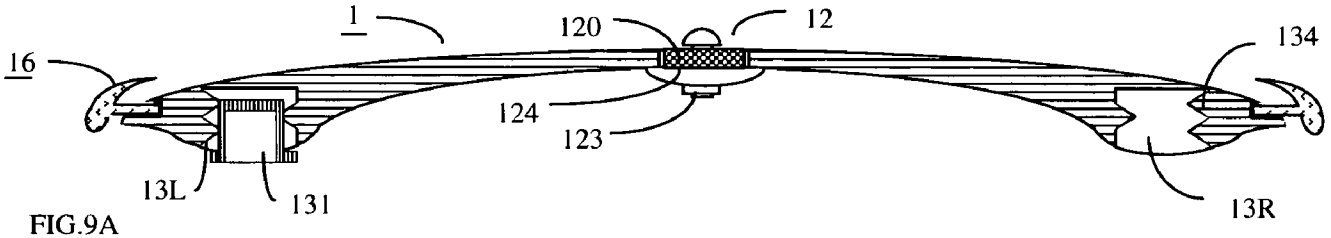
Figure 9B:
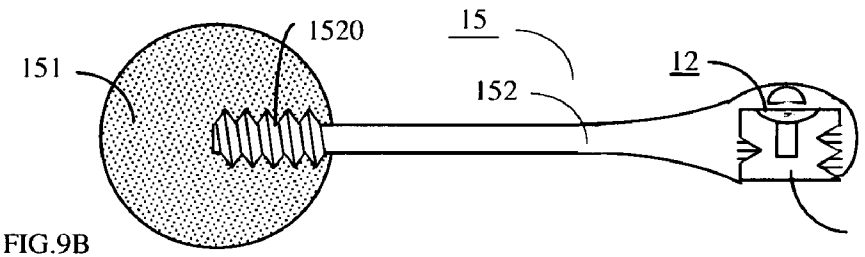
Figure 9C:
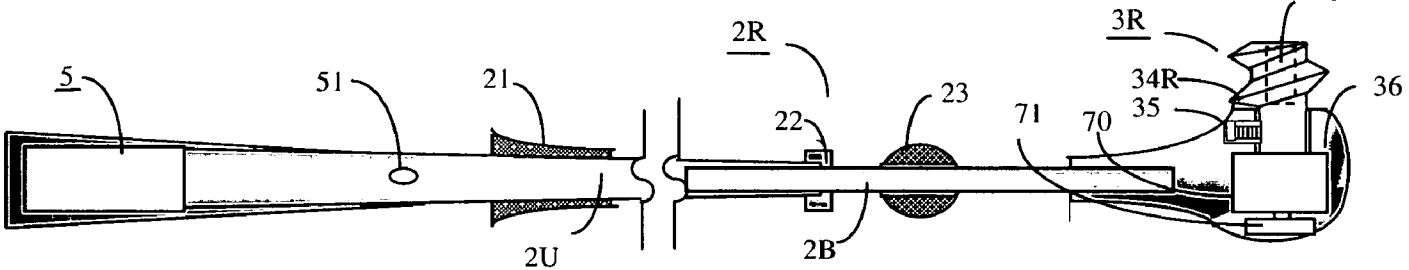
Figure 9D:
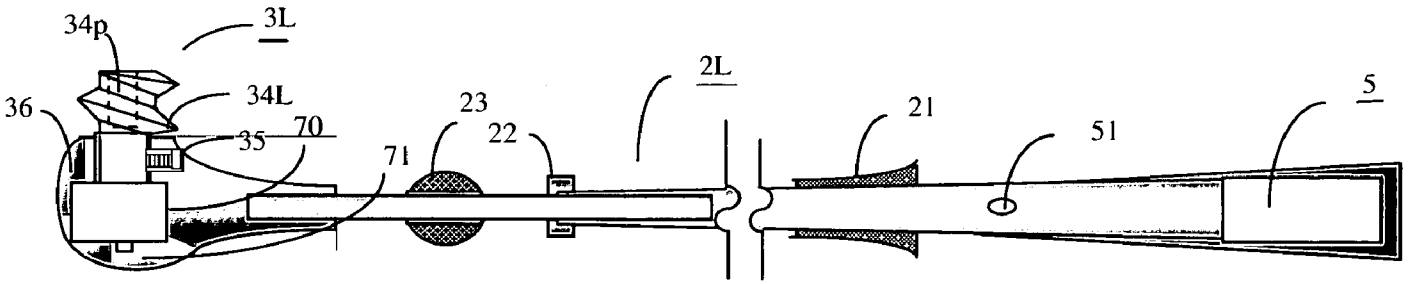

The slotted skirt 16 is the overlap of the slotted flap 1*f*3 and the slotted slap 1*b*1 or the overlap of the slotted flap 1*b*3 and the slotted slap 1*f*1 of the universal directional wing as shown in FIG. 10G and FIG. 10H. The skirt 16 introduces the side stability without the loss of the dogleg fly capability. Furthermore, the slotted skirt 16 serves as the bumper to protect the people from being hit. The slotted skirt 16 has the bumper design to play safe in the park. The slotted skirt 16 made of the foam material has the slotted opening space between the golfrisbee main plane and the skirt 16. The slotted skirt 16 of the golfrisbee 1 has the function of the long-range stability of the spoiler rim; however, the skirt does not have the drag caused by the spoiler rim as the Aerobie disk does. Theoretically, the farthest distance comes from throwing angle at 45 degrees. To throw 45 degrees, it is not necessary to throw the flying disk level. With the slotted skirt 16, the golfrisbee can throw at high angle of attack to have the flying path of 45 degrees. The golfrisbee 1 has no handhold vertical edge that it can launch at any angle-of-attack. FIG. 9B is the partial exposed cross-section of the golfball. The golfball 15 has one handle 152 with the screw 1520 to screw in the ball 151. The ball 151 is similar to the conventional golf ball. Light and/or sound devices 12 are installed in the middle of the female screw 13R. Therefore, the male screw 3R has a hole in the middle portion to adapt the light and/or sound device 12.

The extension club locker 22 is optional. To adjust the length of golh club, the golh club has two segments. The locker 22 has the structure as shown in FIG. 2M. Releasing the extension club locker 22, the lower segment 2B can slide in the upper segment 2U. Locking the extension club locker 22, the lower segment 2B is locked in the upper segment 2U. The length of golh club is adjusted to be the ideal club length of the golher.

The rotational motor 70 is optional. In the most popularly used basic golh club 2, the rotational motor 70 does not need at all. The operation of the basic golh club completely relies on the swivel of club with hands. To use the rotational motor, the locking screw 35 is released to allow the screw 34R to have the free rotation. The rotation motor index 71 is the stopping position of the rotational motor 70 for the optimum launch point as shown in FIG. 6C. The battery 5 embedded in the handle is to supply the power to the rotation motor 70. The switch 51 is to turn on and turn off the rotation of the rotation motor 70. There is turn-on process and turn-off process. For the turn-on process, the battery power is first on, and then the rotation motor 7 starts to rotate. For the turn-off process, the motor rotator first stops the screw 34R at the position prescribed by the index 71 for the optimum launch point in FIG. 6C. Then the battery power is shut down.

Swiveling the golh club 2 to launch the golfrisbee, the golfrisbee 1 rotates on the golh club 2 with the golh club head 34 being the pivotal center. It builds up the angular momentum. The rotational radius is large. As the golfrisbee takes off, the center of rotation is at the center of the golfrisbee. The rotational radius becomes small. According to the conservation of angular momentum, the rotation speed of the golfrisbee will become faster. The effect is similar to the ballet dancer shrinking her hands in front of her chest to speed up the spin speed. Therefore, the golfrisbee is referred to be the sky ballet. To increase the spinning effect, the ring band mass is reduced and the center mass is increased with the addition of weight 12 as shown in FIG. 9.

Figure 9H:
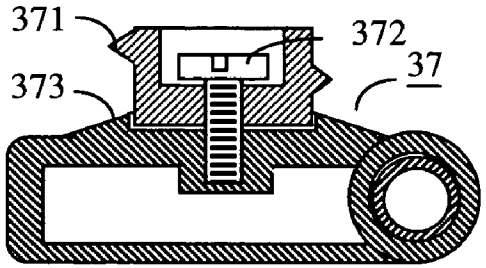
Figure 9I:
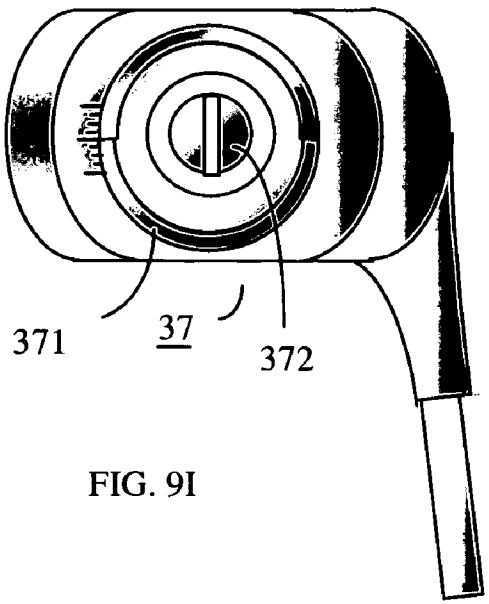
Figure 9E:
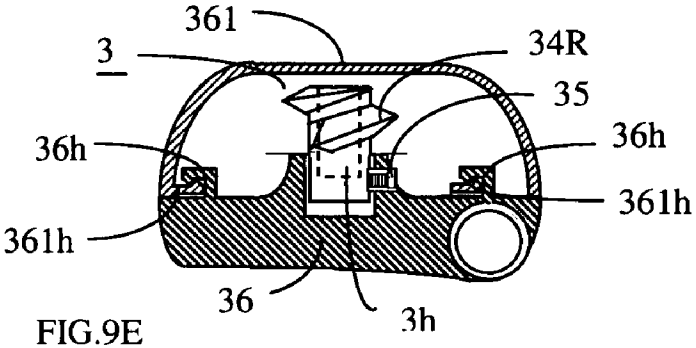
Figure 9F:
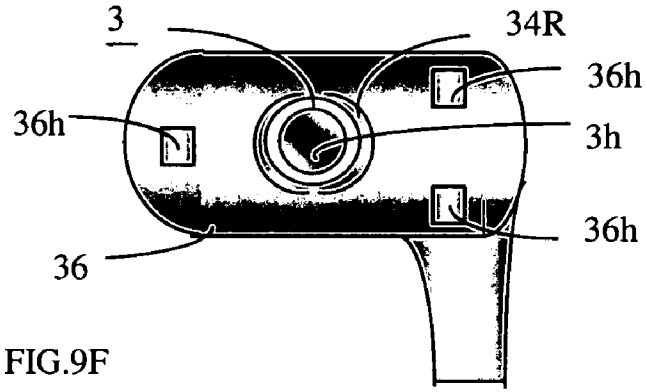
Figure 9G:
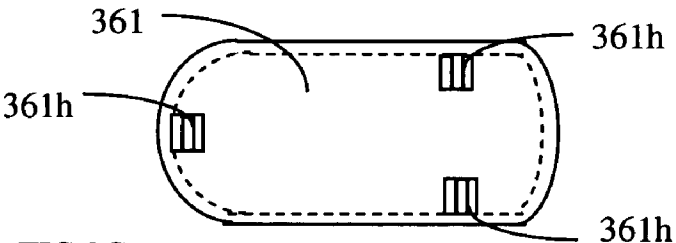

As shown in FIG. 9E and FIG. 9F, the screw 34 is made of a pair of semi-circle teeth. There is an indented hole 3*h* on the screw 3 to adapt the light means 12 as shown in FIG. 9B, etc. Since the golfrisbee sport adopts the screw mechanism to swivel and launch the golfrisbee to fly with the golh club, we need to protect the screw mechanism. As shown in FIG. 9E, FIG. 9F and FIG. 9G, the dust cover 361 sliding mounts on the golh head 36 to protect the screw 3 from the dust. As shown in FIG. 9F and FIG. 9G, mounting the dust cover 361 on the golh head 36, then slides the dust cover 361 sideward to lock the dust cover 361 with club head 36. The dust cover hooks 361*h* are engaged and locked with the golh head hooks 36*h* as shown in FIG. 9E.

FIG. 9H and FIG. 9I show the alternative design of the golh club head. The locking screw 372 is at the center of the launching screw 371. The launching screw 371 is at the center of the cavity formed by the bump 373. For the right hand golh club, the launching screw 371 is right-hand screw; the locking screw 372 is left-hand screw to have the self-lock mechanism. For the left hand golh club, the launching screw 371 is left-hand screw; the locking screw 372 is right-hand screw to have the self-lock mechanism. FIG. 9Q is the golh club with the golh club head 37.

Figure 9J:
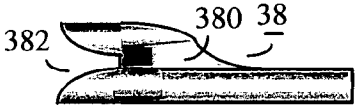
Figure 9K:
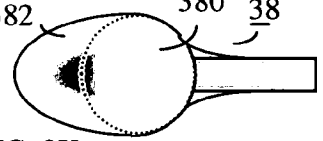
Figure 9L:
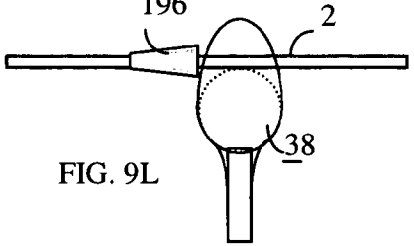
Figure 9M:
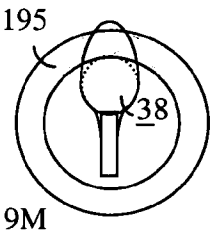
Figure 9N:
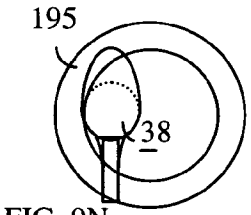
Figure 9O:
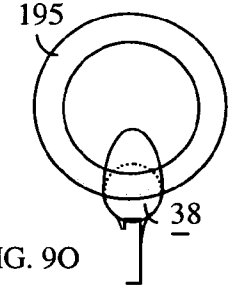
Figure 9P:
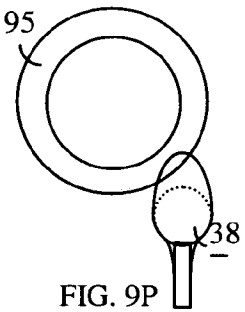
Figure 9Q:
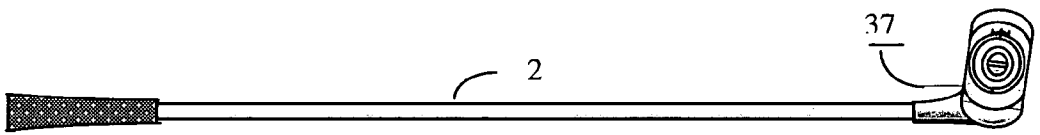
Figure 9R:
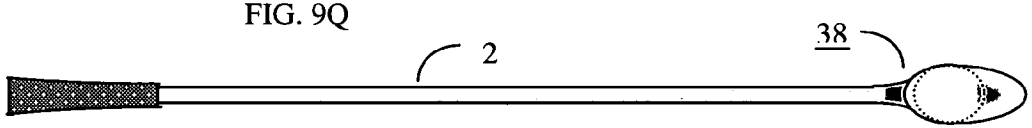
Figure 9S:
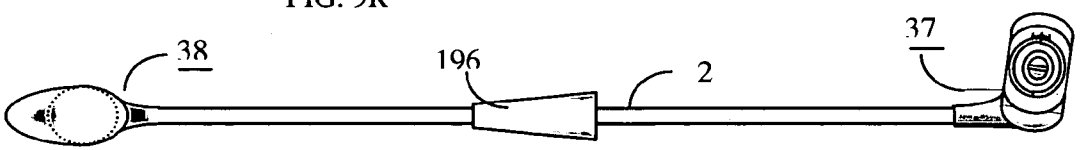

FIG. 9J and FIG. 9K show the auxiliary tool of the fast golh club head 38. FIG. 9R is the golh club with the golh club head 38. The fast golh club head 38 has a shape of duck-head. As shown in FIG. 9L, the fast golh club head 38 can pick up the pole 2 and throw the pole 2 with the duck-mouth 382. As shown in FIG. 9M, the duck mouth 38 also can pick up the flying golfrisbee 195. As shown from FIG. 9M to FIG. 9P, the golfrisbee thrown by the fast golh club head 38 is a ring shaped golfrisbee 195. Golfrisbee ring 195 has an inside edge and outside edge. The golh head has a duck-mouth shaped opening notch 382 attaching to the pivotal axle 380. The duck-mouth-opening 382 clamps at the inside edge of golfrisbee 195. At an opposite edge of the duck-mouth shaped opening notch 382 is an open slope 386 on pivotal axle 380 for the inside ring edge of golfrisbee 195 being released to fly. Swiveling the golh club 2, as shown in FIG. 9N, the golfrisbee 195 pivotally rotates with the axle 380 being axis. Swiveling golh club 2, due to eccentric force, the inside edge of ring-shaped golfrisbee 195 pivotally rotating around pivotal axle 380. Due to the eccentricity, as shown in FIG. 9O, the golfrisbee 195 continues rotating and releasing from the duck-mouth 382. As the inside edge of the ring-shaped golfrisbee 195 contacting with open slope 386, the ring-shaped golfrisbee 195 is sliding over the open slope 386 and released from golh head to fly in sky. As shown in FIG. 9P, the golfrisbee 195 takes off to fly in the sky. FIG. 9S is the combination of the golh head 37 and the fast golh head 38 with one head at each end.

Figure 11C:
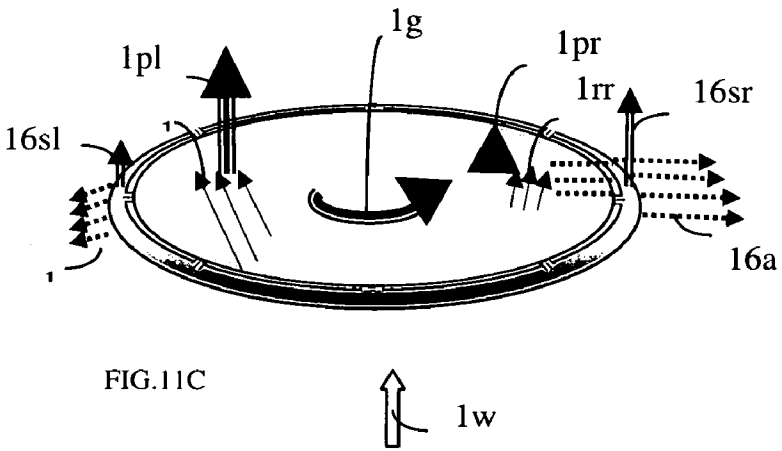
Figures 11A, 11B:
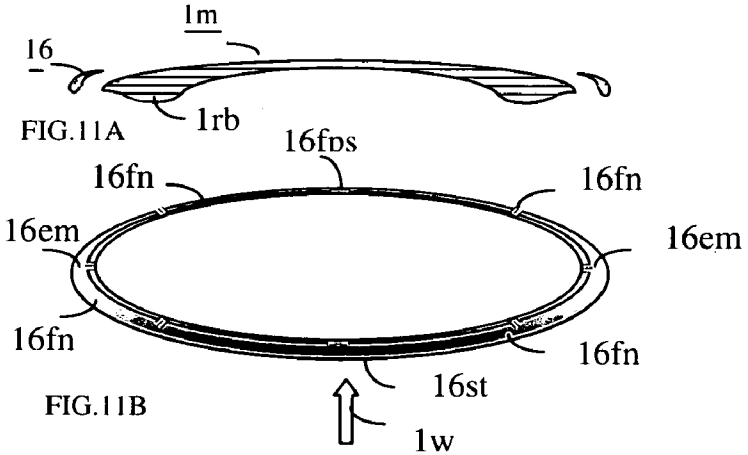
Figures 12A, 12B:
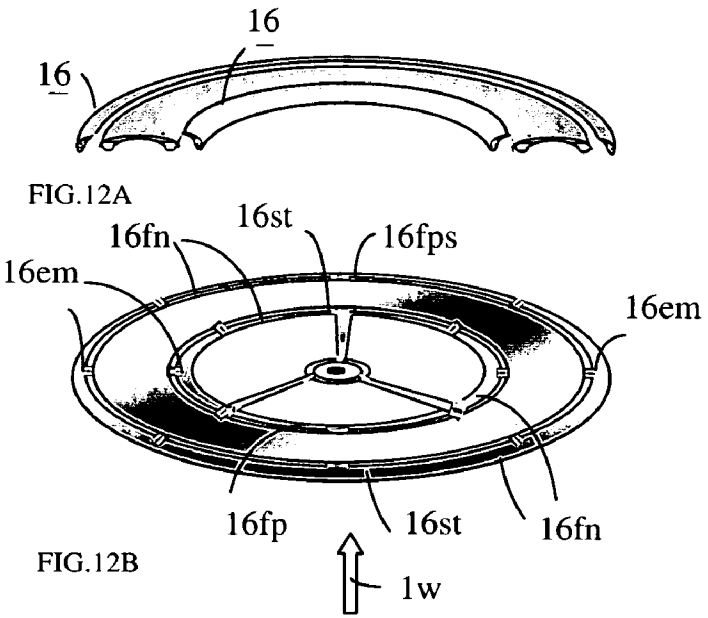
Figures 23A, 23B, 23C:
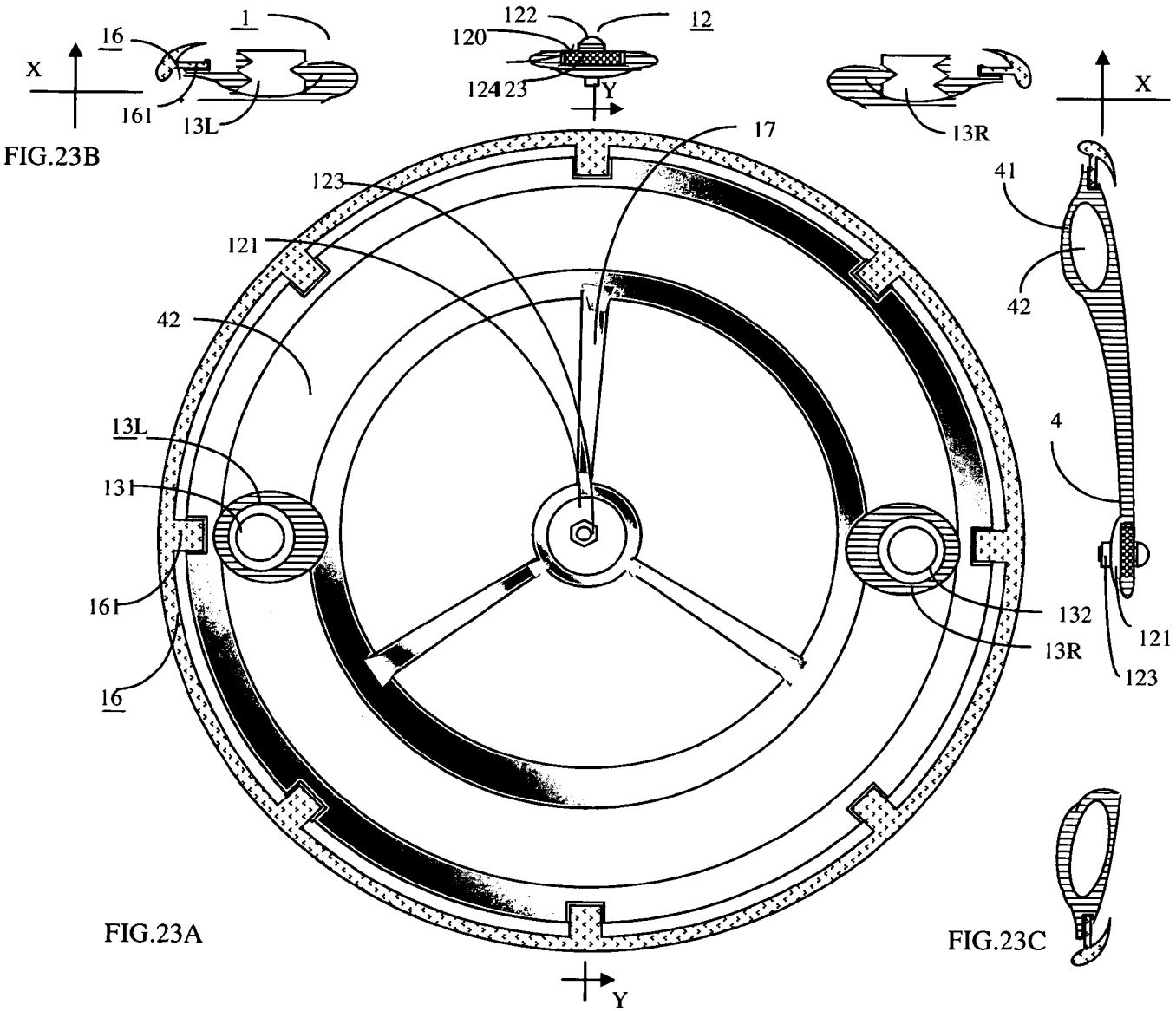
Figures 23D, 23E, 23F:
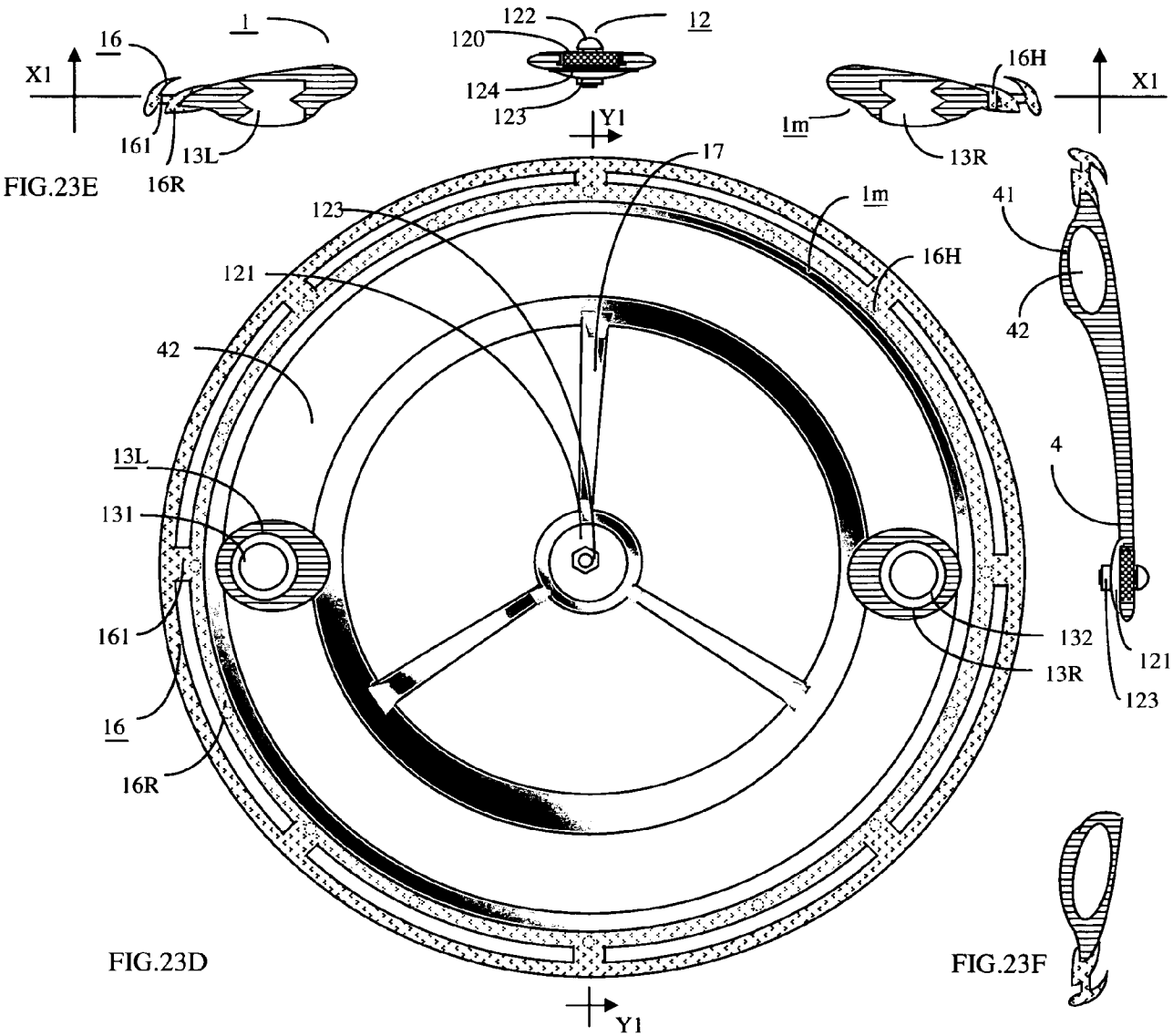
Figures 24A, 24B, 24C:
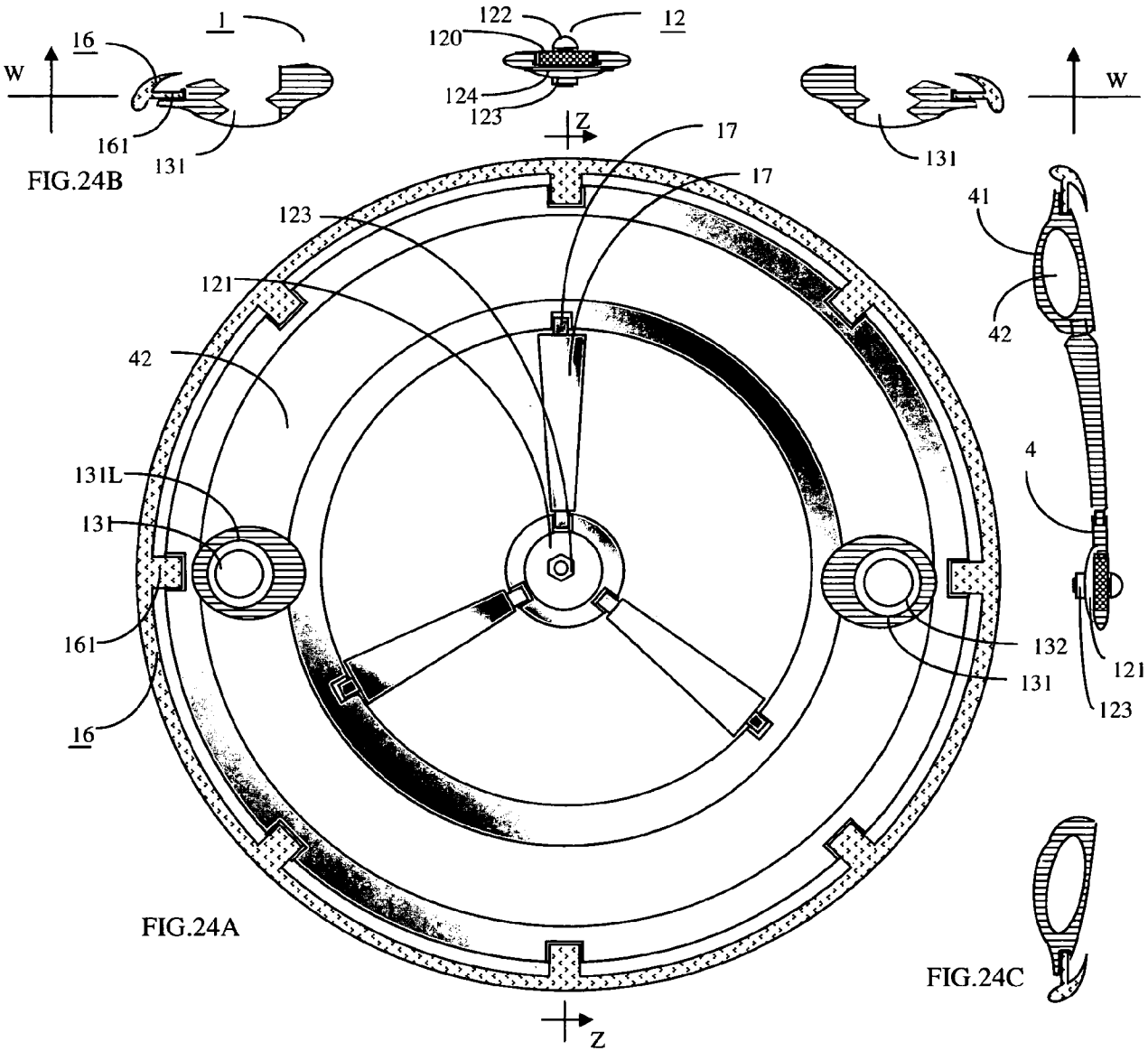

The golh sport is constituted of three core technologies—the universal directional flying wing, the swiveling club and wind-bell-chain technologies. As shown in FIG. 8A and FIG. 24A, the golfrisbee 1 is the merge of the technologies of disk, ring, boomerang and helicopter wing. Since the golh is a brand new sport, so we introduce the innovation of golh product step by step as shown from FIG. 10 to FIG. 26. It is noted that FIG. 9A is the view of the golfrisbee as shown in FIG. 11B; FIG. 8A is the view of the golfrisbee as shown in FIG. 12B. For the ultra long distance flying disk of golfrisbee 1, the low drag force airfoil of the wing and the side stability are the most important issues. Without the side stability, the golfrisbee 1 will roll in the side direction then lose the lift force and falls to ground. With the golh club 2, it will be the human power farthest throw in the world. Furthermore, the golfrisbee 1 is designed to be safe to play as the conventional flying disk does.

So far, there is no flying disk using the aerodynamic airfoil as shown in FIG. 10A in its design. The golfrisbee is the first to apply the wing theory of the aerodynamics to design. As shown in FIG. 10A, being relative to the wind direction 1*w*, as the conventional uni-directional flying wing with airfoil 1*mf* flies in the wind with the tip forward, the wing with airfoil 1*mf* is flying in the forward direction. As shown in FIG. 10B, being relative to the wind direction 1*w*, the conventional wing with airfoil 1*mb* cannot fly in the backward direction. However, the golfrisbee is rotating during the flight to maintain its horizontal flying status. The golfrisbee must fly in both forward direction and backward direction. Actually, for the rotationally flying golfrisbee, the golfrisbee needs the universal directional flying capability. For simplicity, we use bi-directional flying wing to make the analysis and design for the universal flying.

To fly in both forward direction and backward direction, as shown in FIG. 10C, the forward flying wing with airfoil 1*mf* and the backward flying wing with airfoil 1*mb* are overlapped. The forward wing 1*mf* and the backward wing 1*mb* are adjusted to have the maximum overlap of the upper curvatures. Then the transitional smooth curvatures are connected between the forward wing 1*mf* and the backward wing 1*mb*. The lobe 1*rb* is formed. As shown in FIG. 11, for the golfrisbee disk, the lobe 1*rb* becomes the ring band. The envelop of the overlapped wing, as shown in FIG. 10D, is the airfoil with main plane 1*m* of the bi-direction flying wing of the golfrisbee.

To increase the performance of the wing, the wing further has additional wing segments. As shown in FIG. 10E, the wing with airfoil 1*f* is constituted of main plane 1*mf*, slat 1*f*1, slat slot 1*f*2, flap 1*f*3, and flap slot 1*f*4. The slotted slat 1*f*1 is the auxiliary airfoil fitted to the leading edge of the wing. At high angles of attack, the angle of attack of the slotted slat 1*ft* being less than that of the main plane 1*mf*, there is a smooth air flowing over the slotted slat 1*f*1 which tends to smooth out the eddies forming over the wing 1*f*. The slotted slat 1*f*1 is fitted to the leading edge near the wing tip to improve lateral control. Slot 1*f*2 is the passageway built into the wing 1*f* a short distance from the leading edge. It is constructed in such a way that, at high angles-of-attack, the air flows through the slat slot 1*f*2 and over the wing 1*f*, tending to smooth out the turbulence due to eddies.

As shown in FIG. 11 and FIG. 12, the slotted slat 1*f*1 also serves as the wing fence at the position 16*fn*. In the conventional unidirectional flying wing, the wing fences are fin-like vertical surfaces attached to the upper surface of the wing to control the airflow. On swept wing airplane, the wing fence prevents the drifting of air toward the tip of the wing at high angles of attack. On straight wing airplane, the wing fence controls the airflow in the flap area. In both cases, the wing fence gives had better slow speed handling and stall characteristics.

As shown in FIG. 10E, the slotted flap 1*f*3 is a high-lift device which increases the camber of the wing 1*f* and increases the effective wing area. The use of slotted flap 1*f*3 gives better take-off performance and permits steeper approach angles, lower approach, and landing speeds. The flap slot 1*f*4 makes the flap to be slotted flap 1*f*3. The Slotted flap 1*f*3 produces lift in excess of drag.

Since the golfrisbee rotates during flight, as the wing 1*f* rotates 180 degrees, the wing tail become wing tip as shown in FIG. 10F. To make the golfrisbee to fly with wing tail as it does with the wing tip, we need to make the innovation of the wing. As shown in FIG. 10G, the forward wing 1*f* and backward wing 1*b* are overlapped together. As shown in FIG. 10H, the cross section of the universal directional flying golfrisbee wing 1 is the envelope of the forward wing 1*f* and backward wing 1*b* as shown in FIG. 10G. The skirt 16 serves as both slotted slat 1*f*1 and slotted flap 1*f*3 as the conventional wing slat and flap do.

This bi-directional wing can be generalized to be the plural directional wing and the universal directional wing. A plural directional wing has a plural directional flying capability. As shown in FIG. 10 is the bi-directional wing. The bi-direction wing can be extended to plural-direction wing to have flying capability in plural directions. For each flying direction, the plural-directional wing has a cross section to be the envelop of a forward direction of a uni-directional wing cross section 1*f* or 1*mf* and a backward direction of a uni-directional wing cross section 1*b* or 1*mb* as shown in FIG. 10C and FIG. 10G. There are transitional smooth curves between the forward direction of a uni-directional wing cross section and a backward direction of a uni-directional wing cross section. Each flying direction of the plural-direction wing has the cross section as shown in FIG. 10D and FIG. 10H.

For the rotational flying disk, we need to have the universal direction ring. As shown in FIG. 11, it shows that the golfrisbee disk having the universal directional flying capability is equivalent to have the rotational flying capability. For the rotationally flying disk, the disk needs to have the universal direction flying capability. The universal direction-flying wing is in a disk shape. At any section view crossing a center of the disk, the wing cross section is envelop of the forward direction of a uni-directional wing 1*f* and the backward direction of a uni-directional wing 1*b*. There are smooth transitional curves between the forward direction of a uni-directional wing 1*f* and the backward direction of a uni-directional wing 1*b*. For the high performance uni-direction wing, it further comprises a slotted slat 1*f*1 and a slotted flap 1*f*3. The envelope of the forward uni-directional wing and the backward uni-directional wing forms a disk 1*m* made of the main planes and the slotted skirts being the overlap of the slotted slat 1*f*1 and the slotted flap 1*f*3. As shown in FIG. 11B and FIG. 12B, being relative to the wind direction 1*w*, at the position 16*st*, the skirt serves at the slotted slat 1*f*1; at the position of 16*fps*, the skirt serves as the slotted flap 1*f*3.

Furthermore, the skirt 16 serves as the empennage which is similar to the tail assembly of the conventional airplane. The empennage gives the side stability to the aircraft. The skirt 16 serves as the horizontal stabilizer and the vertical stabilizer or fin. As shown in FIG. 11B and FIG. 12B, at the position 16*em*, the skirt 16 serves as the vertical stabilizer. At the position 16*fps*, the skirt 16 serves as both flap 1*f*3 and the horizontal stabilizer. As the skirt 16 serves as the horizontal stabilizer, the skirt 16 is used to prevent the golfrisbee from pitching up and down. As the skirt 16 serves as the vertical stabilizer, the skirt 16 is used to prevent the golfrisbee from yawing in side direction. It serves to offset the tendency of the golfrisbee to roll in the side direction. As shown in FIG. 11C, the principle behind the skirt operation is the compensation of the difference of lift force with the difference of the downwash airflow. As the wind 1*w* blows on the golfrisbee 1, due to the rotation of the golfrisbee 1, one side flow 1*r*1 has the higher relative wind speed than the other side 1*rr*. According to the Bernoulli Law, the difference of relative wind speed over the main plane 1*m* generates the different air pressures that the lift forces 1*p*1 and 1*pr* on two sides are different. Due to the viscosity of boundary flow over the main plane 1*m*, the absolute airflow speeds 16*a*1 and 16*ar* on two sides are different. The airflows hit on the skirt 16 and flow downward with different speeds. The different speeds airflow generates the different forces 16*s*1 and 16*sr*. The momentum caused by the difference of the lift forces 1*p*1 and 1*pr* will be compensated with the momentum caused by the difference of the forces 16*s*1 and 16*sr*. Therefore, the golfrisbee 1 can be kept to fly horizontal position for the ultra long distance fly.

The golfrisbee 1 has a skirt 16 serving as slat and flat. The skirt 16 has many different ways to implement. As shown in FIG. 23A, FIG. 23B and FIG. 23C, the skirt has the slot between the skirt 16 and the disk body 1*m*. As shown in FIG. 23D, FIG. 23E and FIG. 23F, the skirt 16 has the slot implemented as the slotted skirt. The skirt ring 16 has the ring band 16R wrapped around the edge of the main body of the golfrisbee 1*m*. To increase the bond between the main disk 1*m* and the skirt 16, there are the holes 16H punched through the edge of the main disk 1*m*. It is noted that all the skirt in this invention can be and actually is better to be implemented with this way. The skirt 16 has several functions.

(1) It serves as the bumper to protect both human and the golfrisbee itself. The skirt is made of the soft material such as foam rubber. The skirt 16 has the skirt hanger 161 extended into the golfrisbee body.

(2) The skirt 16 serves as the stabilizer at the side of the golfrisbee for the long-range flight as the empennage does.

(3) At the front of the golfrisbee, the skirt 16 serves as the guiding slot to guide the air flowing above the golfrisbee as the slot slat does. It reduces the drag force at the front end. This design is the subsonic airfoil design. It is completely different from the Innova Disk. The Innova Disk has the triangle front end being the supersonic airfoil design. However, for the supersonic wing to operate at the subsonic speed, it induces a lot of drag force.

(4) At the tail of the golfrisbee, the skirt 16 guides the airflow to wash downward to increase the lift and drifting distance as the slot flap does.

As shown in FIG. 12, the wing is in a ring shape wing. The ring shape wing has the section view crossing the center of the ring to be the overlap of forward direction uni-directional wing and backward direction uni-directional wing. There are smooth transitional curves between the cross sections of forward direction uni-directional wing and the backward direction uni-directional wing. As shown in FIG. 12, the universal direction wing developed from the disk in FIG. 10H can be applied to the wing of the flying ring. The cross section of the golfrisbee ring is in the shape of the golfrisbee disk as shown in FIG. 10H and FIG. 11A. FIG. 12B is the isometric view of the FIG. 8A. As shown in FIG. 12B, for the front portion 16*st* of the ring, the outer skirt serves as the slat; the inner skirt 16*fps* serves as flat. For the rear portion of the ring, the inner skirt serves as the slat 16*st*; the outer skirt serves as the flat 16*fps*. At the right side and left side, both the outer skirt and inner skirt serve as the empennage 16*em*.

Figures 13A, 13B:
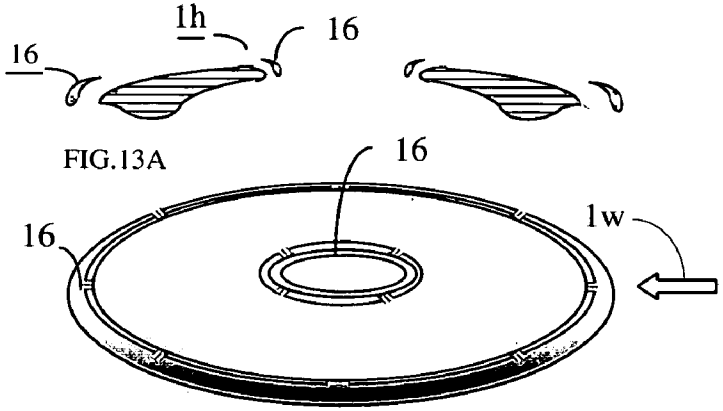

FIG. 13 shows the golfrisbee disk-ring 1*h* or golf disc-ring 1*h* having the combination or hybrid of the golfdisc (golfrisbee disk) and golfring (golfrisbee ring) structure. The golfrisbee disk-ring 1*h* has a central hole. The skirt 16 is also installed along the rim of the central hole. To keep the flying stability of the flying disk, there is one golden rule: the radius of the disk cannot be more than 20 times of the skirt height. If the radius of the flying disk is larger than 20 times of the vertical height of the skirt, then the hole must be introduced to the center of the flying disk to keep the ratio of the span of the main plane to the skirt height being less than 20. If there is a hole in the disk, then it becomes a ring. However, the flying structure of ring is still the same as the disk. It is a wrong idea to differentiate the flying disk from flying ring. Actually, there is no distinguishable difference between the golfrisbee disk and the golfrisbee ring.

The second core technology of the golfrisbee is the swiveling club throwing technology. The swiveling club throwing technology not only throws the golfrisbee 1 but also throws the golfball 15, boomerang, etc. FIG. 14 shows the golh set of killer applications made of the art of golfball 15 and golh club 2. The fit mechanism between the flying object and the head of golh club is screw. To reduce the air drag force, the fit screw of the flying object is the female screw 13 and the head of golh club 2 is male screw 3. The light and sound generator 12 is embedded in the female screw 13. There is one pore 34*p* in the screw head 3 to adapt the light and sound generator 12 as the golfball 15 is mounted on the screw head 3. The LED and battery can be embedded in the flying disk. Because the golh club does not hit on the flying disk and the flying disk has the soft landing, the LED and battery will be left unharmed. Having LED and sound generator 12, you can play golh in the snow golf course and/or in the night. The flying disks will softly land on the top of the snow pile.

Figures 14A, 14B, 14C, 14D:
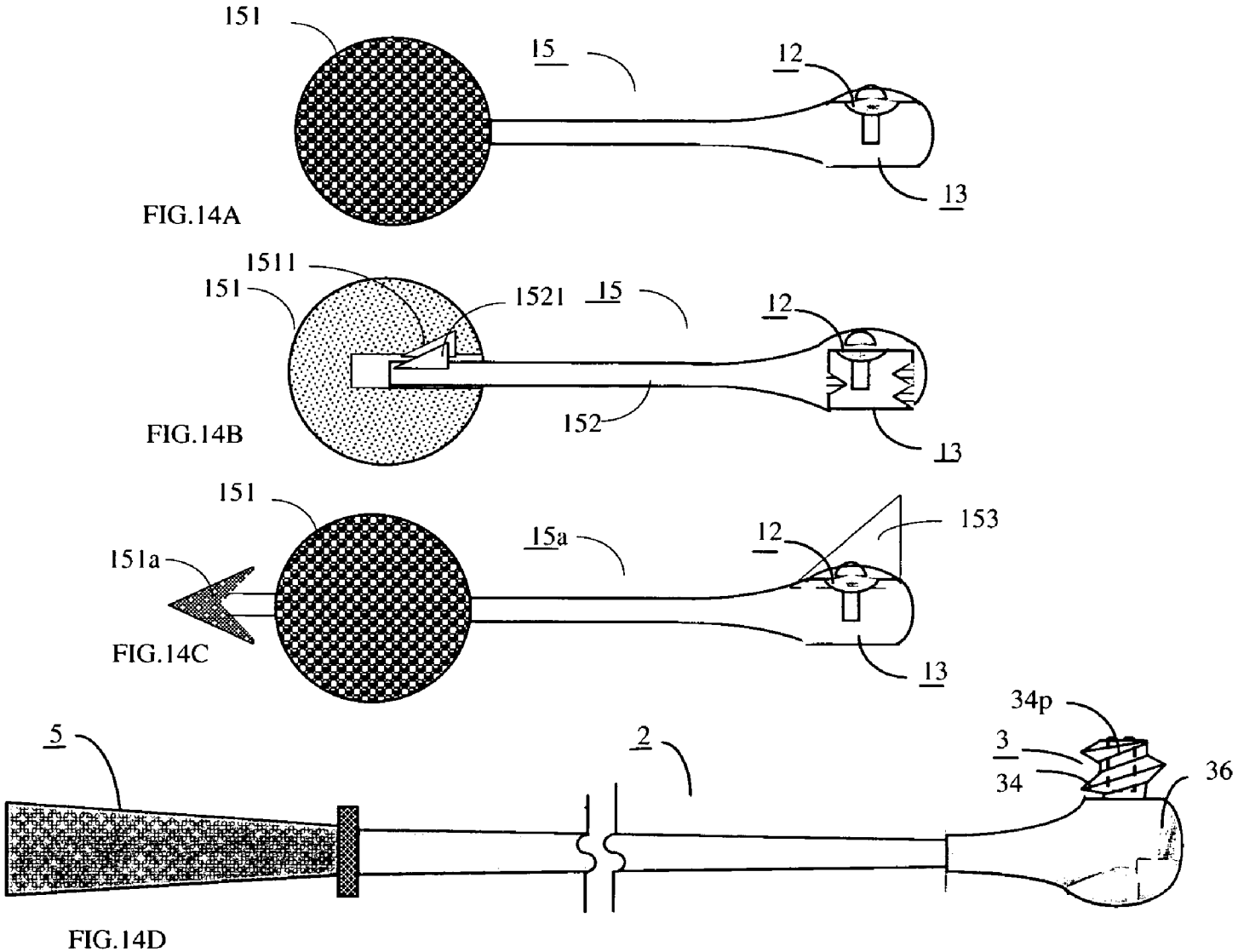
Figure 14G:
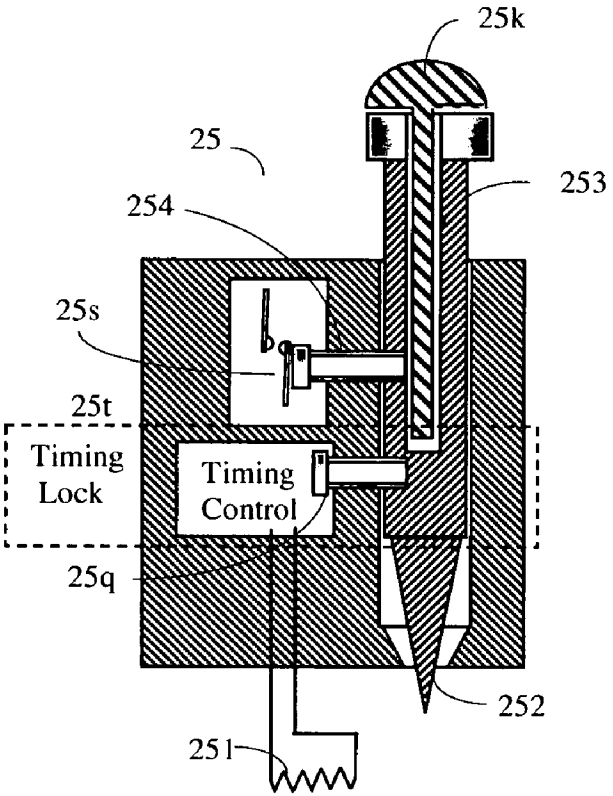
Figure 14E:
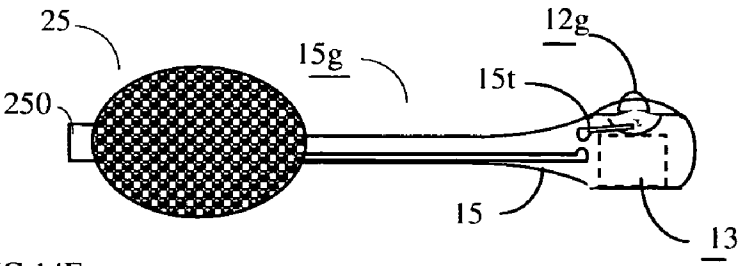
Figure 14F:
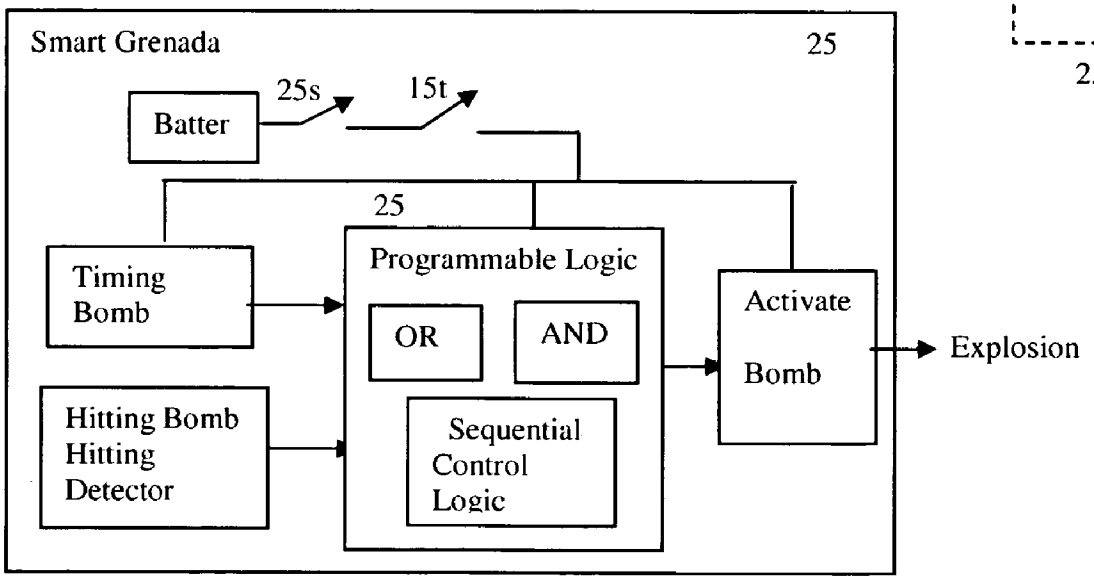

The golfball 15 is thrown with the golh club 2 as shown in FIG. 1A. The fast release latch 1521 is biased by a spring hidden in the bar 152. The fast latch 1521 fits in the notch 1511 in the ball 151 to lock the bar 152 with the ball 151. Twist the bar 152, the fast release latch 1511 will be suppressed and the bar 152 can be pulled out of the ball 151. Then the ball 151 can be putted to roll into the hole 6 as shown in FIG. 7A. As shown in FIG. 14C, there is one arrowhead 151*a* attached to the golfball 15. The fin 153 is to control the throwing direction of the golfball 15. As shown in FIG. 1E, the golfball 15 is thrown to fly and shoot at the target board 18*a*. The versatile golfball type objects all can be thrown with the golh club 2 as shown in FIG. 14D. FIG. 14E shows the killer application of the smart grenade 15*g* for the golfball art. The golh grenade comprises a smart grenade 25 and a handle 15*g* with club head adapter 13. The smart grenade 25 comprises explosive and smart controller. The screw 13 is at the end of the handle 15*h*. The smart grenade block diagram is shown in FIG. 14F. There are many different ways to implement the smart grenade. One of the implementation is to mount the grenade 15*g* on the golh club 2 first. The screw 34 presses the tongue 15*t* apart to open the switch first. Then rotate the safety key 25*k* to unlock the safety lock pin 254 and close the safety switch 25*s*. As the grenade 15*g* takes off to fly in the sky, the tongue 15*t* closes the switch. After the programming, the thermal resister 251 can light up the explosive, the grenade can explode in the air to have mass kill. As the grenade trigger 250 hits on the target, the pin 252 hits on the explosive to induce the explosion. The smart grenade 15*g* can be programmed in different mode with the programmable logic 25*p*. There is a general timing lock mechanism 25*t*. As shown in FIG. 14G, the pin 25*q* is pulled out by the timing circuit to unlock the lock with the timing control. Until timing up, the lock cannot be released. As shown in FIG. 14F, with the timing lock mechanism built in the lock, there are many smart functions can be implemented in the smart grenade 25*g*. For example, in the OR mode, either the time-up of the timing circuit or the hit-on of the trigger 250 will cause the smart grenade to explode; in the AND mode, until the time-up of the timing circuit, the hit-on of the trigger 250 will cause the smart grenade to explode; etc.

Figure 14H:
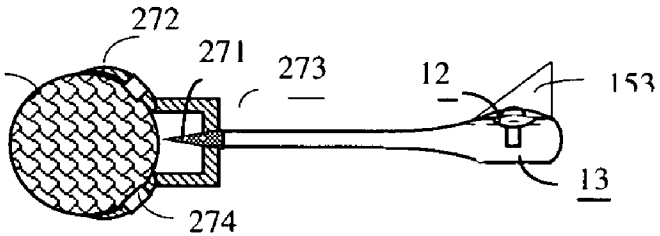

FIG. 14H shows the water grenade 273 being thrown by the golh club. The water grenade 273 comprises a water balloon 270 and a handle 15*wg*. At one end of handle 15*wg* has a golh club head adapter 13. At the other end of said water balloon 270 is mounted on grappler 272. Swiveling a golh club 2, the water grenade 273 rotates due to eccentric force and takes off from the golh club head 3 flying in the sky and being thrown toward other party kids in water game. The water grenade has many different implementations such as the water grenades are shown in our patent U.S. Pat. No. 5,433,646 Water gun launching water grenade. The water grenade can be applied here with the handle being replaced with the handle 15*wg*. In FIG. 14H, a new innovational water grenade is made of water balloon 270 directly. In FIG. 14H, the water balloon 270 is snapped into the grabber 272. The grabber 272 holds the water balloon 270 to be thrown by the golh club. As the water balloon 270 hit on the target and expands backward, due to momentum the needle 271 move forward, the needle pin 271 punches through the water balloon 270. The water expels backward and the water balloon shrinks that the grabber 272 cannot hold the water balloon 270 any more. The water balloon explodes and thrust out to spray the water. To fill the water balloon with the proper quantity of water is an art. The best way to fill the water balloon 270 is to fill the water with the balloon fitting inside the grabber 272. The correct amount of water is to have the pin needle 271 almost contact with the balloon. Then push the water balloon out of the grabber 272 through the hole 274. Taking out the water balloon 270 and putt in the bucket, then the kid players can fill another balloon with water. With buckets of water balloons, the kid player can play the water grenade game with the exchange of the throwing water grenades. Water-golh-gun comprises a water gun 275 and a golh club head 3. The golh club head 3*vis* mounted on the water gun 275.

Figure 14I:
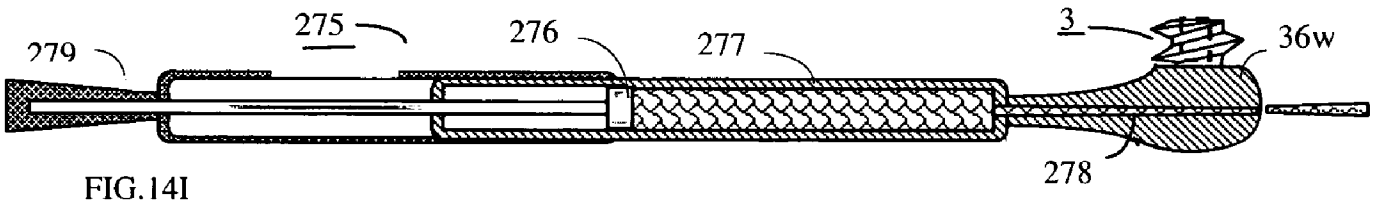
Figure 14J:
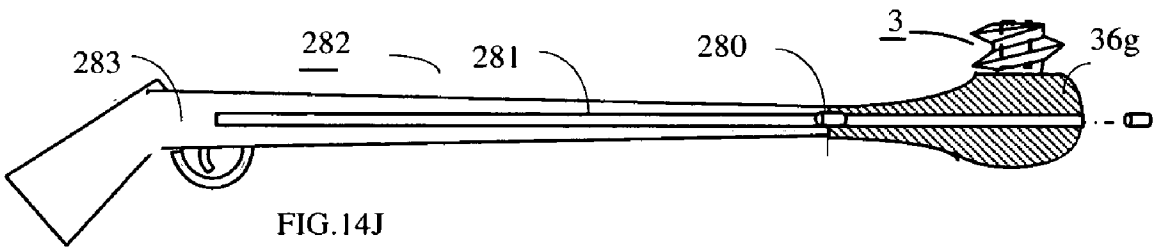
Figure 14K:
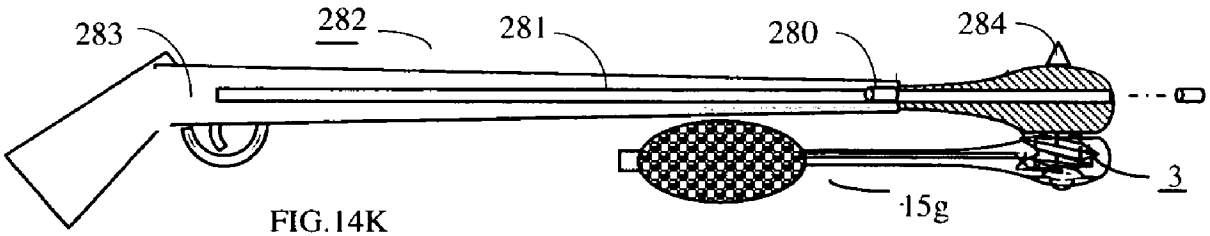

FIG. 14I shows the golh club is further modified to be the water golh gun 275. Pushing the handle 279, the piston 276 compresses the water in the tube 277. The water is force flowing through nozzle 278 and being ejected to spray. Swiveling the water gun 275, water grenade 273 rotating due to eccentric force and taking off from water golh gun 275 flying in the sky and being thrown toward other party kids in water game. On the real battlefield, as shown in FIG. 14J, the gun is integrated with the golh club to be the golh-gun 282. The golh-gun 282 is constituted of gun 281 and golh head 3. The golh head 3 is mounted at top of gun 281. The bullet 280 is fired and expelled out of the gun tube 281. The gun handle 283 and gun tube 281 are served as the golh club. FIG. 14K shows the practical arrangement of the gun golh club. The left hand holds the front portion 285 and the grenade 15*g* and the right hand holds the rear portion 283. As the gun is swiveled leftward, the left hand slides backward and releases the grenade 15*g*, the grenade 15*g* will rotate and fly toward the enemy. The smart grenade 15*g* is pivotally mounted on the golh head of the gun 281. Swiveling gun 281, the golh grenade 15*g* rotates and takes off to throw on target of enemies.

In general, the golh sport comprises of a flying object being thrown to fly with a swivel of a club 2 by hand. The golh club 2 is swiveled with hands to rotate the flying object to build up the rotating momentum and throw the flying object to fly. The golh club 2 is constituted of a pole and a head. The pole is swiveled with hands in a circle to throw the flying object to fly. The club head is for the flying object pivotally mounting on it. The flying object is thrown out to rotate and fly. The flying object can be boomerang 171 as shown in FIG. 15, the ball 15 and the disk 1 as shown in FIG. 1, etc.

FIG. 15 shows the swiveling golh club and the universal direction wing technology applying to boomerang 171. The flying object is a boomerang 171. The boomerang 171 comprises two branches jointing together at a central joint. The fitting screw 13 is mounted at the central joint. FIG. 15A and FIG. 15C are the applications of the swiveling golh club technologies to the boomerangs 171*m* and 171. As shown in FIG. 15A, the boomerang 171*m* is made of two branches and each branch has the cross section as shown in FIG. 10D. As shown in FIG. 15C, the boomerang 171 is made of two branches and each branch has the cross section as shown in FIG. 10H. As shown in FIG. 15E, the golh club 2 is swiveled backward to be ready to throw the golfrisbee boomerang 171. As shown in FIG. 15F, due to the eccentric force, the golfrisbee boomerang 171 rotates. As shown in FIG. 15G, the golfrisbee boomerang 171 takes off and flies in the sky.

Figures 16A, 16B, 16C, 16D, 16E, 16F, 16G, 16H, 16I:
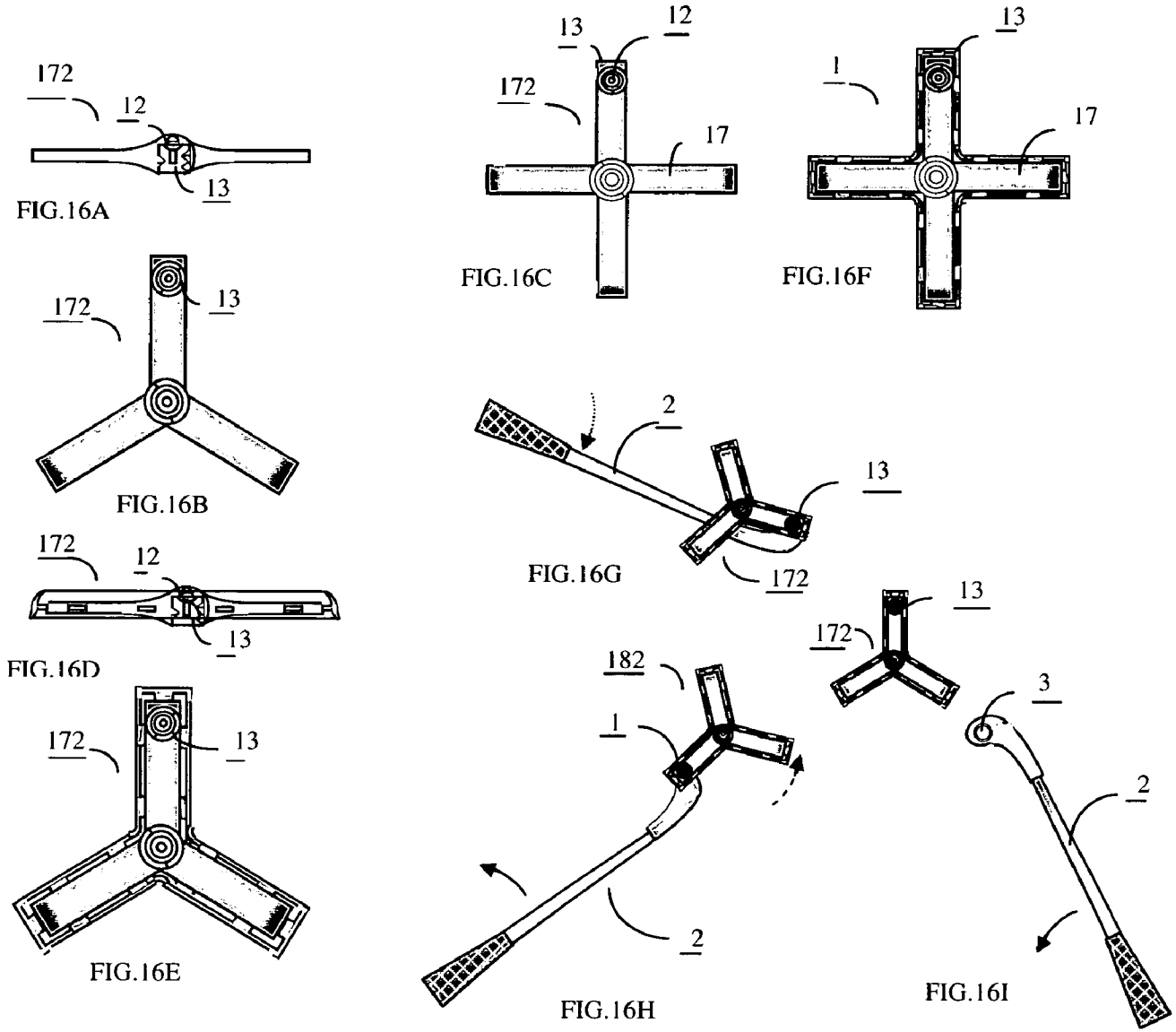

FIG. 16 shows the swiveling golh club and the universal direction wing technology applying to multi-boomerang 172. The flying object is a multi-branches boomerang 172, the boomerang 172 comprises multiple branches jointing together at a central joint. For the odd number of branches, the boomerang will turn and fly back. For the even number of branches, the boomerang will not turn. Adjusting the number of the branches, we can control the curvature of flying path. To have the eccentric force, the fitting screw 13 is mounted at ends of branches. FIG. 16A and FIG. 16C is the application of the swiveling golh club technologies to the tri-boomerang 172*m* and 172. As shown in FIG. 16A, the tri-boomerang 172*m* is made of three branches and each branch has the cross section as shown in FIG. 10D. As shown in FIG. 16C, the tri-boomerang 172 is made of three branches and each branch has the cross section as shown in FIG. 10H. As shown in FIG. 16G, the golh club 2 is swiveled back to be ready to throw the golfrisbee tri-boomerang 172. As shown in FIG. 16H, due to the eccentric force, the golfrisbee tri-boomerang 172 rotates. As shown in FIG. 16I, the golfrisbee tri-boomerang 172 takes off and flies in the sky.

FIG. 17 shows the swiveling golh club and the universal direction wing technology applied to polygon boomerang 173. The flying object is a polygon boomerang 173. The polygon boomerang 173 comprises branches jointing together to form a polygon. The fitting screw 13 is mounted at joints of the branches. For the odd number of edges, the polygon boomerang will turn and fly back. For the even number of edges, the polygon boomerang will not turn. Adjusting the number of the edges, we can control the curvature of fly path. FIG. 17A and FIG. 17C are the applications of the swiveling golh club technologies to the triangle boomerang 173*m* and 173. As shown in FIG. 17A, the boomerang 173*m* is made of three edges and each edge has the cross section as shown in FIG. 10D. As shown in FIG. 17C, the triangle boomerang 173 is made of three edges and each edge has the cross section as shown in FIG. 10H. As shown in FIG. 17E, the golh club 2 is swiveled back to be ready to throw the golfrisbee triangle boomerang 173. As shown in FIG. 17F, due to the eccentric force, the golfrisbee triangle boomerang 173 rotates. As shown in FIG. 17G, the golfrisbee triangle boomerang 173 takes off and flies in the sky.

FIG. 18 shows the swiveling golh club and the universal direction wing technology applied to golfrisbee disk 1*d*. The flying object is a disk 1*d*. FIG. 18A and FIG. 18C is the application of the swiveling golh club technologies to the golfrisbees 1*dm* and 1*d* made of flying disk. As shown in FIG. 18A, the golfrisbee 1*dm* has the cross section as shown in FIG. 10D.

Figure 18A:
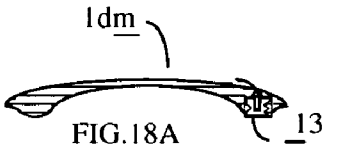
Figure 18B:
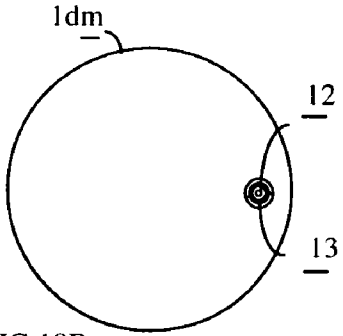
Figure 18C:
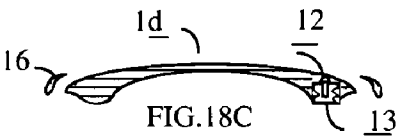
Figure 18D:
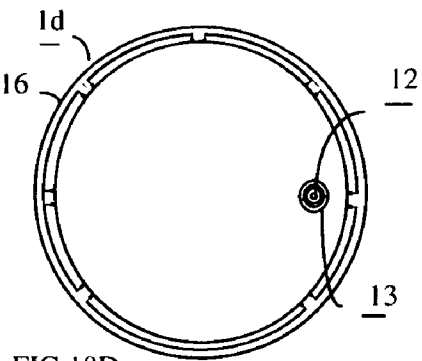
Figure 18E:
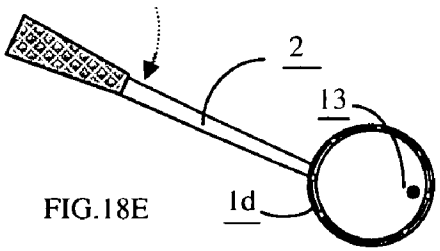
Figure 18F:
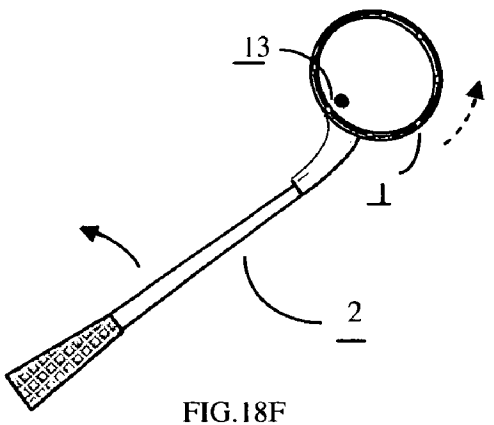
Figure 18G:
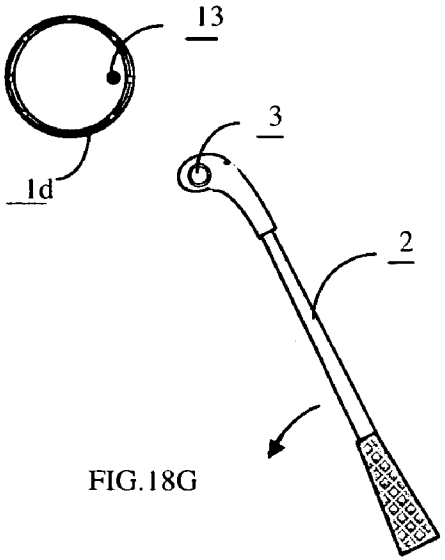

As shown in FIG. 18C, the golfrisbee 1*d* has the cross section as shown in FIG. 10H. A light and sound generator 12 is installed in the middle of female screw 13. The male screw 34 of club head is empty in the middle portion. The light and sound generator 12 is embedded in the cavity of female screw 13 not only to reduce air drag to increase throwing distance of flying disk but also having weight balance for the flying disk. Since the golfrisbee can have the sound device and light device installed, the snow golh and night golh has the long Drive capability with golfrisbee. The golh can be played in the snowy golf course to be snow golh. The snow golf course just needs to blow the snow away from the putting hole area to clean out a small area for putting the golf ball. With the golh, the snowy golf course can continue the operation in the winter season. As shown in FIG. 18E, the golh club 2 is swiveled backward to be ready to throw the golfrisbee disk 1*d*. As shown in FIG. 18F, due to the eccentric force, the golfrisbee disk 1*d* rotates. As shown in FIG. 18G, the golfrisbee disk 1*d* takes off and flies in the sky.

Figure 19E:
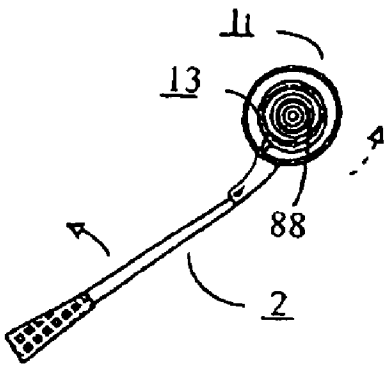
Figure 19G:
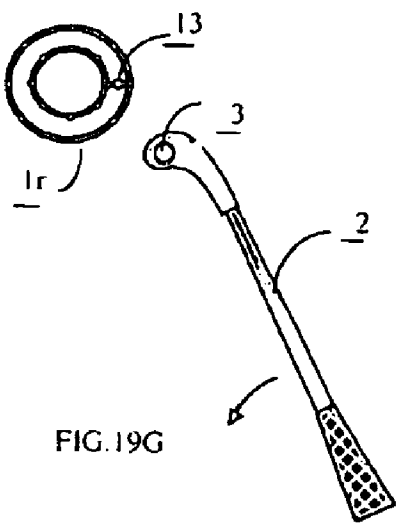
Figure 19:
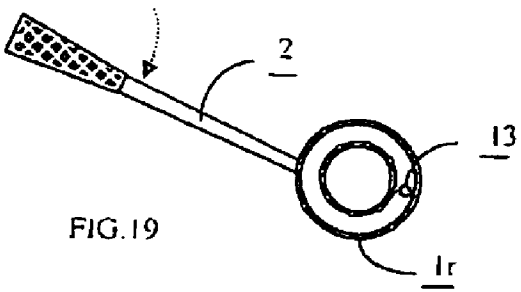
Figure 19F:
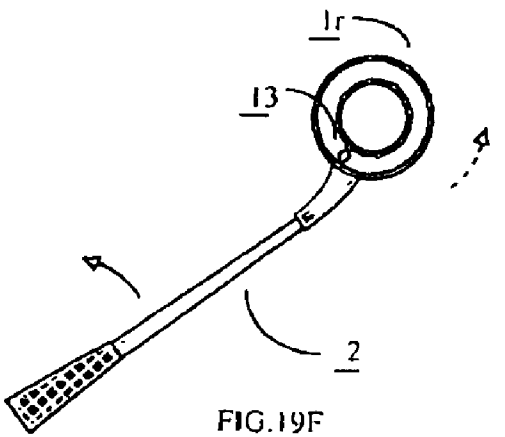
Figure 19A:
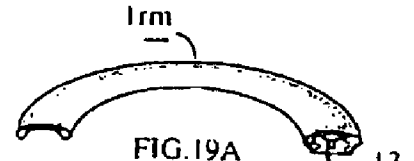
Figure 19B:
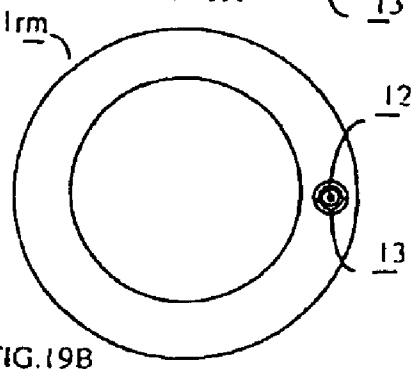
Figure 19C:
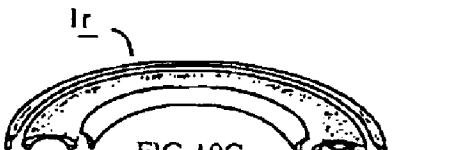
Figure 19D:
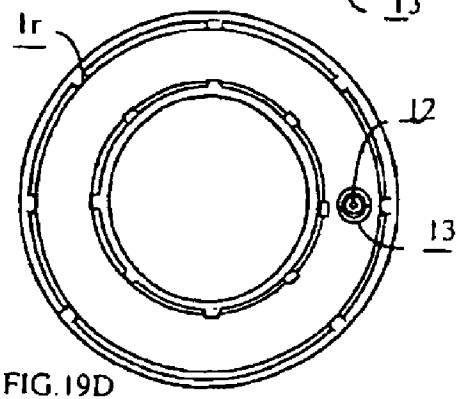
Figure 19O:
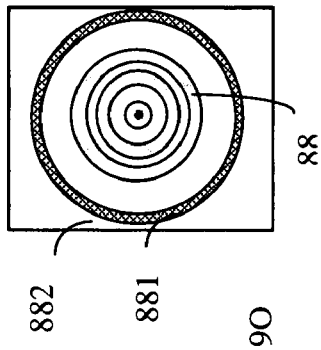
Figure 19N:
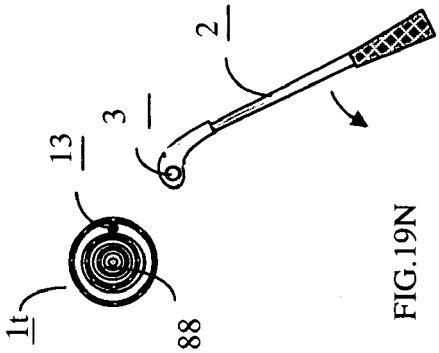
Figure 19L:
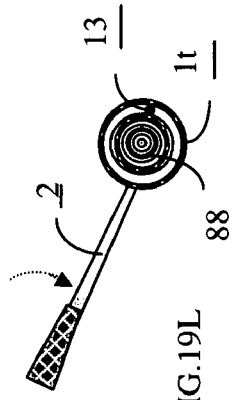
Figure 19M:
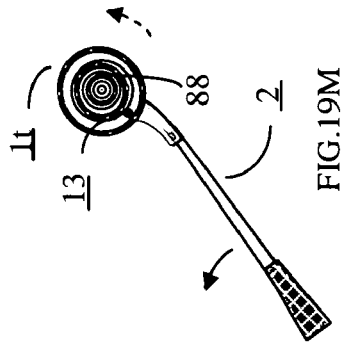
Figure 19H:
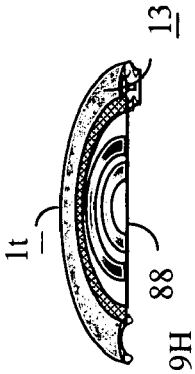
Figure 19I:
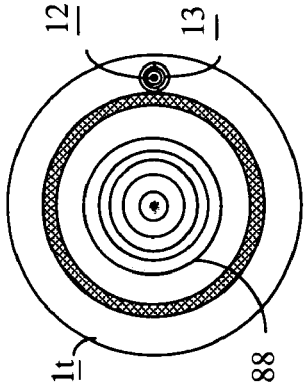
Figure 19J:
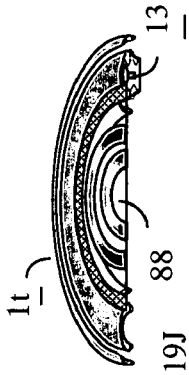
Figure 19K:
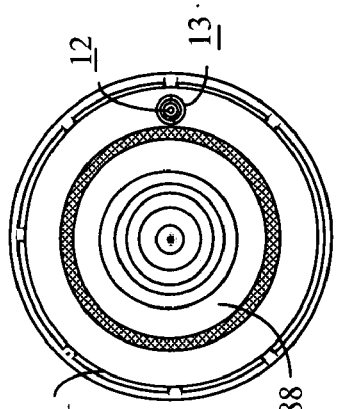

FIG. 19 shows the swiveling golh club and the universal direction wing technology applied to the golfrisbee ring 1*r*. The flying object is a ring 1*r*. FIG. 19A and FIG. 19C is the application of the swiveling golh club technologies to the golfrisbee rings 1*rm* and 1*r*. As shown in FIG. 19A, the golfrisbee ring 1*rm* has the cross section as shown in FIG. 10D. As shown in FIG. 19C, the golfrisbee 1*r* made of the ring has the cross section as shown in FIG. 10H. As shown in FIG. 19E, the golh club 2 is swiveled backward to be ready to throw the golfrisbee ring 1*r*. As shown 1*r* FIG. 19F, due to the eccentric force, the golfrisbee ring 1*r* rotates. As shown in FIG. 19G, the golfrisbee ring 1*r* takes off and flies in the sky. As shown in FIG. 19H, FIG. 19I, FIG. 19J and FIG. 19K, the golfrisbee ring 1*t* and 1*tm* can serve as the shooting target in the hunting practice in FIG. 1G. The golfrisbee 1*r* has a target paper sticking to it to be a shoot target 1*t*. The target paper 88 has a sticky rim 881 coated with glue to protect one sheet of glassy paper 882. Peeling off target paper 88 from glassy paper 882 and sticking target paper on rim golfrisbee 1*r*, the golfrisbee 1*r* becomes a target 1*t*. As shown in FIG. 19P, the shooting target paper 88 is attached to the glassy paper 882 with the glue 881. As shown in FIG. 19L, the golfrisbee target 1*t* is mounted on the golh club. Swiveling the golh club 2, the golfrisbee target 1*t* pivotally rotates on the golh club head. As shown in FIG. 19M and FIG. 1G, the golfrisbee target 1*t* takes off to fly in the sky and the hunters shoot at the flying golfrisbee targets 1*t*.

FIG. 20 shows the swiveling golh club and the universal direction wing technology applied to golfrisbee disk-ring 1*h* made of the hybrid of the disk and ring. The flying object is a disk-ring 1*h*. FIG. 20A and FIG. 20C are the application of the swiveling golh club technologies to the golfrisbee disk-rings 1*hm* and 1*h*. As shown in FIG. 20A, the golfrisbee disk-ring 1*hm* has the cross section as shown in FIG. 10D. As shown in FIG. 20C, the golfrisbee disk-ring 1*hm* has the cross section as shown in FIG. 10H. As shown in FIG. 20E, the golh club 2 is swiveled back to be ready to throw the golfrisbee disk-ring 1*h*. As shown in FIG. 20F, due to the eccentric force, the golfrisbee disk-ring 1*h* rotates. As shown in FIG. 20G, the golfrisbee disk-ring 1*h* takes off and flies in the sky.

The essential difference between the golfrisbee and the conventional hand-thrown flying disk is that the golfrisbee 1 gets rid of all the sharp edges. It has no edge at all. The golfrisbee 1 has the dome shape smooth design in its middle portion. The golfrisbee 1 with the skirt 16 is safe to play in the park. It is the only flying disk having both the thin profile of the ring structure and the dome shape of the flying disk. The golfrisbee 1 is launched with the golf club 2. The golfrisbee screw 13 is about half turn only. It makes the golfrisbee 1 be able to have very thin profile.

Figure 21E:
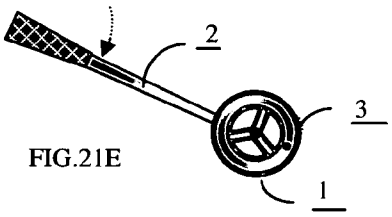
Figure 21G:
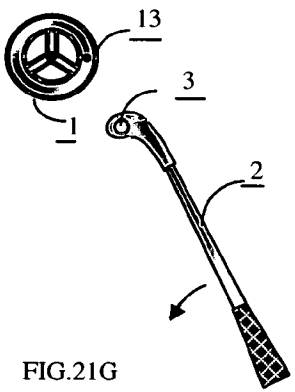
Figure 21F:
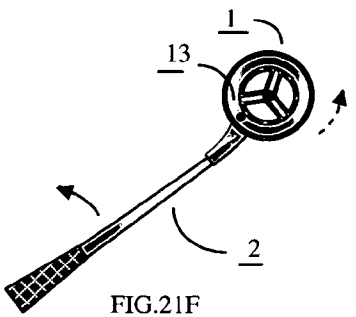
Figure 21A:
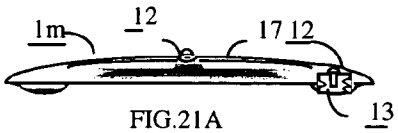
Figure 21B:
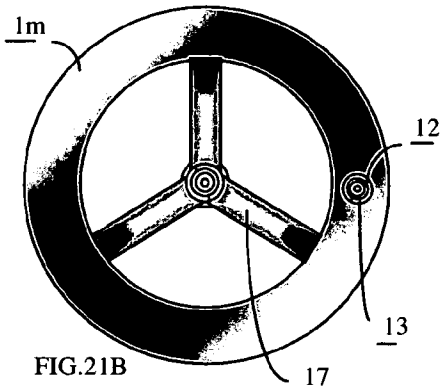
Figure 21C:
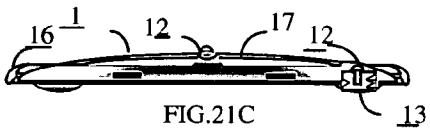
Figure 21D:
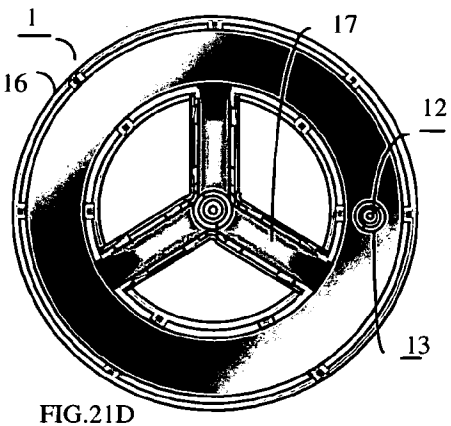
Figure 21J:
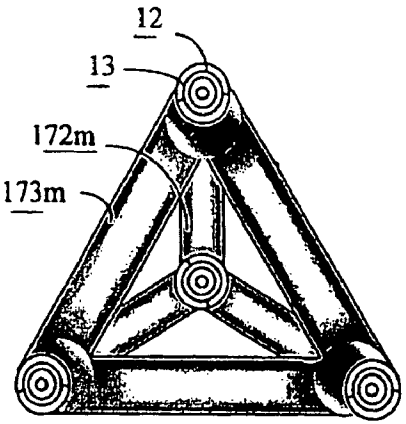
Figure 21K:
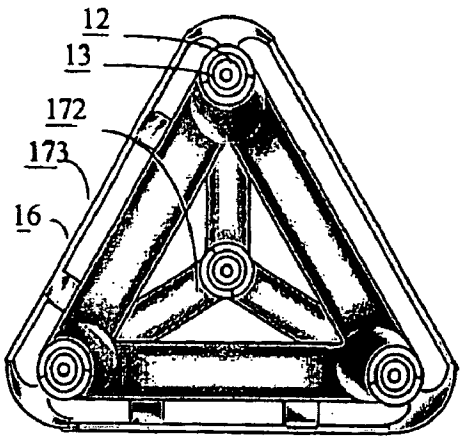
Figure 21L:
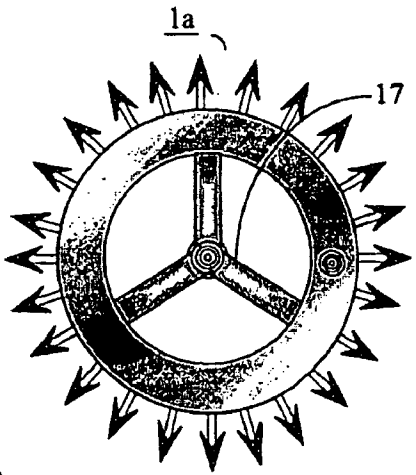
Figure 21H:
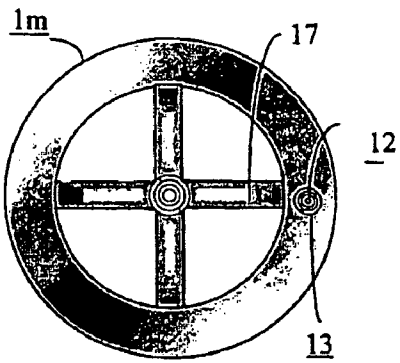
Figure 21I:
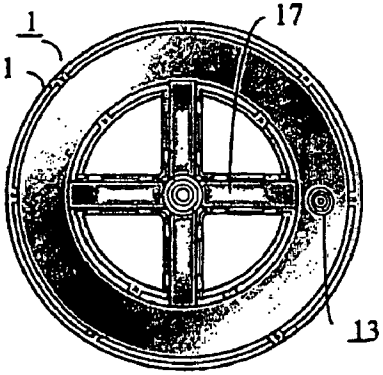
Figure 22A:
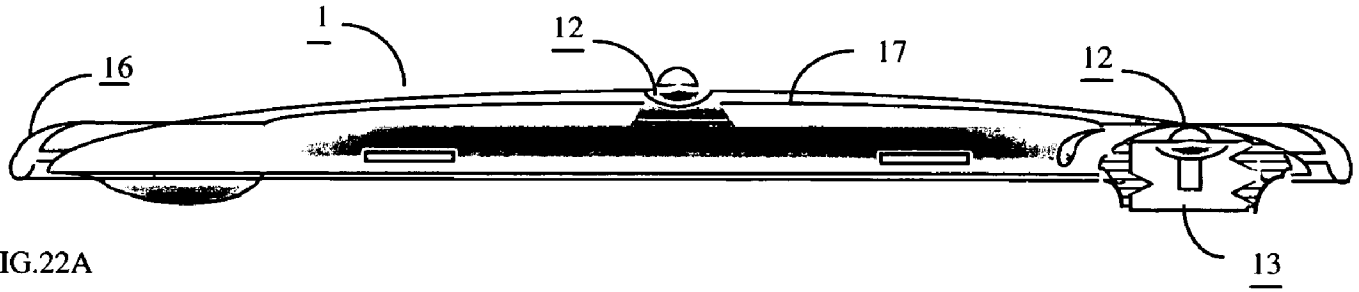
Figure 22B:
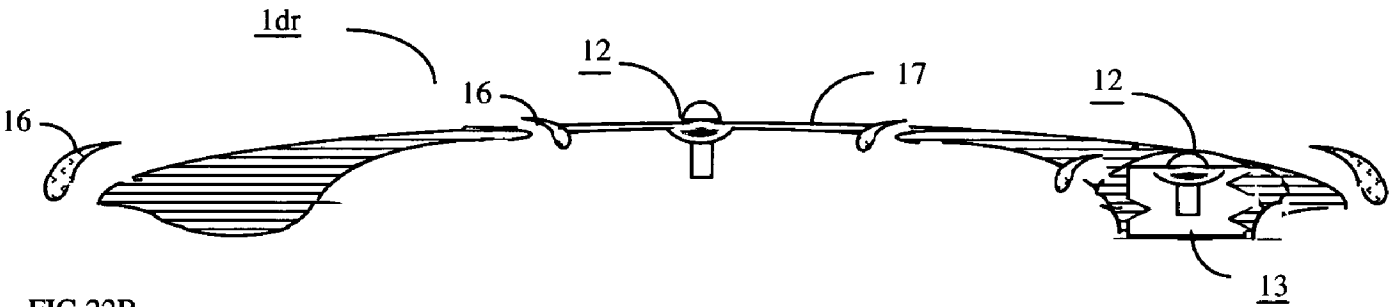
Figure 22C:
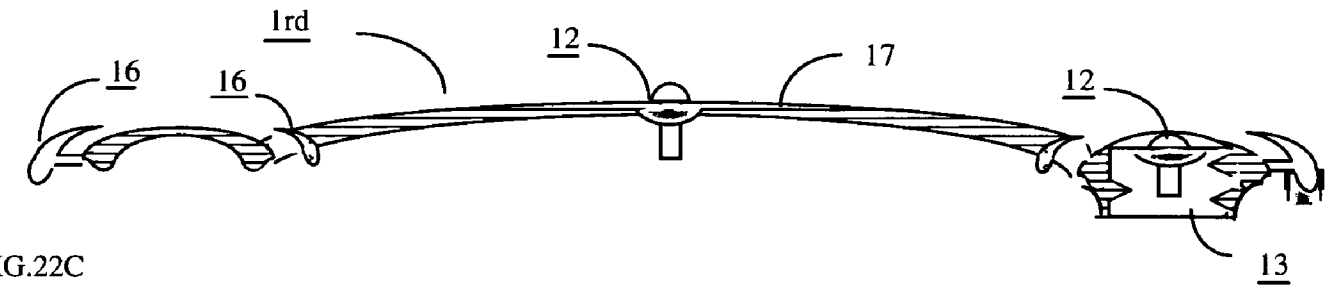

FIG. 21 shows the swiveling golh club and the universal direction wing technology applied to boomerang disk-ring or boomerang ring. As shown in FIG. 22, the same golfrisbee 1 has the structure to be disk-ring 1*dr* as shown in FIG. 22B or the structure to be ring-disk 1*rd* as shown in FIG. 22C. Both of them are referred to be the golfrisbee 1. The golfrisbee 1 has the hybrid structure of the disk, ring and boomerang. FIG. 21A and FIG. 21C are the application of the swiveling golh club technologies to the sky ballet golfrisbee 1 made of the boomerang disk-ring 1*dr* or boomerang ring 1*rd*. As shown in FIG. 21A, the golfrisbee 1*m* is the main plane of the structure either to be the main plane of disk-ring 1*dr* as shown in FIG. 22B or the structure of main plane to be the main plane of ring (ring-disk) 1*rd* as shown in FIG. 22C.

As shown in FIG. 22B, the flying object is a boomerang type disk-ring 1*dr*. The boomerang 17 is at the center portion of the disk-ring 1*dr*. The boomerang 17 is constituted of a plural of branches. As shown in FIG. 22C, the flying object is a boomerang ring 1*rd* and the boomerang is at the center portion of said disk-ring 1*dr*. The boomerang 17 is constituted of a plural of branches. As shown in FIG. 21H, the golfrisbee 1 has the cross section is either to be disk-ring 1*dr* as shown in FIG. 22B or the cross section of ring 1*rd* as shown in FIG. 22C. As shown in FIG. 22G, the golh club 2 is swiveled backward to be ready to throw the sky ballet golfrisbee 1. As shown in FIG. 21E, due to the eccentric force, the sky ballet golfrisbee 1 rotates. As shown in FIG. 21G, the golfrisbee 1 takes off and flies in the sky. As shown in FIG. 21L, there are arrowheads 1*a* around the peripheral of the golfrisbee 1*m*. As shown in FIG. 1E, swiveling the golh club, the golfrisbee with arrowhead hits and attached on the target board 18*a*.

FIG. 23 shows the alternative design of the golfrisbee 1 made of the boomerang disk-ring. As shown in FIG. 21J, the boomerang polygon is the combination of two different boomerangs 172*m* and 173*m* as shown in FIG. 16 and FIG. 17. Comparing with the boomerang polygon as shown in FIG. 21K with the boomerang disk-ring as shown in FIG. 23A, the boomerang disk-ring is the boomerang polygon with the number polygon edges to be infinite. The golfrisbee 1 is also considered the combination of the boomerang 172*m* as shown in FIG. 16 and the disk-ring 1*h* as shown in FIG. 20. As shown in FIG. 23, the hole 42 in the ring band is to reduce the weight. The center weight 12 is added to the center of the golfrisbee to increase the spinning effect. The center weight 12 is constituted of the weights 120, 124 the screw 122 and the nut 123. For the night golf and/or snow golf, the weight 120 and/or 124 can be either the light source and/or the sound source.

Figure 36A:
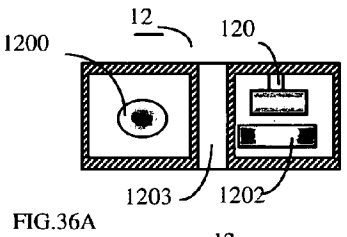
FIG. 36 (A) is the section view of the integrated waterproof LED light for golfishing golfrisbee; (B) is the top view of the integrated waterproof LED light for golfishing golfrisbee.
Figure 36B:
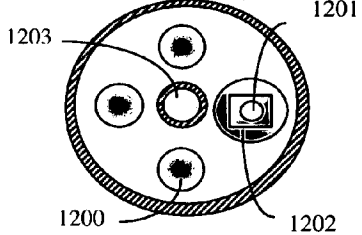

As shown in FIG. 36, the weight 120 is the light source for the night golh and snow golh. The screw 122 passes the hole 1203 to hold the light 120 to the golfrisbee 1. The light source 1200 emits the light in the night golh to guide the golher to locate the golfrisbee. To save the power, the light sources are LED. The LEDs have different colors. As the golfrisbee rotates in the night, it has the rainbow in the dark sky. The switching button 1201 can be pushed to shut the battery power. The switching button can be capacitor type that the seal of 1201 can be solid. The battery and the switching circuit 1202 are to supply the power and light control to the light source 1200.

Figure 37A:
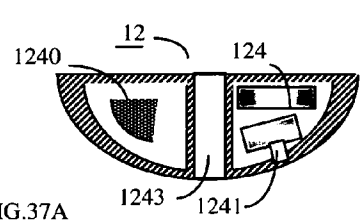
FIG. 37 (A) is the section view of the integrated waterproof sonar sound generator for golfishing golfrisbee; (B) is the top view of the integrated waterproof sonar sound generator for golfishing golfrisbee.
Figure 37B:
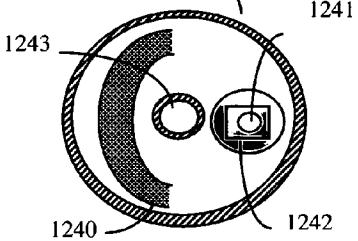

As shown in FIG. 37, it shows the sound source 124 is to add the weight at the center of the golfrisbee for the night golh and snow golh. The screw 122 passes the hole 1243 to hold the sound source 124 to the golfrisbee 1. The speaker 1240 generates the sound to guide the golher to locate the golfrisbee. The switching button 1241 can be pushed to shut the battery power. The switching button can be capacitor type that the seal of 1241 can be solid. The battery and the switching circuit 1242 are to supply the power and light control to the light source 1240.

As shown in FIG. 28, to have the video, audio effect and enhanced curved flying capability, the golfrisbee is modified to be the helicopter type golfrisbee as shown in FIG. 24. To have the control of the soft landing in the golfrisbee basket

182*cp*, the boomerang golfrisbee 1 adjusts the boomerang wing 17 to have different curved path. The boomerang wing 17 has many different wing segments to modify the curved flying path of the golfrisbee. As shown in FIG. 28A, the boomerang wing 17 having the segment 17*a* is for the right-hand golh club to have the curved up flying path. As shown in FIG. 28B, the boomerang wing 17 having the segment 17*b* is for the left-hand golh club to have the curved up flying path. As shown in FIG. 28C, the boomerang wing 17 having the segment 17*c* is for the left-hand golh club or right-hand club to have the curved up flying path. The segment 17*c* is derived from the bi-directional wing segment 1*m* as shown in FIG. 10D. As shown in FIG. 28D, the boomerang wing 17 having the segment 17*d* is for the right-hand golh club to have the curved down flying path. As shown in FIG. 28E, the boomerang wing 17 having the segment 17*e* is for the left-hand golh club to have the curved down flying path. As shown in FIG. 28F, the boomerang wing 17 having the segment 17*f* is for the left-hand golh club or right-hand club to have the curved down flying path.

As shown in FIG. 24, the golfrisbee has the universal wing 17*a*. The wing segment 17*a* can adjust the angle of attack to change the flying path of the golfrisbee. The wing segment 17*a* has the short stub 17*b* pivotally fitting in the golfrisbee body. Changing the angle of the attack of the wing segment 17*a*, the lift force of the golfrisbee will change. The flying path of the golfrisbee will change accordingly.

There are many different versions of the golfrisbee. As shown in FIG. 24, the cap 131L is the punched through cap. For the punched through type cap, the launching angle can be increased a lot. Furthermore, the golfrisbee 1 can be made much thinner. It can reduce the drag force. The flying distance can be much farther. As shown in FIG. 25 the wing segment 17 is optional to be removed to be a golfring. As shown in FIG. 26, the golfrisbee has only one right hand cap to minimize the air drag. To have the weight balance, the air bubble 13*b* is embedded in the golfrisbee body on the opposite site of the cap. The volume of the air bubble is the same as the volume of the cap. There are different ways to make the golfrisbee to float in the water and light up in the night. The golfrisbee with air bubble can float in the water. The golfrisbee is made of foam rubber can also float in the air to be fishing golfrisbee. The LED installed on the golfrisbee can light in the night. The fluorescence added golfrisbee also can light in the night golf course. Furthermore, the golfishing adopt the floating lighting golfrisbee as shown in FIG. 26.

Figures 26A, 26B, 26C:
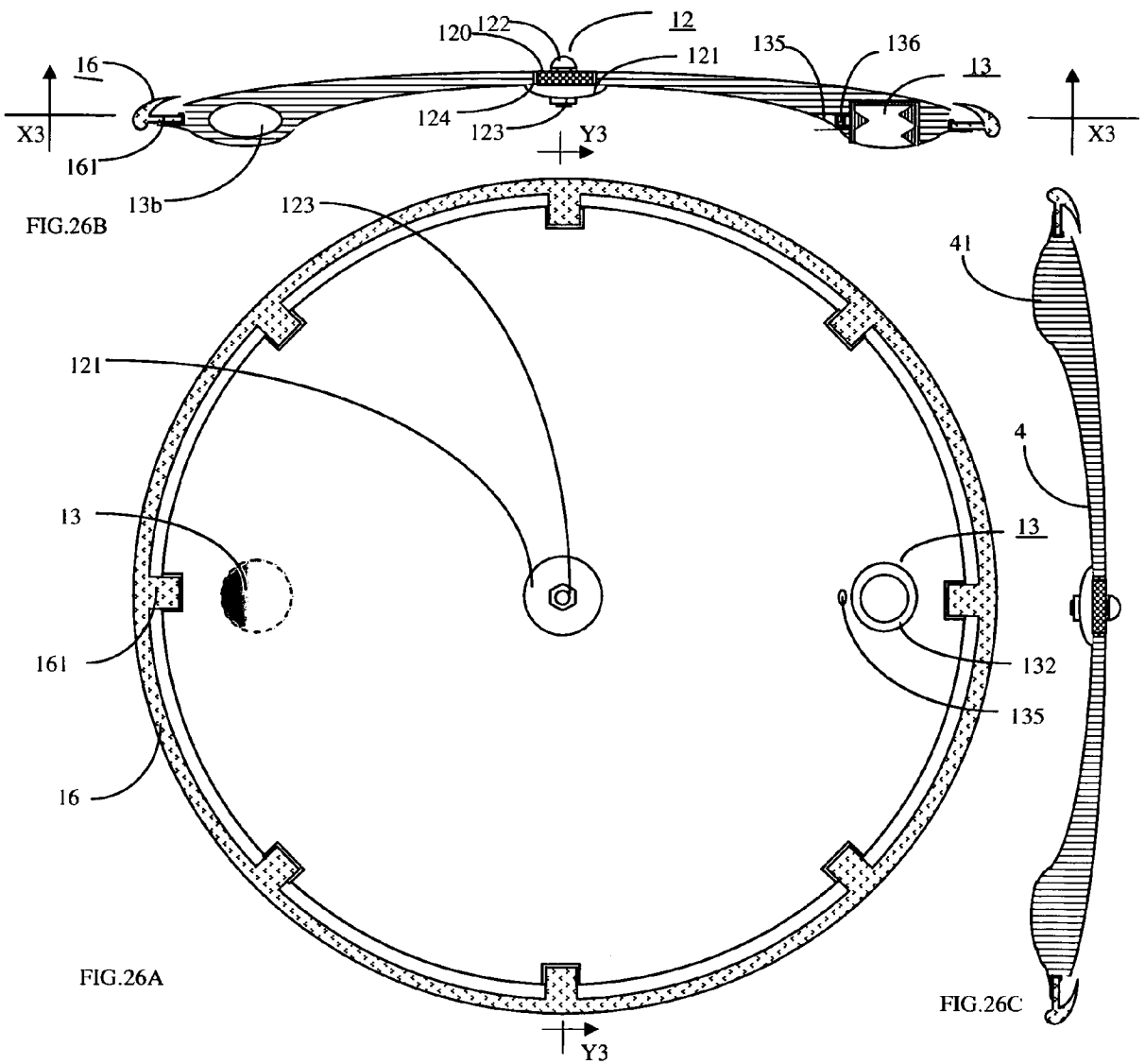
Figure 26D:
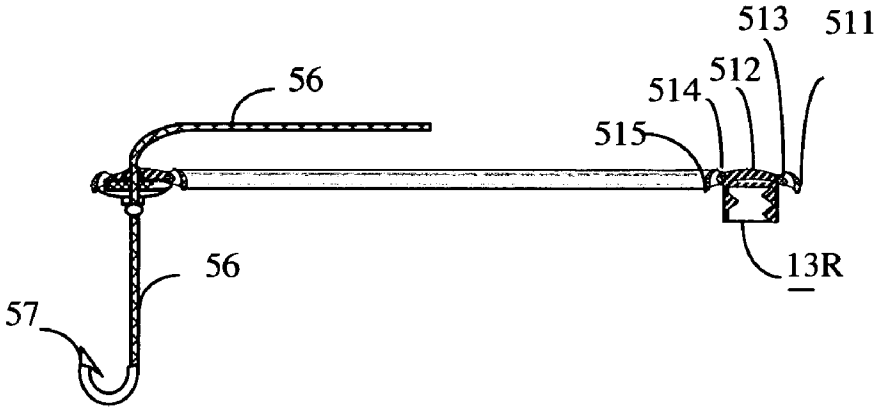
Figure 26D:
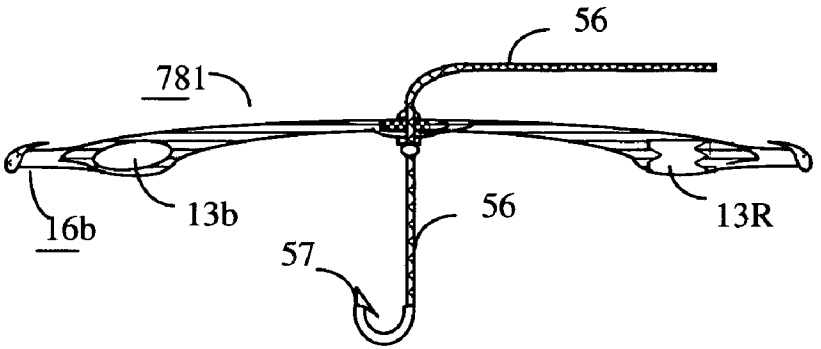
Figure 26E:
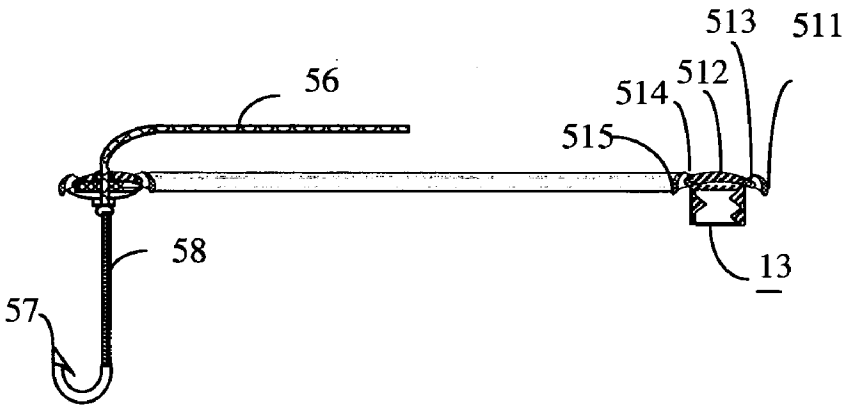
Figure 26E:
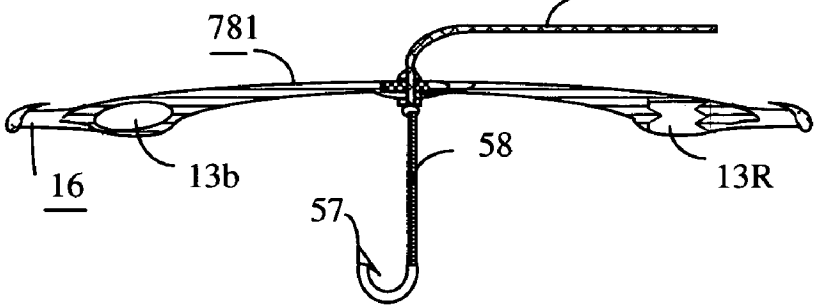
Figure 26F:
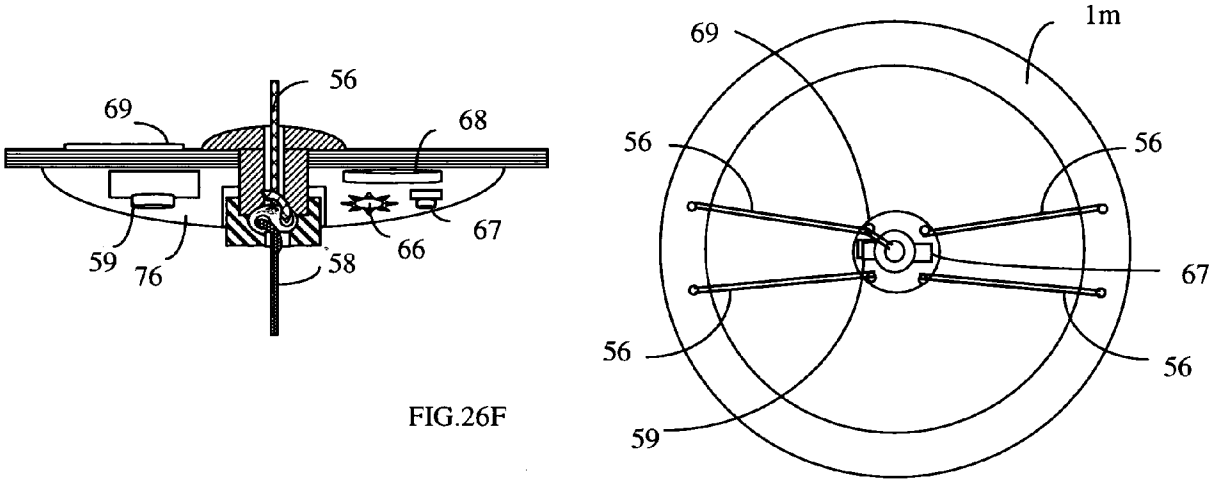

On the golfishing golfrisbee, there are sensor and transmitter of monitor to monitor fishing activities under water surface, transmitter of monitor being carried with golfishing golfrisbee, monitoring signal of monitor being transmitted back and displaying on display. Referring to FIG. 26Q, the golfishing comprises a golfishing rod 78, golfishing golfrisbee 781 and reel 77 for wrapping fishing line 56*t*. The golfishing rod 78 comprises a fishing pole 783, golh club pole 782 and golh club head 34. The golfishing golfrisbee 781 is pivotally rotating mounted on golh club head 34 and golfishing golfrisbee 781 is able to float in water. A fishing line 56*t* is attached to golfishing golfrisbee 781. Swiveling golfishing rod d 78, the golfishing golfrisbee 781 takes off from golh club head 34. As golfishing golfrisbee 781 taking off from golfishing rod 78, the golfishing golfrisbee 781 carries the fishing line 56*t* to fly to farther place. As shown in FIG. 26D, the fishing golfrisbee 781 has the fishing line 56 attached to the golfrisbee 781. The fishing hook 57 can go up down vertically in different water depth. In FIG. 26E, it shows the alternative design of the golfrisbee 781. The fishing hook 57 is kept at the constant water depth by the terminal fishing line 58. FIG. 26F shows the basic wireless golfishing golfrisbee. As shown in FIG. 26F, a portion of the fishing monitor is carried to fly with golfishing golfrisbee 781. The fishing monitor comprises a sensor, transmitter 760, and receiver 761, signal processing 762 and display 773. The sensor such as the video camera 59 is mounted beneath golfishing golfrisbee 781 to monitor the fishing activities under water. The transmitter 760 transmits the monitoring signals generated by sensor back to the receiver 774. Receiver 761 receives the monitoring signal and send monitor signal to signal processing 762 to process monitoring signal. The processed signal is sent to display 773 for fisherman to monitor fishing activity under the golfishing golfrisbee 781.

Figure 26G:
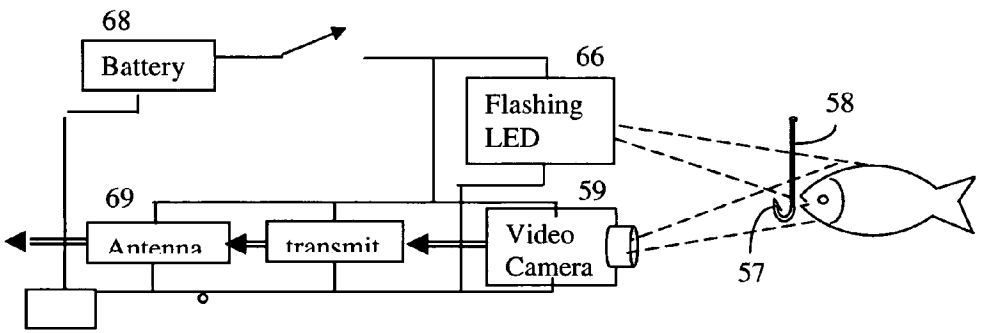
Figure 26H:
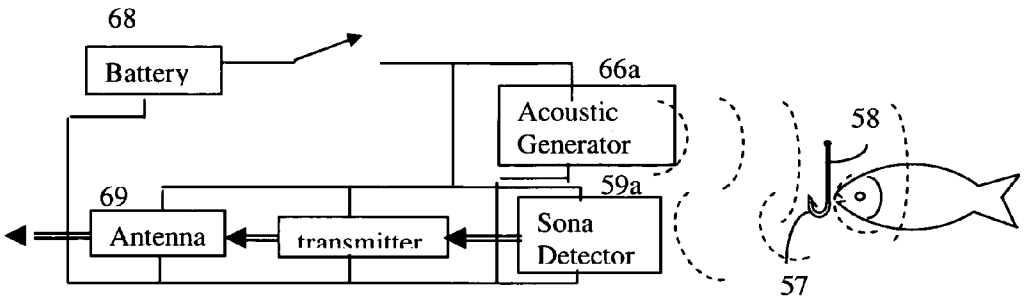

FIG. 26G is the block diagram of the basic wireless golfishing golfrisbee. The golfishing golfrisbee 781 comprises lure to attract fishes. The lure comprises light or LED 66. The flashing LED 66 shines light and attracts fishes. The LED 66 is controlled to flash and light in different modes. The video camera 59 takes the picture of the fish and transmits the video data with transmitter 760. For wireless smart golfishing, golfrisbee the transmitting video signal is sent with the antenna 69. As shown in FIG. 26H, the fishing golfrisbee also can adopt the sonar system. The acoustic wave generator 66*a* transmits acoustic wave. The acoustic wave reflects from the fish. The reflected acoustic wave is received by the sonar detector 59*a* converting to be the sonar signal. The sonar signal transmits with the transmitter and antenna 69. The fishing lines 56*s* and 56*t* further comprise an insulate layer and core including conductive core 56*c* to transmit electricity. The insulate layer 56*i* wrapping around the conductive cores 56*c*. The core 56*c* has a plurality of connection patterns of single line, dual lines in parallel, twisted pairs and multiple wires of more than three, etc. The fishing line 56*s* and 56*t* transmit power and commands from smart reel 77 through golfishing rod 78 to said golfishing golfrisbee 781 and transmitting high speed video data transmission from golfishing golfrisbee 781 through golfishing rod 78 back to smart reel 77. Taking advantage of the nano-technology, the fishing line can be very strong that the golfishing has many potential applications. For example, the fireman and lifeguard can use the golfishing golfrisbee to send the strong nano-fishing line to save the people drown in the sea, etc. As shown in FIG. 26I and FIG. 26J, the fishing line 56*s* can supply the power to the golfishing golfrisbee. As shown in FIG. 26K and FIG. 26L, the fishing line 56*t* can transmit both power and signal. As shown in FIG. 26L, the transmitter sends the differential signal on the Power line P and Ground line G separately. The fishing line 56*s* also can transmit signal with the water being ground. The imaging transmitting line is the mirror to the ground. The receiver 761 and display 773 are embedded with the reel 771 to be a smart reel 77. The smart reel 77 further comprises a rotor 777 and control panel 776. The display 773 is preferred to be flat panel 773 being integrated with control panel 776. The rotor 777 drives the reel 767 to rotate to rewind fishing line 56 to tow golfing golfrisbee 781 across water surface. Monitoring and detecting the fishing activities with flat panel display 773, the fisherman uses the control panel 776 to stop rotor 777 and uses hand to crank a handle 772 to rotate reel 767 to rewind fishing line 56. The sensor is an image sensor of video camera 59. The image sensor of video camera 59 takes picture of underwater fishing activities beneath water surface and sends video signal of image picture through transmitter 760 back to receiver 761 to display underwater fishing activities on the flat panel 773.

Figure 26O:
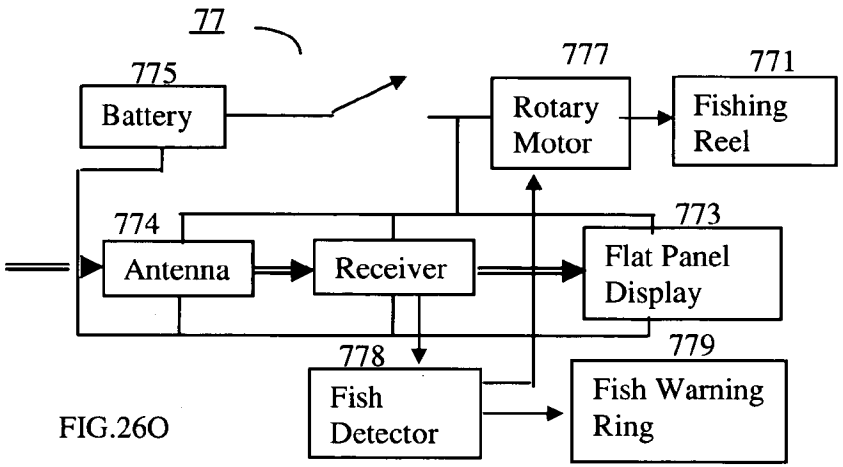
Figure 26P:
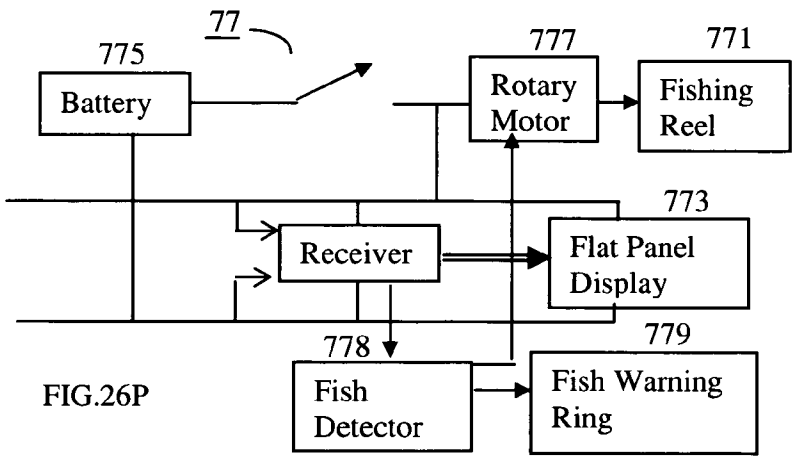
Figure 26N:
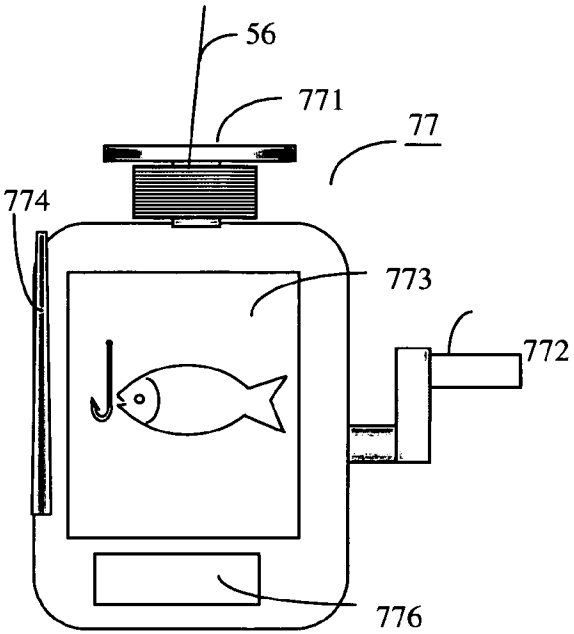
Figure 26N:
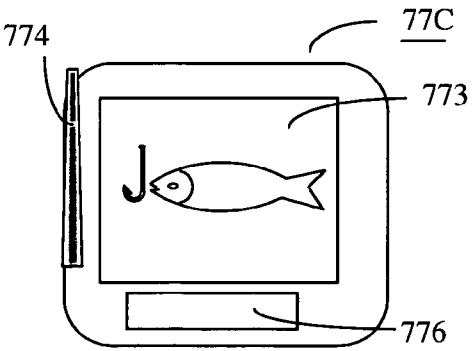
Figure 26R:
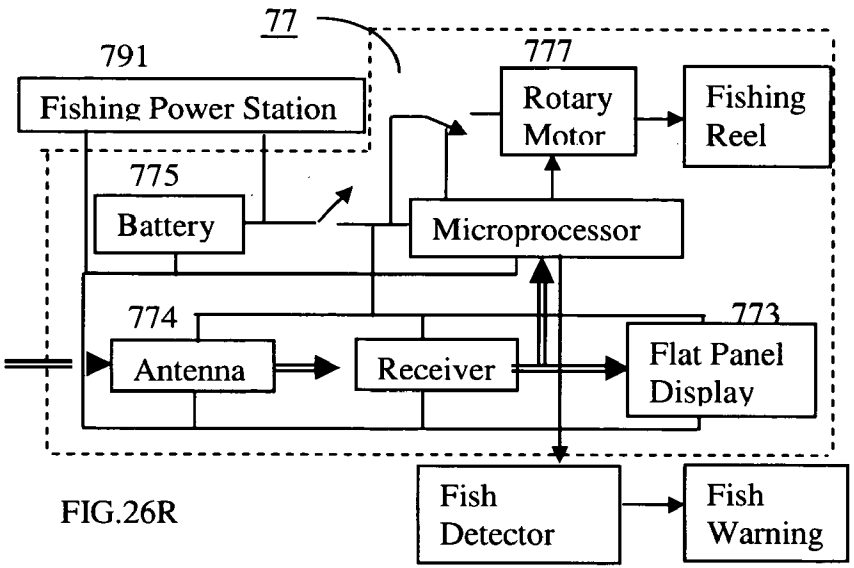
Figure 26S:
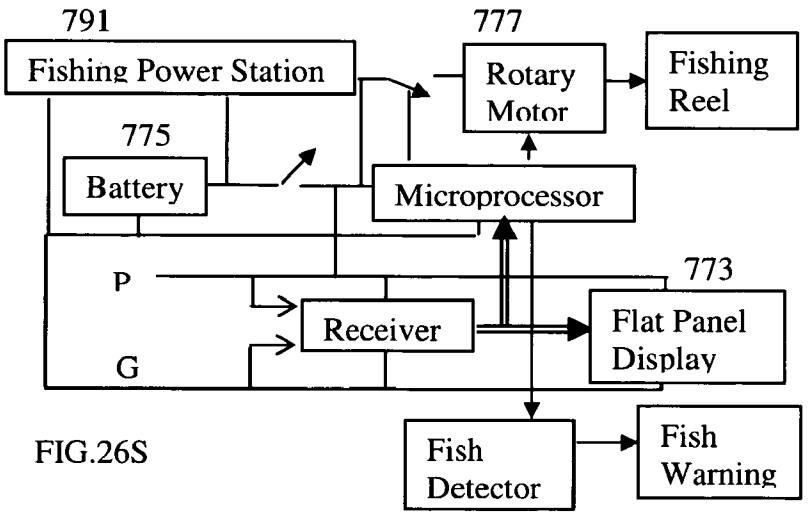
Figure 26Q:
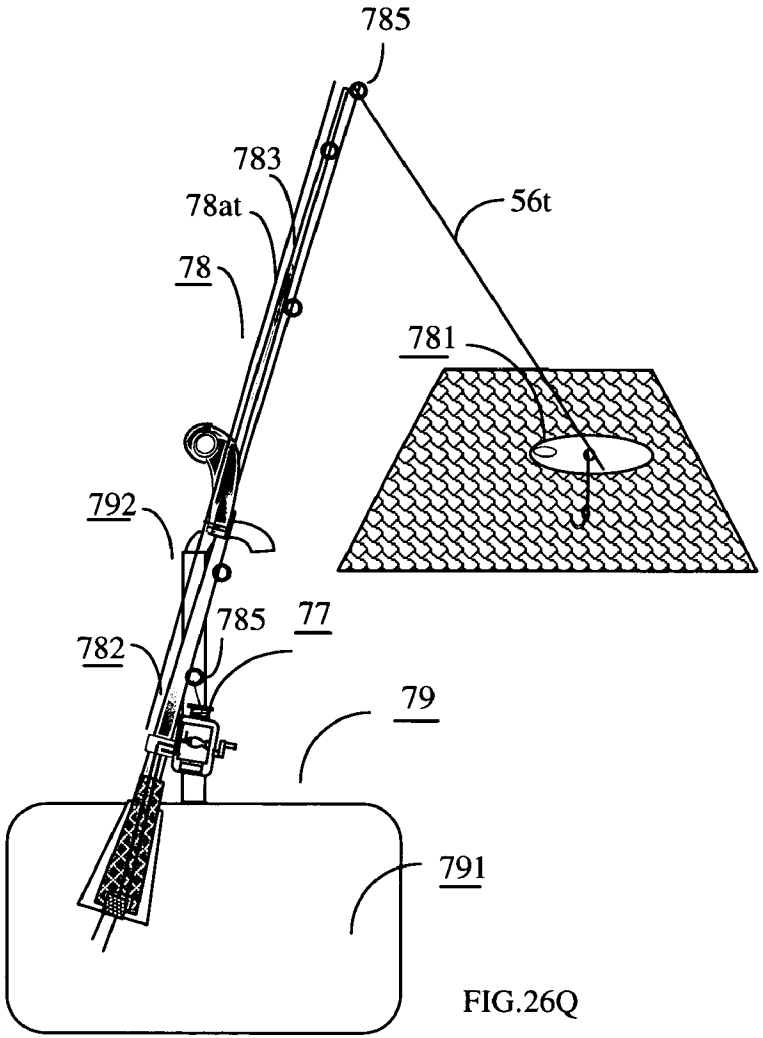
Figure 26U:
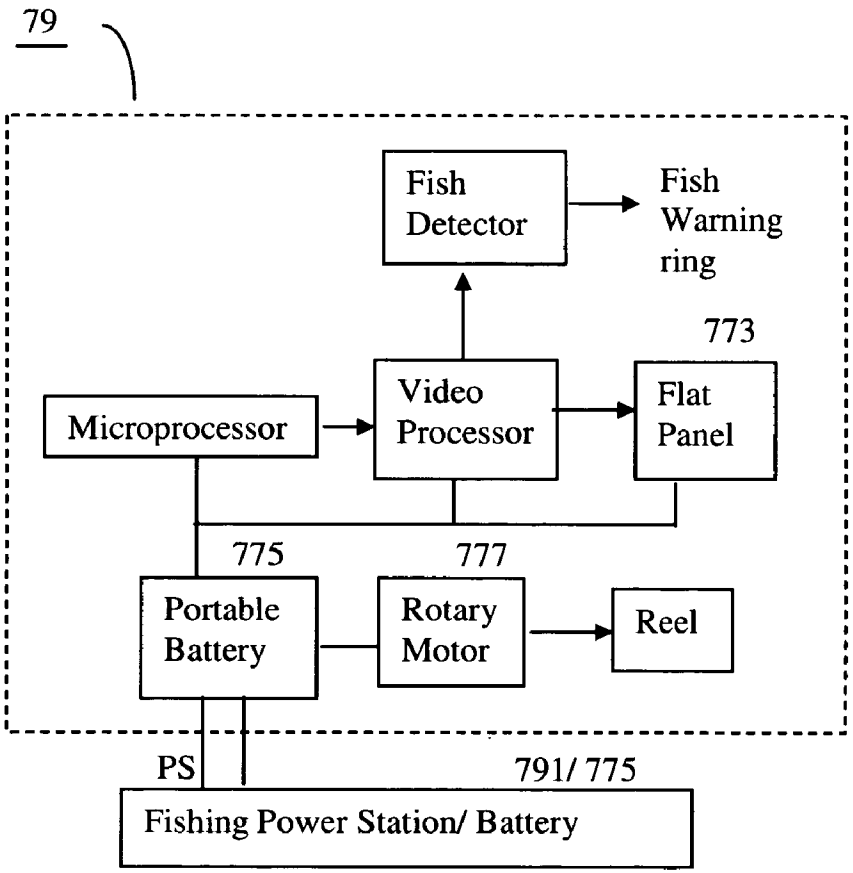
Figure 26T:
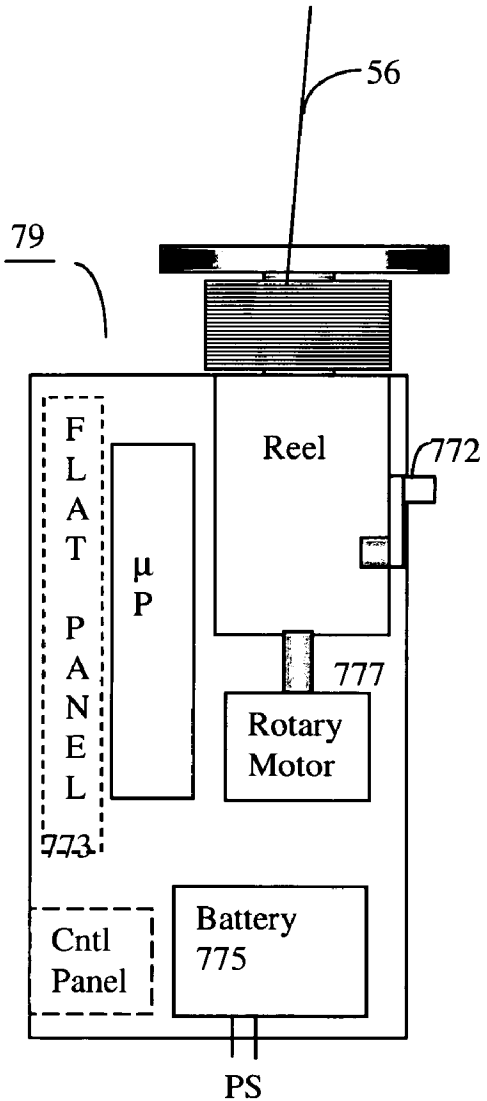
Figures 26V, 26W, 26X:
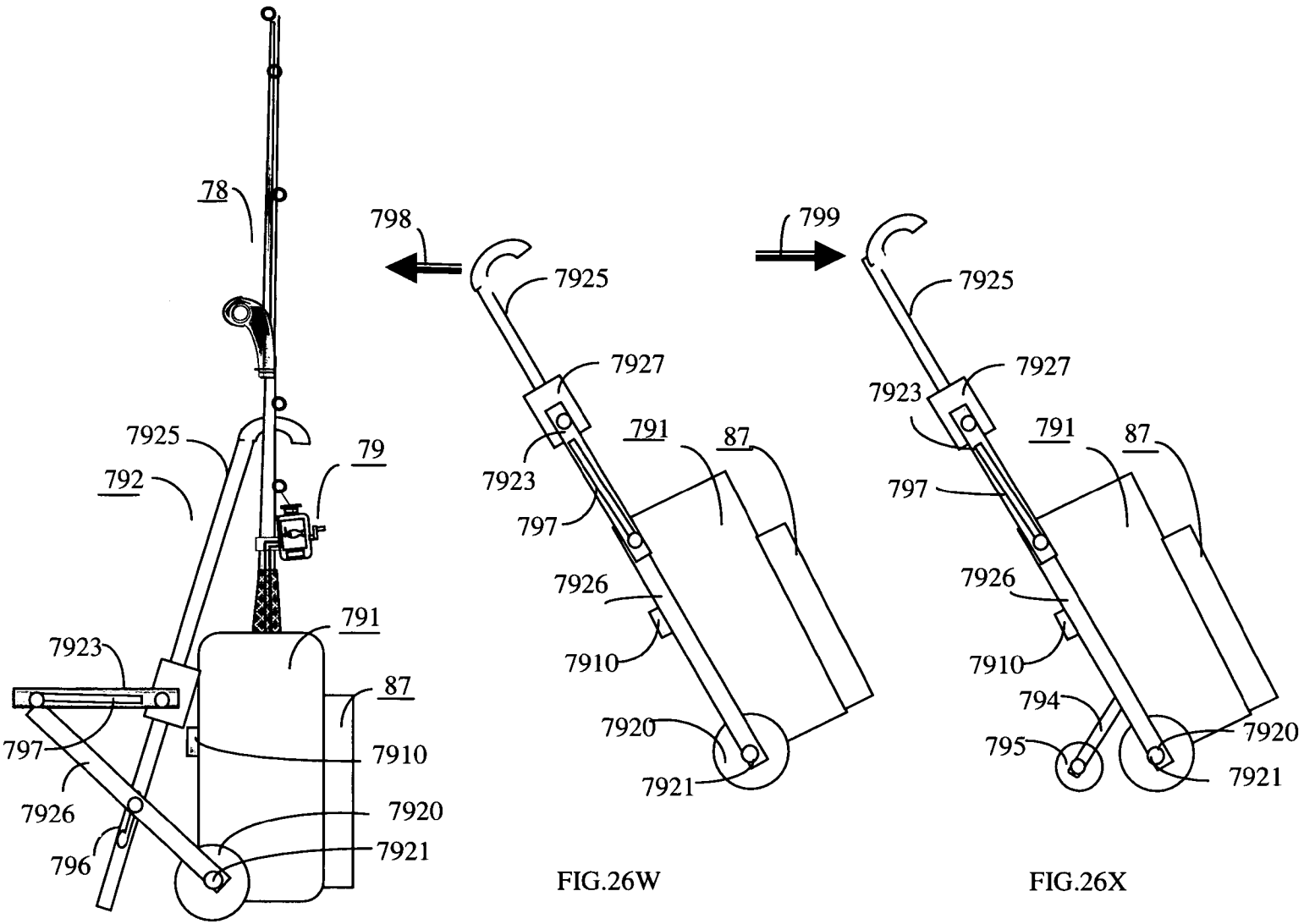
Figure 26Z:
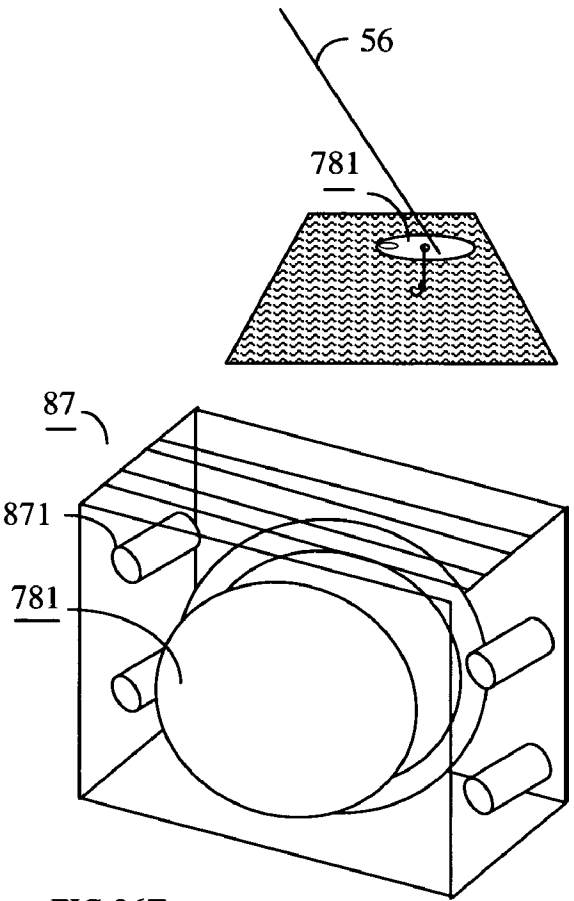
Figure 26Y:
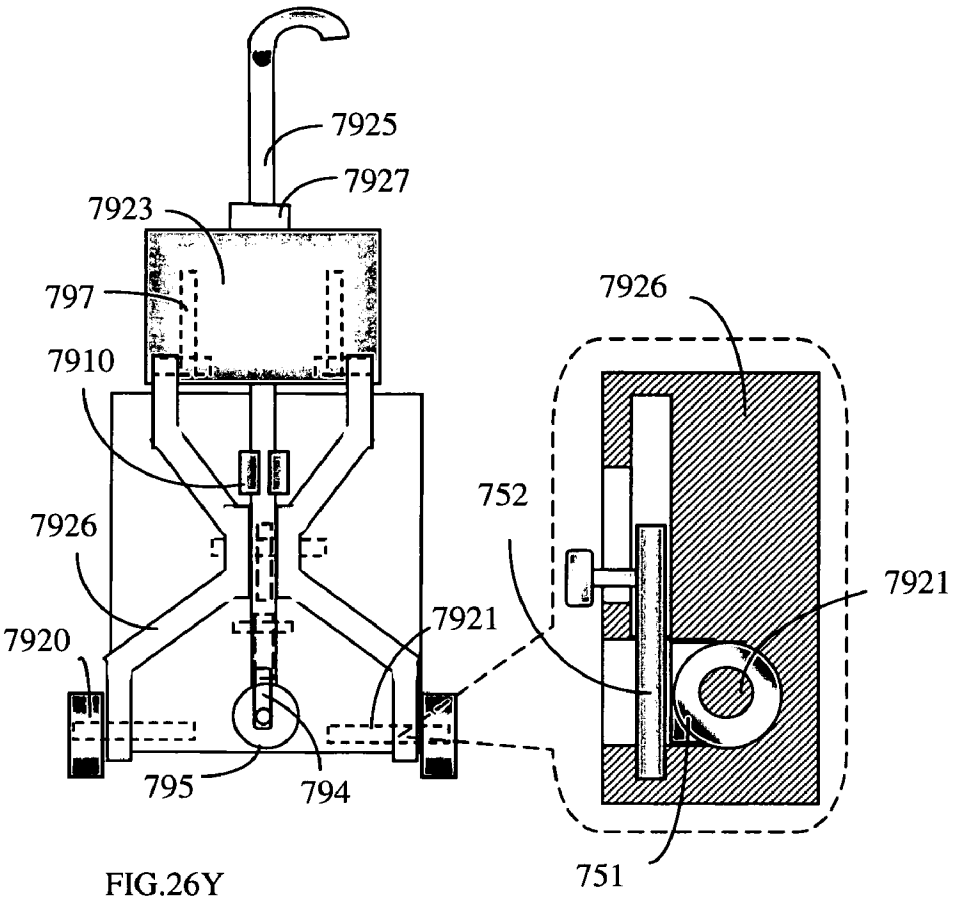

FIG. 26N shows the smart fishing reel 77 is constituted of the reel 771, cranking shaft, fishing video monitor 773, receiving antenna 774, control panel 776, rotor 777, and the battery 775. The fishing video monitor 773 can be either moved out of the smart fishing reel 77 to be the cellular phone 77C or share the fishing video with the existing cellular phone 77C. The fishing video 773 can be displayed on the commercial cellular phone. It is much better to have the cellular phone video monitor 77C to be put on the smart fishing reel 77 or can removed from the smart fishing reel 77 to be the independent fishing monitor and serving as the cellular phone 77C. For the wireless smart fishing reel, as shown in FIG. 26O, the antenna 774 and receiver receives the video signal and displays the video signal on the flat panel display 773. Press the control panel 776, the rotor 777 drives the rotator to rotate the reel 771 with different pulsing modes. As the DSP (Digital Signal Process) of fishing detector 778 detects the fish, the fishing detector will send the signal to automatic rotor 777 to change the rotor modes and send signal to the warning ring and melody generator 779 to generate the sound to attract the attention of fisherman. With the remote fishing monitoring capability, the fishing becomes much more interesting and productive. There is no more guessing and anxiety in the smart fishing with fishing golfrisbee. For the wired smart fishing reel, as shown in FIG. 26P, the receiver receives the video signal and displays the video signal on the flat panel display 773. The battery 775 embedded in the smart fishing reel 77 is to provide the short time power. The golfishing rod 78 comprises a golh club 782 and a fishing rod 783. The fishing rod 783 is mounted on an end of golh club 782. The fishing rod 783 has elasticity is for fishing. The golh club has the elasticity for throwing golfishing golfrisbee 781 to fly. The fishing line 56 passes through the guiding rings of fishing rod 783. The fishing line 56 folds back to attach on golfrisbee 781. The golfishing golfrisbee 781 is pivotally mounted on golh head 34 of golh club 782. Swiveling golh club 782, the golfishing golfrisbee 781 takes off and carries the fish line 566 to fly farther. As shown in FIG. 26Q, the golfishing rod 78 seats on the golfishing station 79 to charge up the golfishing battery 775 and make an automatic fishing at the same time. The golfishing rod 78 leans on the golfishing station handle 792 with the rotor 777 automatic rewinding of the fishing line 56*t*. The antenna 78 at can be attached on the fishing pole 78 that the fishing pole 78 serves as the basestation to have the long-range communication capability with the minimum power. The golfishing golfrisbee 781 is fluorescent buoyant golfrisbee to be lighting in dark and floating in water. To optically charge up fluorescent buoyant golfrisbee 781, as shown in FIG. 26Z, inserting fluorescent buoyant golfrisbee in an optical-charging box 87 optically charge golfrisbee 781. The optical-charging box 87 comprises light 871 to emit photons to optically pumping fluorescent buoyant golfrisbee 781. To provide electricity to fishing activities, the golfishing facilities 79 comprises a fishing power station 791 to supply power to optical-charging box 87, etc. The fishing power station 791 can convert either AC power or automotive power to store in battery storage of the fishing power station 791. In the night fish, the fishing golfrisbee 781 floats in the water and lights. To optical charge up the fluorescent fishing golfrisbee, as shown in FIG. 26Y, the golfishing golfrisbee 781 is inserted in the optical charge box 87. The light bulb 871 lights up and emits the photon to make the optical charge up for the fluorescent golfishing golfrisbee 781. The power of the optical charge box 87 comes from the fishing station 791. Therefore, the optical charge box 87 can be integrated with the fishing station 791. FIG. 26T and FIG. 26U show the integrate system of golfishing. The golfishing adopts the towing-pushing-seating-baggage 79 being able to do the smart golfishing in any tough environment. A towing-pushing-seating-baggage 792 is for golfishing. The golfrisbee 781 is carried with towing-pushing-seating-baggage 792. The towing-pushing-seating-baggage 792 comprises a wheeled baggage 791 and a seating stick 792. The wheeled baggage 791 further comprises two wheels 7920 and a droppable third wheel 795. The seating stick 792 has three legs. As shown in the callout in FIG. 26Y, two legs 7926 has lock rings 752 being engaged with the bearings 751 of the axle 7921 of two wheels 7920 of wheeled baggage 791. The seating stick 792 can be separated from the wheeled baggage 791. As the seating stick is separated from wheeled baggage 791 and the seating stick 792 is folded, the seating stick 792 serving as a stick in a stick mode. As shown in FIG. 26V, the seating stick 792 is unfolded. The seating stick 792 serves as a chair in a seat mode. As the seating stick 792 is engaged with wheeled baggage 791 with two legs 7926 having lock rings 752 being engaged with the bearing 751 of axles 7921 of two wheels 7920 of wheeled baggage 791. As the droppable third wheel 795 dropping to contact with ground, as shown in FIG. 26X, the towing-pushing-seating-baggage 79 is able to push forward in a pushing mode. As the droppable third wheel 795 retracting in wheeled baggage 791, as shown in FIG. 26W, the towing-pushing-seating-baggage 79 is able to tow forward in a towing mode. As the seating stick is unfolded, as shown in FIG. 26V, the seating stick serves as a chair in a rest mode.

Carrying the golfishing station 79 to make the golfishing in the field, as shown in FIG. 26V, FIG. 26W and FIG. 26X, the fishing station 79 integrates the portable towing stick chair 792 with the power station 791. The portable towing stick chair 792 is for the general purpose and it can be integrated with any kind of baggage. Here it shows the baggage to be the fishing power station 791. FIG. 26R shows the wireless fishing power station. FIG. 26S shows the wired fishing power station. The fishing power station 791 supplies power to the battery 775 of the smart reel 77. Pressing on the control panel 776, the smart reel 77 is power on. The battery 775 supplies power to the reel. As the antenna 774 and receiver 761 receives signal and the video signal is sent to the microprocessor 762 to do digital signal process. In the automatic fishing-rewinding mode, the rotary motor 777 drives the fishing reel 767 to rewind the fishing wire 56 with scan mode. As the fish is detected with the fish detector 778, the warning signal is generated to call the attention of the fish man. At the same time, the microprocessor 762 changes the rotor speed to be short pulsing mode to attract the fish. FIG. 26T shows the side view of the physical alignment of the components inside the smart reel 79 which incorporated with fishing power station 791. FIG. 26U shows the block diagram of the smart reel 77 which incorporated with fishing power station 791. FIG. 26V shows the smart fishing with the fishing golfrisbee 781 and fishing station 79. The power of smart reel 77 is connected through the rod. The golfishing rod 78 seats on the fishing power station 791. The golfishing rod 78 leans against the stick 7925 of the towing stick chair 792. The fish man sits on the chair plate 7923. The link 7926 and the stick 7925 constitute a triangle structure to support the weight seating on the chair plate 7923. The slot 797 and the slot 796 are for folding the compact towing stick chair 792. As shown in FIG. 26W, the towing stick chair 792 is folded to tow the golfishing station 791. Pull the handle 7925 to tow the baggage. The baggage 791 rolls forward. It is shown by the arrow 798. To take care of the baggage, it had better to push the baggage instead of towing. As shown in FIG. 26X, the third wheel 795 is lowed down to support the baggage 791. The link 794 supports the baggage 791 in the inclined position. Push the handle 7925. The baggage 791 rolls forward. It is shown by the arrow 799. As shown in FIG. 26Y, the third wheel 795 is retracted and hidden at the back of the baggage 791.

Figure 27D:
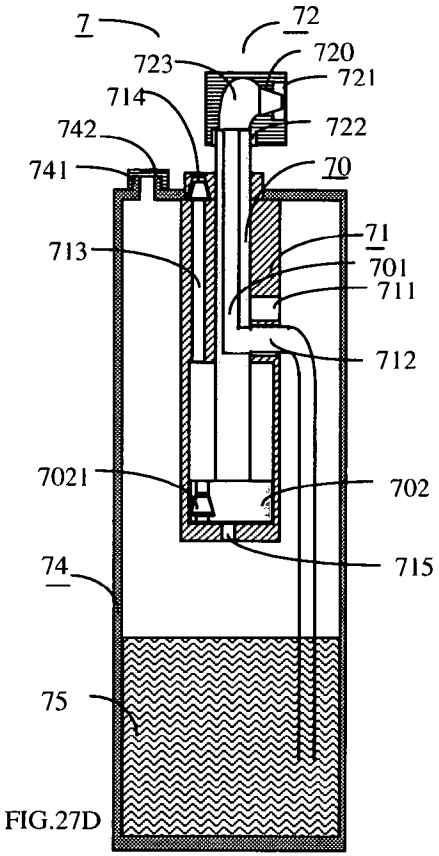

The cap 13 of the golfrisbee is checked and cleaned quite often for the serious competition of championship. As shown in FIG. 27, in the field operation, we use the static friction controller 7. It has the three processes to be integrated in one bottle device: the air compression, the air cleaning and the lubricant application. The static friction controller is constituted of the compressing cylinder 70, the switching block 71, the spraying nozzle 72 and the container 74. The lubricant 75 is stored in container 74. The cap 742 is to seal the lubricant 741 entrances. The spraying nozzle 72 is mounted on the top of the sliding cylinder 70. The sliding tube 70 can be fit in the hole 722. The cavity 723 guides the fluid into the nozzle 720. The hole 721 is to fit for the spraying tube. Pressing on the spraying nozzle 72, the sliding cylinder 70 slides downward. It is shown in the FIG. 27B. The one-way compression piston 7021 moves upward to seal the conduit. The one-way compression valves 714 moves downward to allow the air to be sucked into the conduit 713. The air inside the switching block compartment 716 is forced to flow out into the container 74. As the finger is released, the sliding cylinder 70 moves upward under the air pressure in the compartment 716. The air inside the conduit 713 is compressed and the one-way valve 714 is closed. As the air pressure inside the conduit 713 is larger than the air pressure in the compartment 716, the one-way valve 7021 moves downward. The compressed air flows into the compartment. Repeating the process as shown in FIG. 27A and FIG. 27B reciprocally, the air pressure inside the container 74 is built up.

Figure 27C:
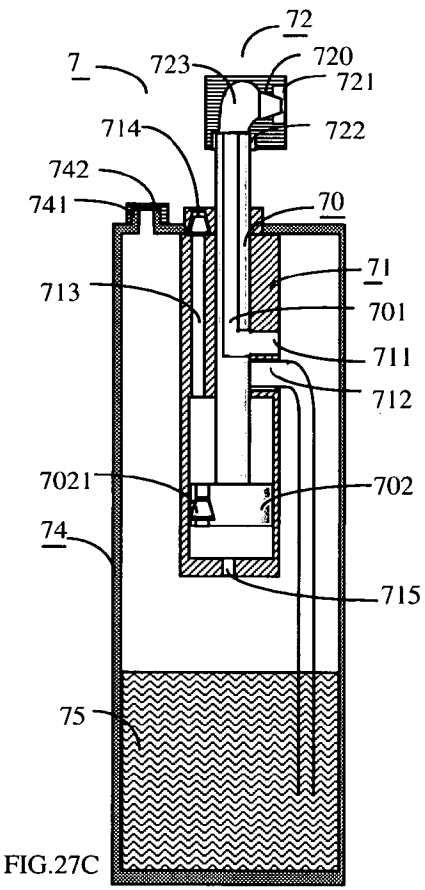
Figure 27B:
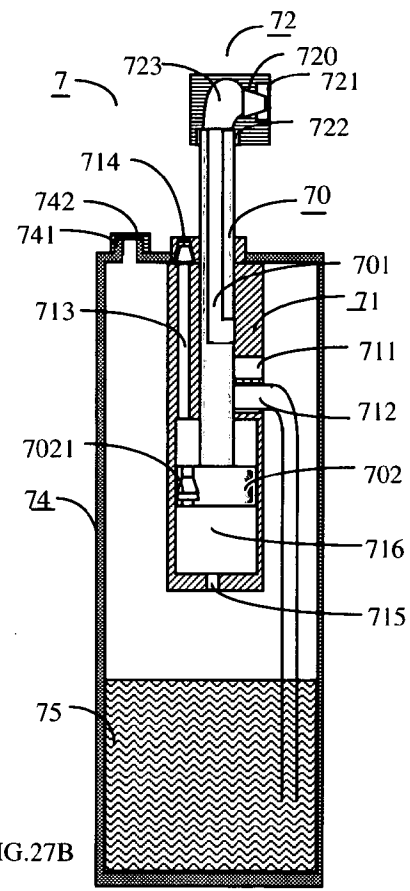
Figure 27A:
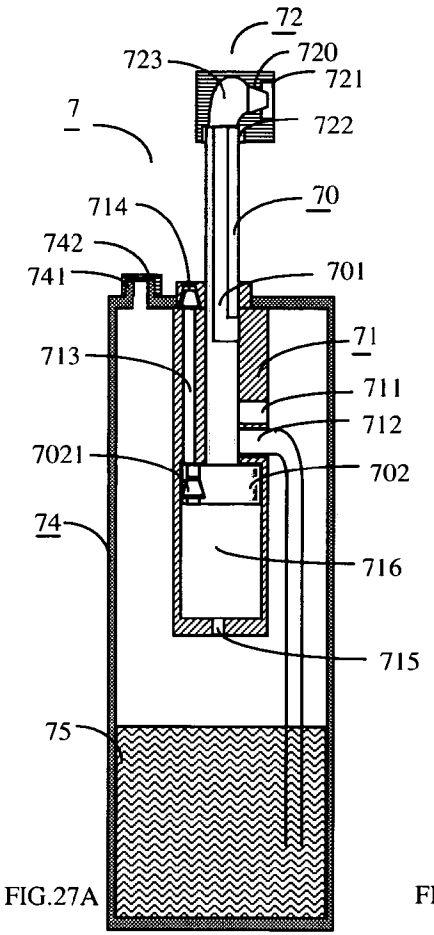

To use the compressed air to clean the cap of the golfrisbee or the screw of the golh head, as shown in FIG. 27C, the finger holds the sliding tube at the position to have the conduit 701 to align with the hole 711 on the wall of the switching block 71. The compressed air flows through the hole 711, the conduit 701, the cavity 723, and the nozzle 720. The compressed air blows on the cap or screw to blow away the dirt. As the dirt is cleaned, the golher can apply the lubricant 75 to the cap or screw. As shown in FIG. 27D, the finger holds the sliding tube 70 at the position to have the conduit 701 to align with the hole 712 on the wall of the switching block 71. The lubricant 75 flows through the hole 712, the conduit 701, and the cavity 723 and the nozzle 720. The lubricant 75 sprays on the cap and screw to lubricate the cap and screw.

As shown in FIG. 29A, the golh trolley 5 is mounted on the axle 500 of wheels 50. The foldable handle 51 pulls the frame 52 to drag the golh trolley 5 forward. The supporter 55 is hinged to the ear 520 on the frame 52 with the pivotal axle 550. The golh bag 4 is leaned against the frame 52. FIG. 29B shows the golh bag being integrated with the portable trolley 5*a*. To ski on the snow, as shown in FIG. 29C, the trolley 5 is mounted on the snow ski 901. To ski on the snow and run on the road, as shown in FIG. 29D, the trolley is mounted on the belt wheel 501. The belt wheel 501 is composed of two wheels 5011 and 5012, belt 5013 and triangle structure 5014. The trolley 5 is pivotally mounted on the top node of the structure 5014.

Figure 30A:
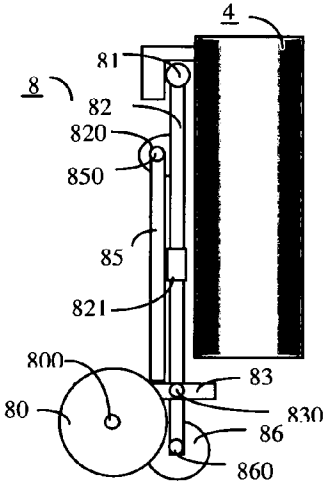
Figure 30B:
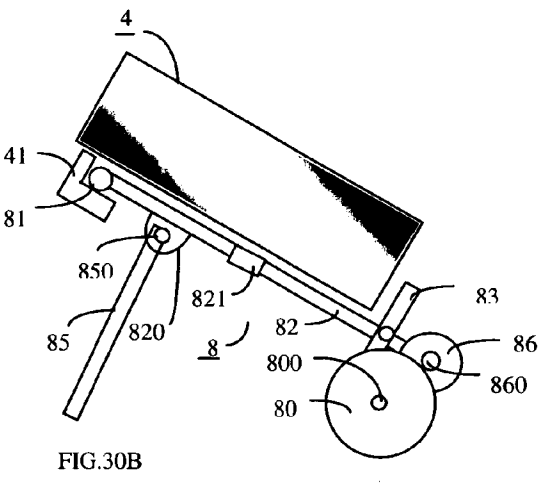
Figure 30C:
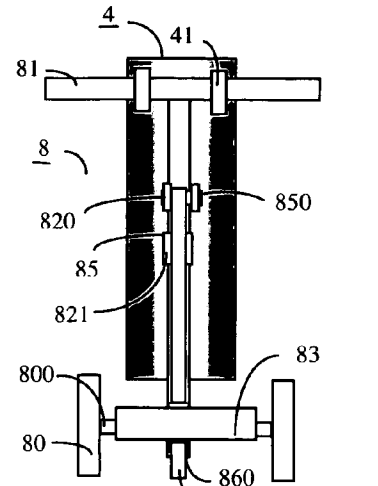

There are two kinds of cart. One is three-wheel golh cart 8 as shown in FIG. 30. The golher can stand on the golh cart 8 to drive the golh cart. The golh cart is a foldable and portable golh cart. Releasing the extension lock 821, the length of pole 82 can be adjusted. The pole 82 is foldable with the pivotal joint 830. The technique for the golh cart adopts our former patent U.S. Pat. No. 5,474,144 Twin-Wheel Motor Car with Differential Height and Speed Mechanism. It needs only one motor to drive the twin-wheels 80. Since it has three wheels, it does not need the complicate self-balance circuits and control. It does not have the speed limit as the two-wheel golh cart does. Therefore, the cost becomes much cheaper and the speed is much faster. As shown in FIG. 30C, the front wheel 86 is mounted on the support frame 82 with the axle 860. Rotating the handle 81, the frame 82 rotates which also causes the front wheel 86 to rotate to change direction. The twin-wheels have the differential mechanism to drive the wheels 86 to have the different speed during the turning direction. In FIG. 30B, the support 85 pivotally rotates on the axle 850 to support the ear 820. The support 85 supports the frame 82. The golf cart is served as the standing bag and golh trolley.

The golh needs to play as the snow golh and the night golh. It is impossible for the golher to pull the golf trolley in the deep snow. It is extreme dangerous to walk in the dark field. The golh cannot use the existed golf facilities to play the snow golh or night golh. In the snowfield and the dark field, the golh trolley has to be integrated with the golh cart and be able to carry the golher. Our new innovative golh cart is unique to have the multiple functions of the golh bag, golh trolley and golh cart. The golh cart is similar to the two-wheel golf trolley. However, the golher can ride on the golh cart.

Figure 35B:
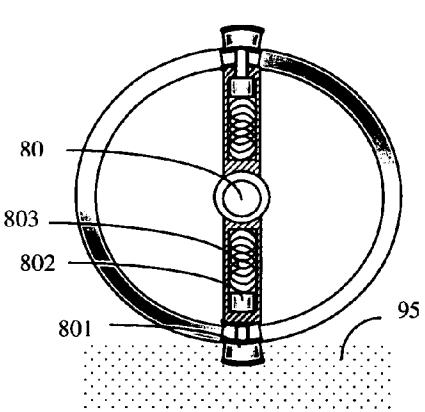
FIG. 35 is the snow wheel; (A) is the snow wheel rolling on the solid ground; (B) is the snow wheel rolling on the snow.
Figure 35A:
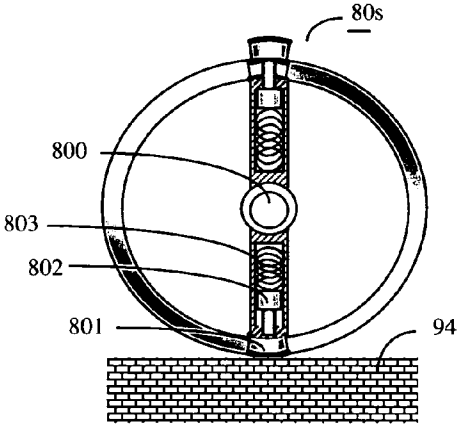

On the contrary, the snow golh and ski golh are the real golf sports in the snowy winter season. To run on the deep snow in the golf course, the wheel can change to be the snow wheel 80*s* as shown in FIG. 35. The wheel paddle 801 is at the end of the cylinder 802. The cylinder 802 is under the bias of the spring 803. As shown in FIG. 35A, the snow wheel 80*s* rolls on the solid ground. The wheel paddle 801 is compressed to be the same circle as the wheel 80*s*. As shown in FIG. 35A, the snow wheel 80*s* rolls on the snow. The wheel paddle 801 is expanded into the snow to serve as the paddle. The wheel paddle 801 expels the snow to drive the golh cart 8 forward or backward.

Figure 30D:
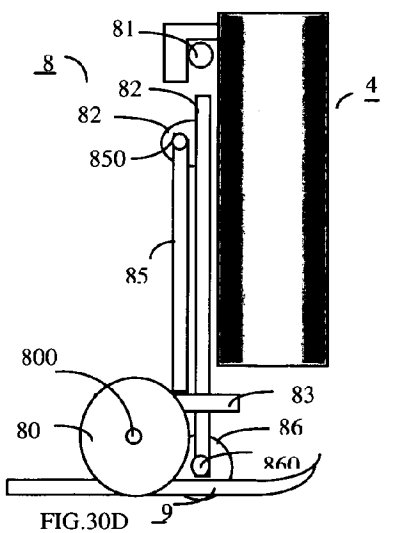
Figure 30E:
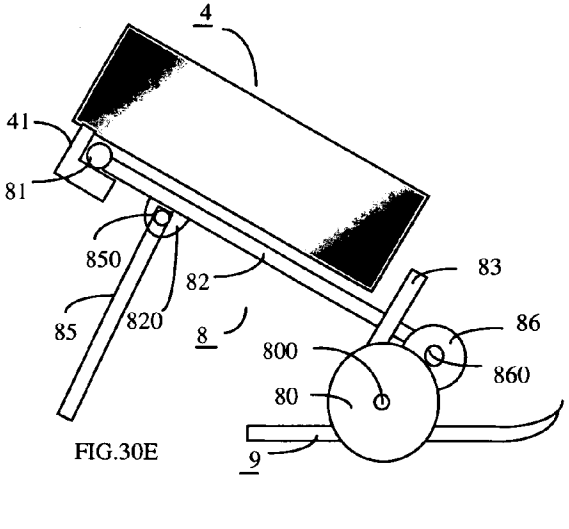
Figure 30F:
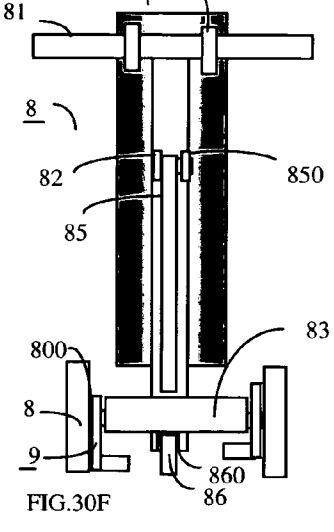
Figure 31A:
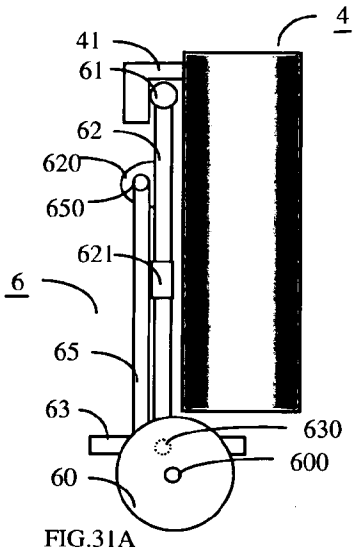
Figure 31B:
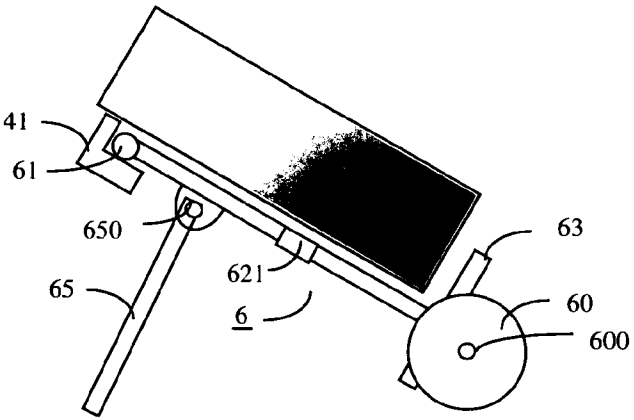
Figure 31C:
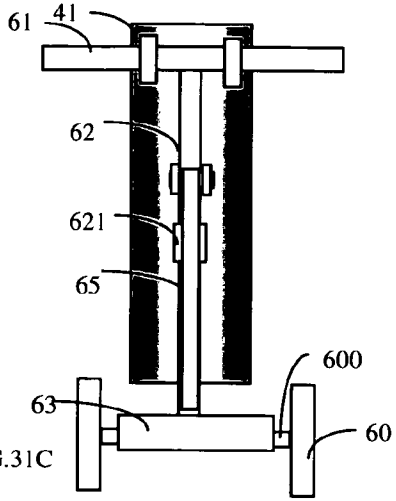
Figure 31D:
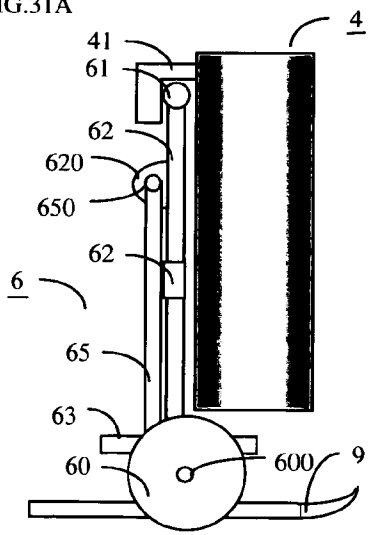
Figure 31E:
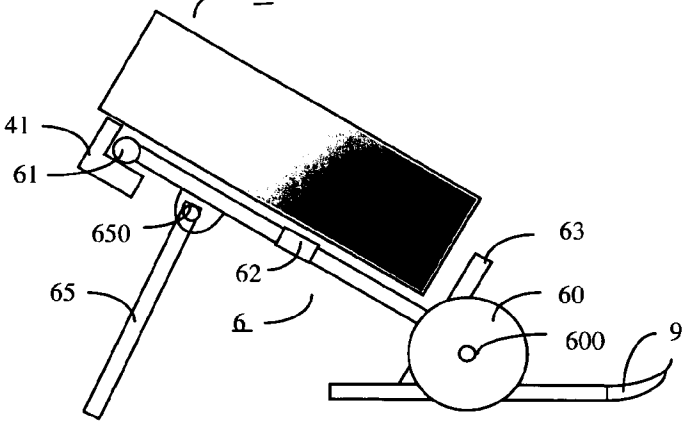
Figure 31F:
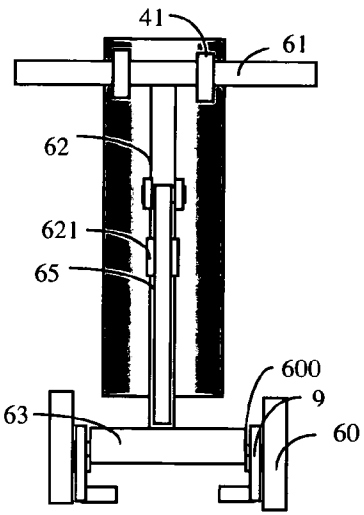
Figure 33A:
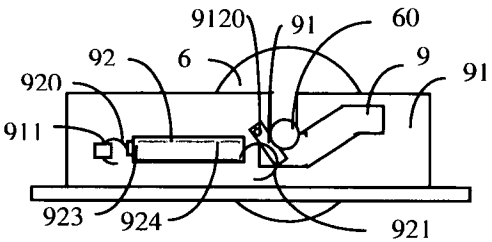
Figure 33B:
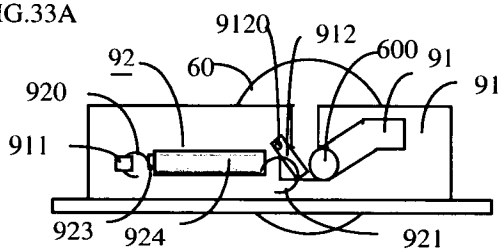
Figure 33C:
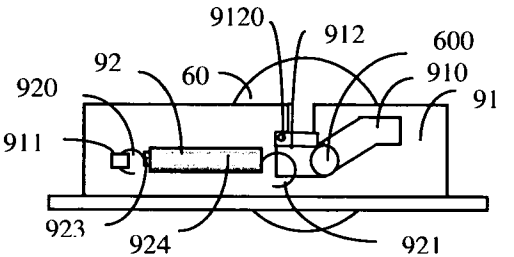
Figure 33D:
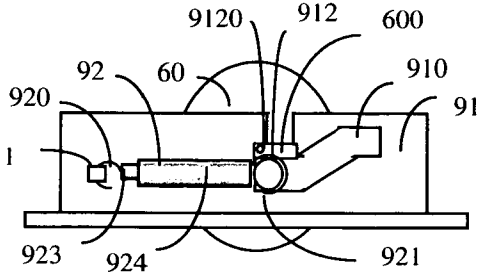
Figure 32C:
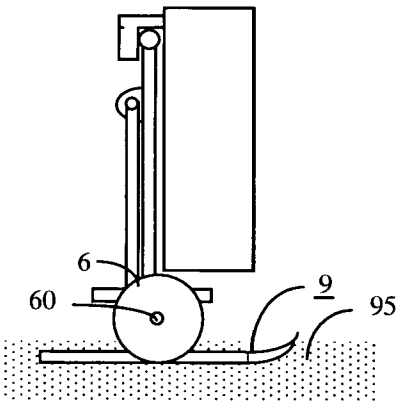
Figure 32D:
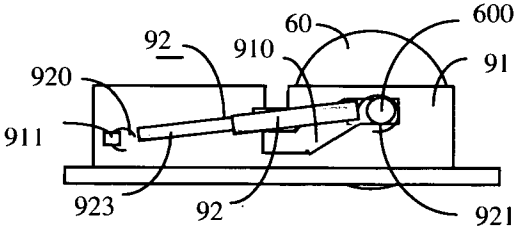
Figure 32A:
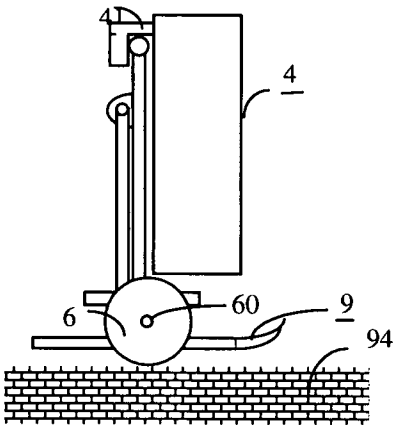
Figure 32B:
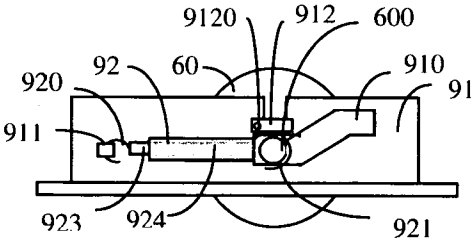

As shown in FIG. 30D to FIG. 30F, the golh cart 9 is further equipped with the automatic golh snow ski 9. As shown in FIG. 32A and FIG. 32B, the automatic golh snow ski 9 is raised up to run on the solid ground. As shown in FIG. 32C and FIG. 32D, the automatic golh ski 9 is lowered to support the weight of golh cart 9 to drive on the soft snow. The wheel can be changed to be the snow wheel 80*s*.

As shown in FIG. 32B, guiding slot 910 notched a Z-shape on the guiding plate 91. The wheel axle 600 passes through the Z-shape guiding slot 910. The spring 92 connects between the axle 600 and the ski 9 to pull the ski forward to raise the ski 9. The spring 92 is constituted of two segments 923 and 924. The segment 924 has the hooked end 921 to hook the axle 600. The segment 924 has the hooked end 920 to hook the ear 923 of the guiding board 91. Under the compression force of the spring 92, the guiding plate 91 is pulled forward to raise the ski 9 up.

As shown in FIG. 32C, the wheel rolls on the soft snow 95 and traps in the snow 95. The ski 9 contacts snow 95. As the wheel 60 rotates to drive the golh cart to move forward, due to friction, the ski 9 is left behind. The wheel axle 600 climbs up the slope of the Z-shape guiding slot 910 to force the ski 9 downward to engage with snow 95 to support the weight of golh carts.

Figure 34:
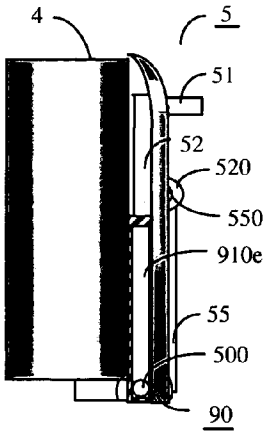
FIG. 34 is the snow ski having the elongated guiding slot to have snow ski to be packed.

FIG. 33 shows the installation of the snow ski without removing the wheel. As shown in FIG. 33A, the wheel axle 600 passes the slot and presses the locking plate 912 downward. The locking plate 912 is pivotally mounted on the guiding plate 91 with the pin 9120. FIG. 33B shows the axle 600 is mounted in the guiding slot 910. FIG. 33C shows the locking plate is closed with the biasing spring. FIG. 33D shows the hook 921 is attached to the axle 600 and the installation is finished. FIG. 34 shows the lower slot of Z-shape guiding slot can make the extension to be the guiding slot 910*e*. The snow ski 9 can be folded to integrate with the golh cart or golh trolley.

FIG. 31 shows the two-wheel golh cart. The golh cart is foldable and portable. Releasing the extension lock 621, the length of pole 62 can be adjusted. The pole 62 is foldable with the pivotal joint 630. The supporting stick 65 is pivotally mounted on the frame 62 with the pivotal axle 650 passing the ear 620 of the frame 62. The two-wheel golher cart 6 is served as the standing bag as shown in FIG. 31B. The snow ski 9 can be mounted as shown in FIG. 32D, FIG. 32E and FIG. 32F. The wheel can be changed to be the snow wheel 8*s*, too.

Figure 38B:
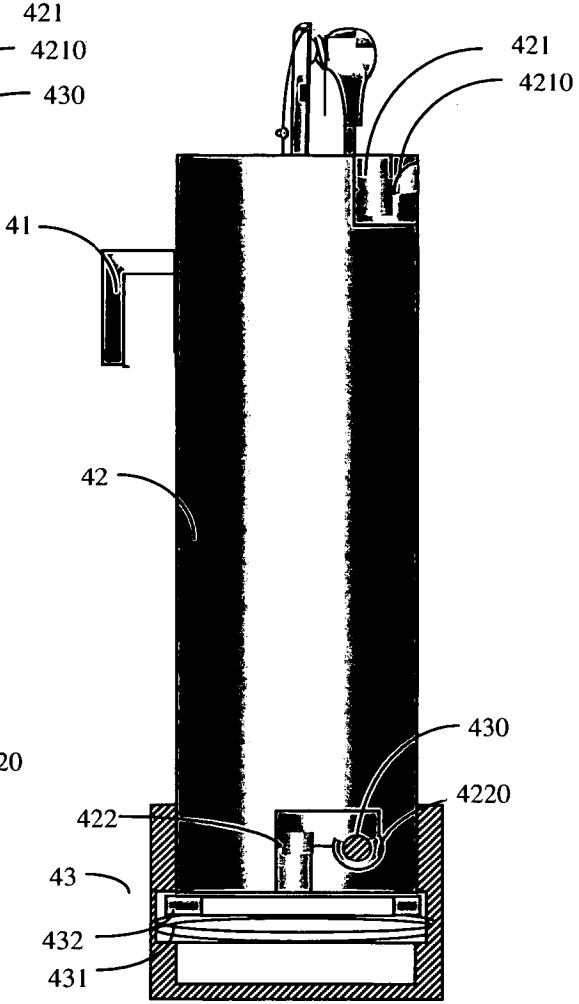
FIG. 38 is the partial exposed section view of the self-locked golh bag; (A) the cap of the self-locked golh bag is in the locked position; (B) the cap of the self-locked golh bag is uncapped and is self-locked at the bottom of the bag.
Figure 38A:
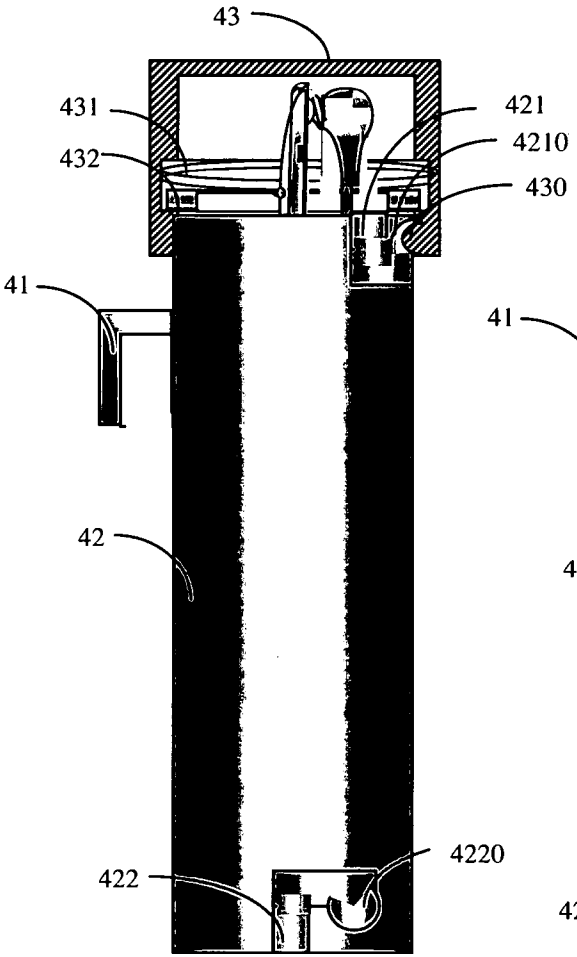

FIG. 38 shows the self-locked portable golh bag for traveling golher. As shown in FIG. 38A, the golh bag has the self-lock cap 43 being self-locked with the golh bag 42. The handle 41 is to carry the golh bag 42 or to hang the golh bag 42 on the golh cart as shown in FIG. 30. Under the biasing spring 431, the pressing plate 432 presses against the top rim of the golh bag 42. Under this pressure, the protrude 430 is locked in the notch 4210. To open the golh bag, pressing the cap 43 downward, the protrusion 430 moves downward to slide in the slot 421. Rotating the cap 43, the protrusion 430 slides to the end of the horizontal segment of the slot 421. Lifting up the cap 43, the golh bag 42 is opened. As shown FIG. 38B, the cap 43 can be held at the bottom of golh bag 42 to facilitate the carry of the golh bag 42. Slide the protrude 430 into the vertical segment of the slot 422 and press the cap 43 upward. As the protrude hits the end of the vertical segment, rotate the cap 43 horizontally to the end. Releasing the pressure on the cap 43, the pressing plate biases against the bottom plate of the golh bag 42. It is under the biasing force of the spring 431. Under the biasing force, the protrude 430 is fitted in the notch 422. The self-locked cap 43 is self-locked to the bottom of the golh bag 42.

To play the basedisc, we need the portable base. To play the golh in the park, we need the portable-putting hole. As shown in the FIG. 39, it shows the universal portable hole base. It can be used as either the base in the basedisc or the putting hole in the park golh. The rolling golf ball can roll upward on the inclined plane 452 and the plateau 451 into the hole 450. The flag 46 has the flag 461 to mark the number of the hole. The flag is inserted in the hole 450 of the base 45 with the stub 460 fitting inside the hole 450.

However, the way of golh swing is different from the way of golf swinging. There is the golh swing trainer to train the golfer to be the golher. The golf swing trainer provides guidance for the correct way of the swing of the golf club. Our golh swing trainer not only guides the swing path but also guides the swing speed and swing acceleration. The golher swing trainer integrates both the weight training and swing training in the same swing trainer.

Figure 40C:
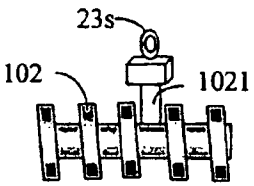
FIG. 40 is golh swing trainer; (A) is the isometric view of the golh swing trainer; (B) is the side view of the golh swing trainer; (C) is the guide implemented with the gear for the golfrisbee club; (D) is the guide implemented with the steel rope for the golfrisbee club.
Figure 40D:
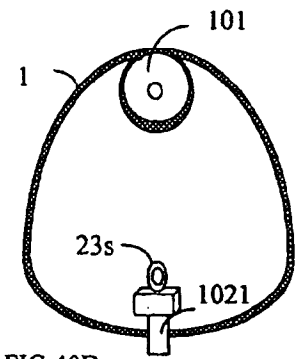
Figure 40B:
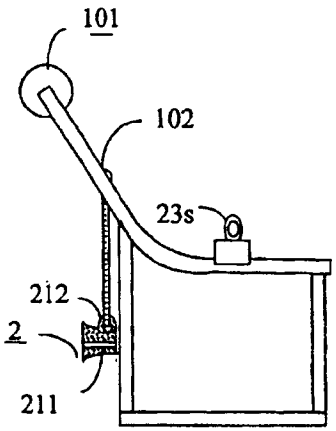
Figure 40A:
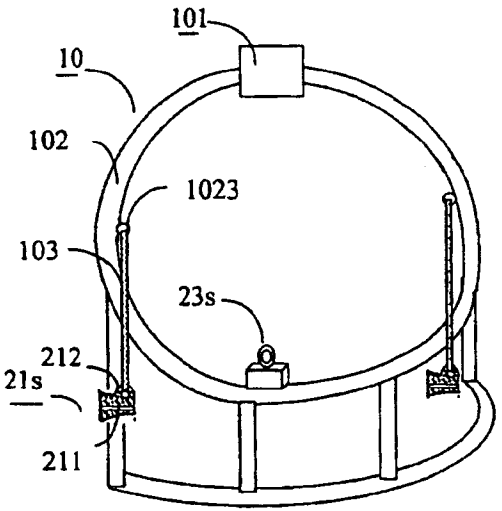

The swing of golh is different from the swing of golf. To launch the golfrisbee with the golh club, the swing speed and the swing pattern is very important. To train the golher to be familiar with the swing way of golh, as shown in FIG. 40, the golh swing trainer 10 is important for the golh instructor. The golher stands inside the golher trainer and has the golher club 2 fit inside the swing glider 23*s* as the same position as the payload 23 shown in FIG. 8. The handle 21*s* is fit at the position 21 shown in FIG. 8. The Computer aided golh instructor 101 drives the solenoid tube 1022 located inside the tube 102 to rotate to drive the gliding stub 1021 and the swing glider 23*s* to slide. The swing glider 23*s* is to guide the correct swing speed of the golh club. In FIG. 40D, it shows the alternative design of the guide. As the pulley 101*p* pulls the rope 1025, the guide 23*s* slides to move to guide the correct swing speed.

With the golher simulator, the golher does not need to go through the tedious launching, walking, and trial and error process and improve his techniques systematically. The golh simulator 41 is the miniature of the portable wheel balance machine. Instead of balancing the wheel, we apply the same principle and mechanism to measure the rotation of the golfrisbee 1. The golher can easily check the simulating results of flying distance, launching angle, launching speed, and flying direction on the LCD screen. Furthermore, the golher can adjust the parameter of the viscosity of the lubricant, the starting angle, the launching angle of the screw, etc to find the optimum swing pattern for himself.

Figure 41:
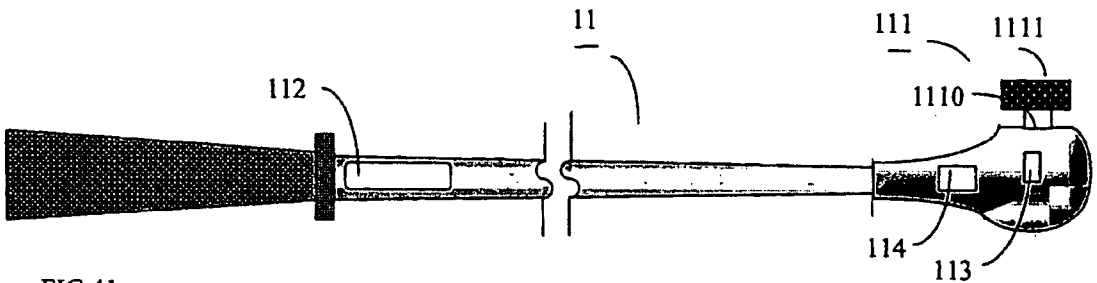
FIG. 41 is the golh simulator.

FIG. 41 is the golh simulator 11. The golfrisbee 1 is mounted on the rubber wheel head 111. The rubber 1111 envelops around the steel drum 1110 to be the rubber head. Any golfrisbee cap 3 can easily fit on the rubber wheel head 111. As the golher swings the golher club, the sensors 113 and microprocessor 114 of balance mechanism record and analyze the dynamical behaviors of the golfrisbee. The dynamics results are shown on the LCD display. The LCD display 1112 is mounted on pole of the golf club.

Figure 42A:
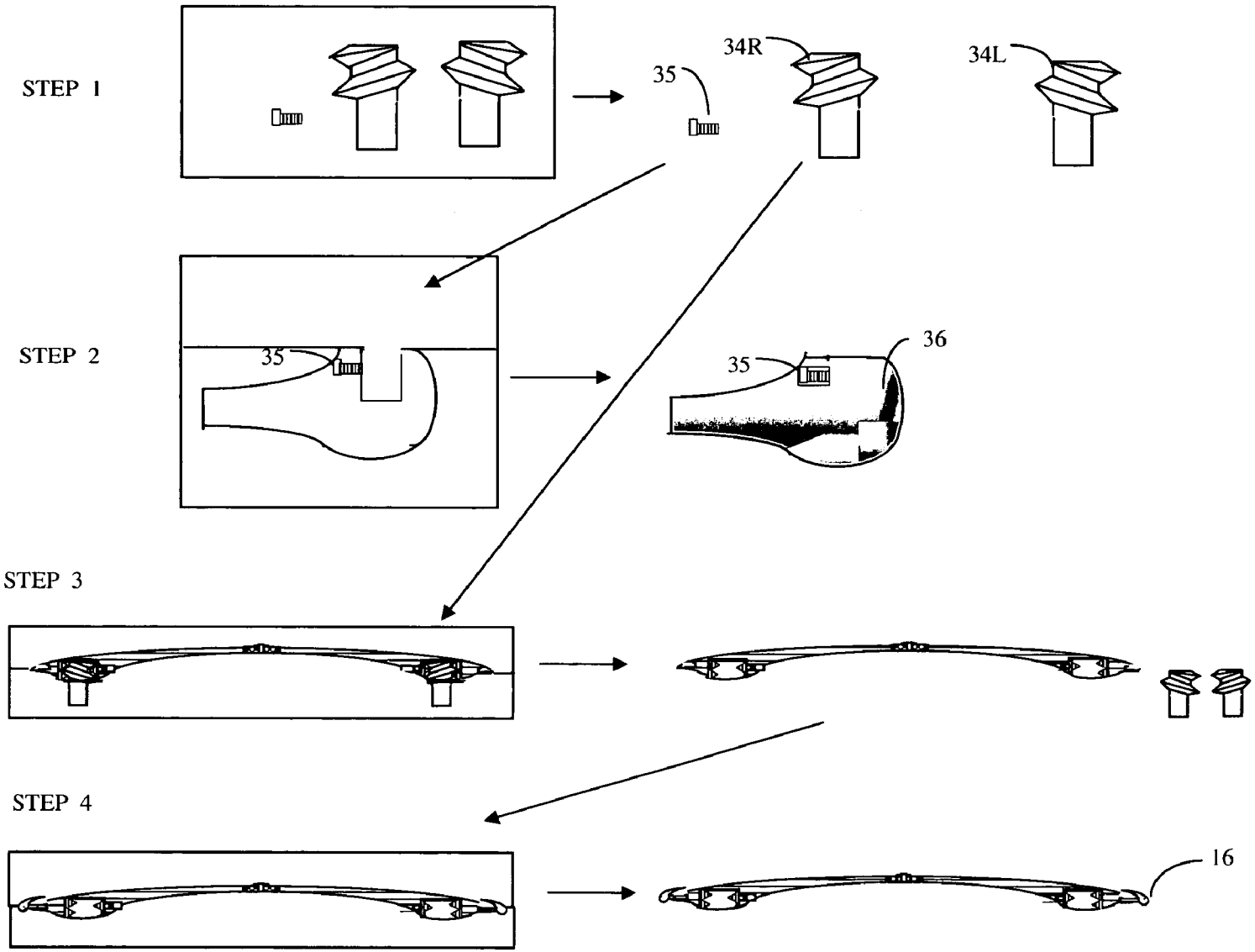
FIG. 42 is the flowchart of the manufacture process for the golh club and golfrisbee disk; (A) the module process flow for golh head and golfrisbee; (B) the assembly flow for the golh club and golfrisbee.

The golfrisbee is made of the composite material to be one single piece. Furthermore, the golfrisbee has the screw. Therefore, the mass production manufacture process is very important to the golh industry. As shown in FIG. 42A, the manufacture of making golh club and golfrisbee module is highly complicated four-step process. In the first step, the golh club head locking screw 35, launching stubs 34R and 34L are cast with model. As shown in step 2, the locking screw 35 is put in the club head module to cast the golh head with the locking screw 35. As shown in step 3, the launching stubs 34R and 34L are put in the golfrisbee module to cast the golfrisbee with the launching screws. As shown in step 4, the golfrisbee is put in the skirt module to have the skirt 16 cast to be one unit with the golfrisbee 1.

Figure 42B:
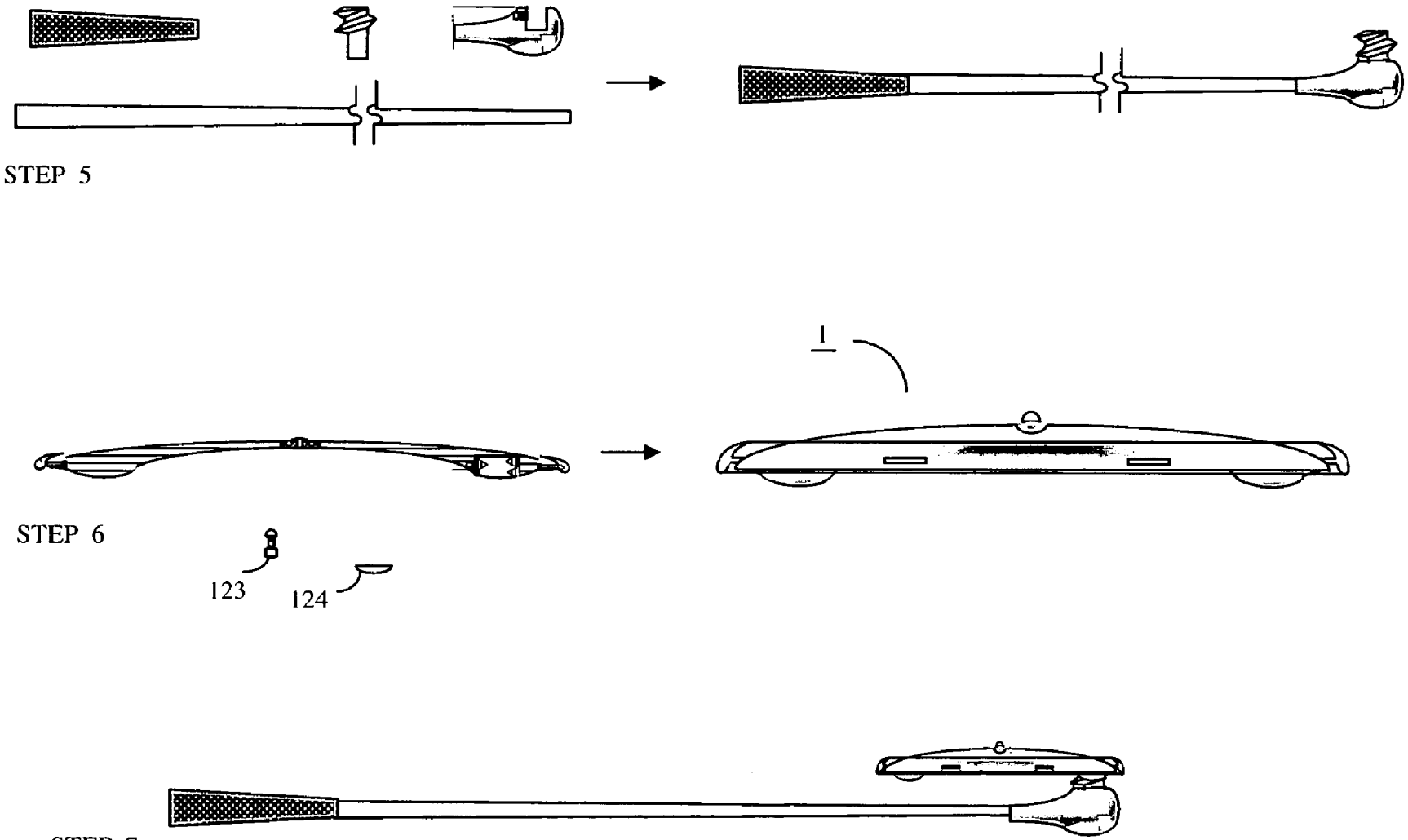

FIG. 42B shows the assembly process of the golh club and golfrisbee. In Step 5, the handle, golf club head, golf club pole and golf launching stub are assembled to be the golh club. In Step 6, the payload 124, screw 123 and golfrisbee body are assembled to be the golfrisbee 1. In step 7, the golfrisbee 1 is mounted on the launching screw stub and is ready for launching test. The detailed production process and flow are discussed in details as follows.

As shown in FIG. 23D, the golfrisbee is made of two materials. The skirt 16 material is made of the soft material 16*s* as shown in FIG. 46. The main plane 1*m* material is made of the elastic material 1*me* as shown in FIG. 43. It adopted the double injection plastic modules as shown in FIG. 43 and FIG. 46. As shown in FIG. 44, the golfrisbee 1 is made of three materials. It adopted the triple injection plastic modules as shown in FIG. 43 and FIG. 46. To minimize the air drag, as shown in FIG. 43, the callouts show the details of the curvatures for the stubs which support the skirt 16.

During the plastic module injection, to generate the screw 13 of the golfrisbee 1, it must rotate to retrieve the screwed module head 13*s*. The rotation of the screwed module head 13*s* will cause the distortion of the main plane 1*m* of the golfrisbee 1. To get rid of the distortion due to the rotation of the screwed module head 13*s*, there is the need for the special module injection process. A plastic injection module for the flying object comprises a screw module 13*s* and a main plane cavity module 190, said screw module 13*s* rotates to retrieve from said main plane cavity module 190 before said plastic injection modules 190 and 191 are open. As shown in FIG. 43A, as the modules 190 and 191 close, the elastic plastics 1*me* is injected into the cavity of the main plane 1*m*. After the plastic injection, the screwed module head 13*s* rotates and retrieves from the cavity as shown in FIG. 43B. The modules 190 and 191 still close and press on the injected plastic main plain 1*m* to release the stress on the main plane 1*m* with the residue heat of the plastic injection and keep the main plane 1*m* in the original shape. After the main plane 1*m* is hardened, then the module 191 opens as shown by the arrow 191*t*.

To increase the life of the golfrisbee 1, as shown in FIG. 44, the screw bore 13 is made of the hard plastic material. The screw 134 is in the shape of dual half ring. The golfrisbee is constituted of three kinds of material: the soft skirt 16, the elastic main plane 1*m* and the hard screw 13. The composite golfrisbee 1 adopts the triple plastic injection process. To reduce the air drag, as shown in FIG. 44C, the skirt support 161 envelops the edge of the main plane 1*m*. There are smooth transition curves between the skirt 16 and the main plane 1*m*. As shown in FIG. 45A, the pore 13*p* reserves a hole 1*mp* as the elastic material 1*me* is injected for the main plane 1*m*. As shown in FIG. 45B, the modules are separated and the hole 1*mp* is formed in the main plane 1*m*. Then the hard plastic 1*mh* is injected and the screwed module head 13*s* is inserted in the reserved pore as shown in FIG. 45C. As shown in FIG. 45D, the screw module head rotates and retrieves, then the modules 190 and 191 open. The hard female screw 13 is formed.

As shown in FIG. 46A, the soft plastic 16*s* is injected for the skirt 16. As the module 190 and 191 open, the complete golfrisbee 1 is done. It notes that the soft plastic 16*s* injection can be integrated with either FIG. 43 or FIG. 44 to have the double injection or triple injection to minimize the production cost.

As the golfrisbee is large and flat for the long throwing distance, the distortion of plastic injection becomes problem. To overcome the shrinkage distortion in plastic injection, as shown in FIG. 47, the backbone plate 1*mk* is embedded in the golfrisbee disk or golfrisbee ring. The screw 13 is integrated with the backbone plate 1*mk*. As shown in FIG. 48, the backbone plate 1*mk* and screw 13 are injected with the hard plastic material 1*mh* such as polycarbonate. Then the backbone plate 1*mk* with the screw 13 is put in the cavity to be injected and enwrapped with the elastic plastic material injection 1*me* such as rubber. The high technology and high performance golfrisbee is made of the composite material with the complex manufacturing process.

Figure 27E:
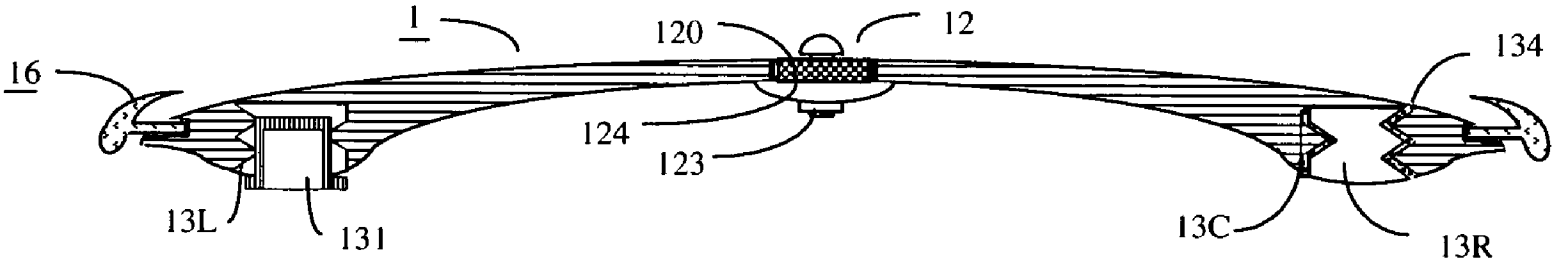
Figure 27F:
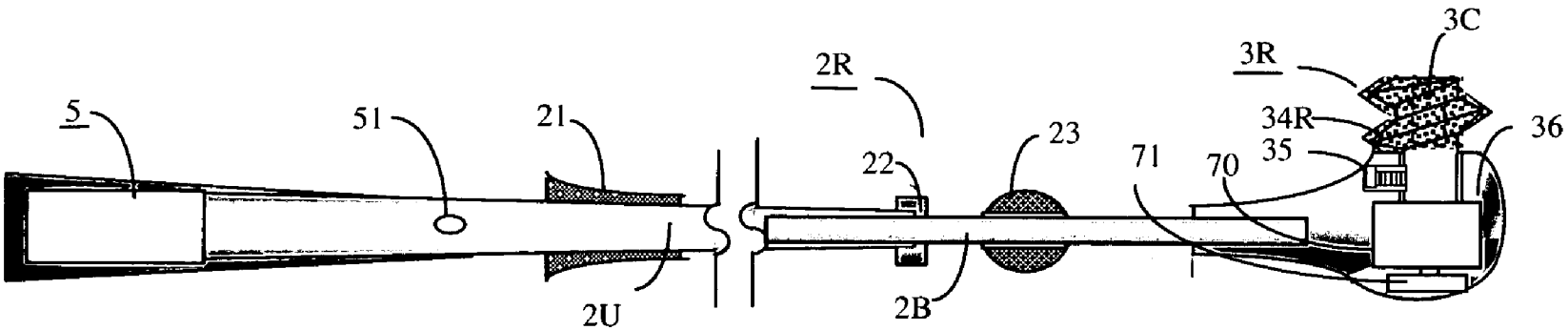
Figure 49C:
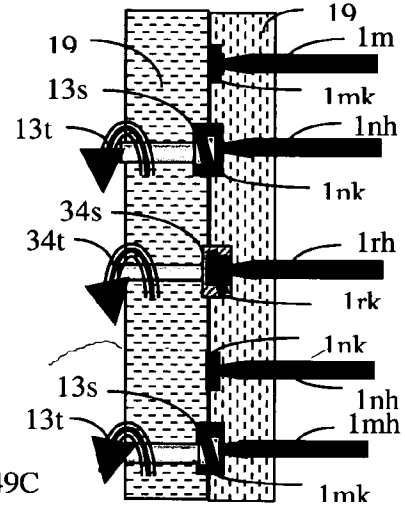
Figure 49D:
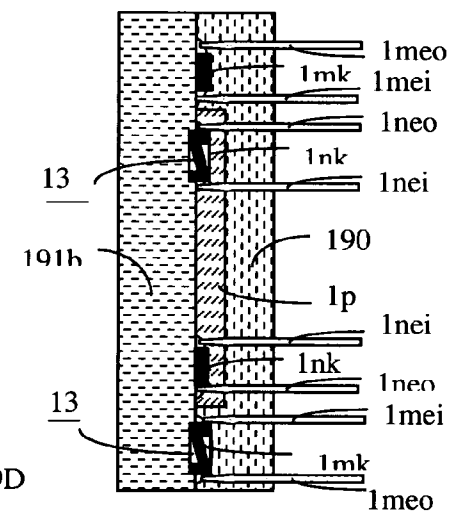
Figure 49A:
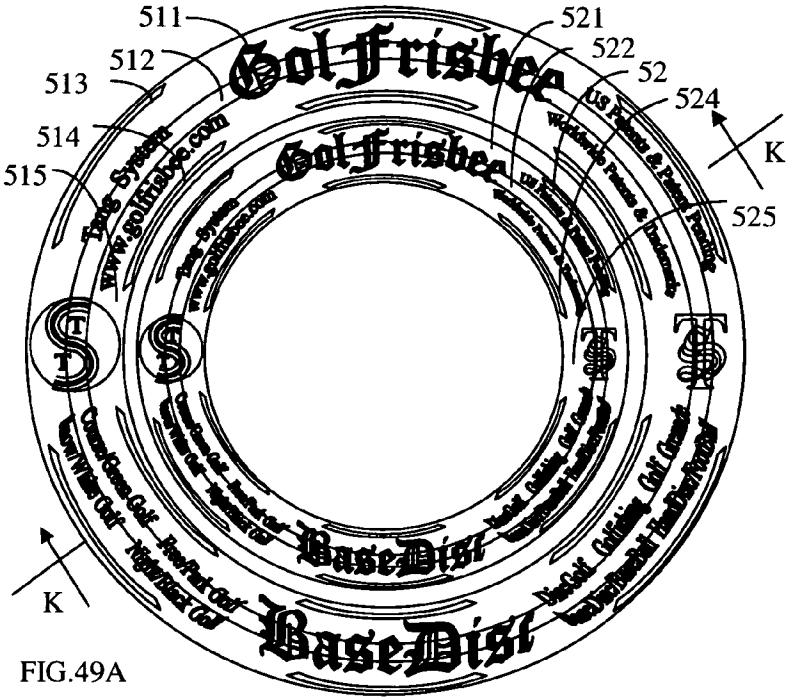
Figure 49B:
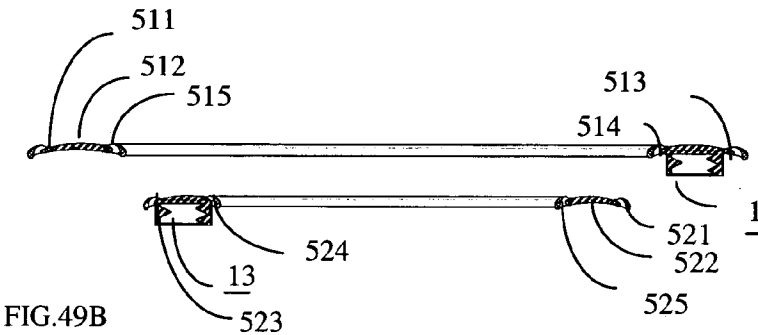
Figure 49E:
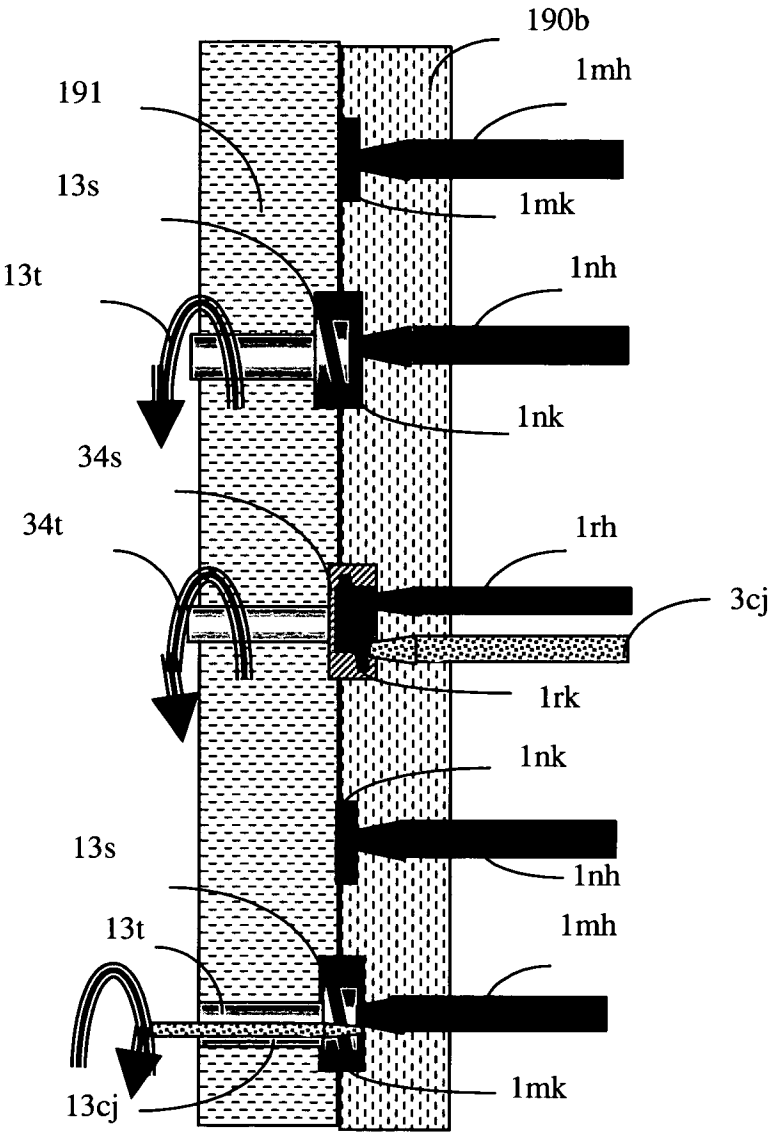
Figure 50C:
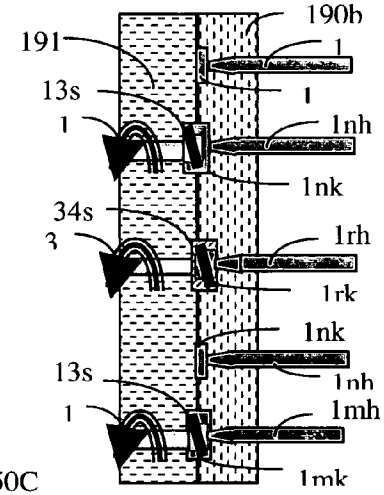
Figure 50D:
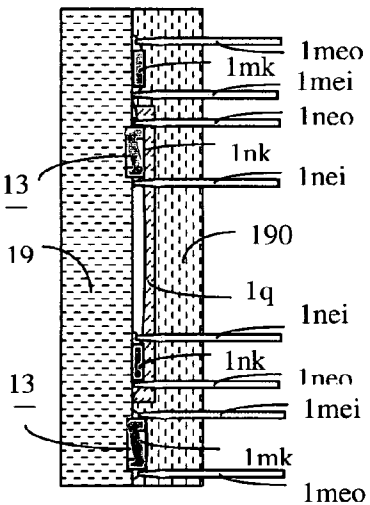
Figure 50A:
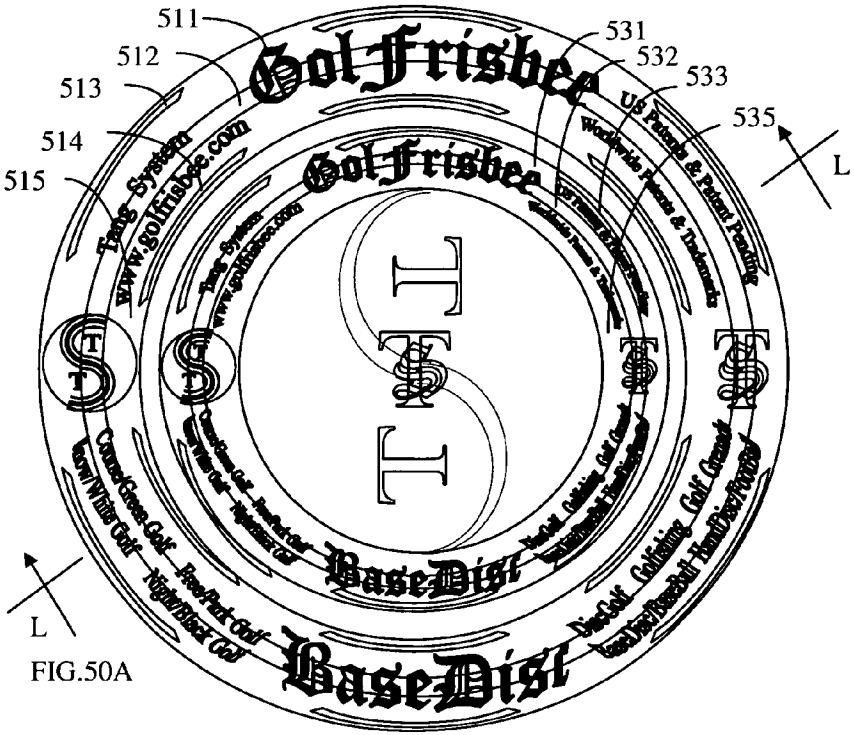
Figure 50B:
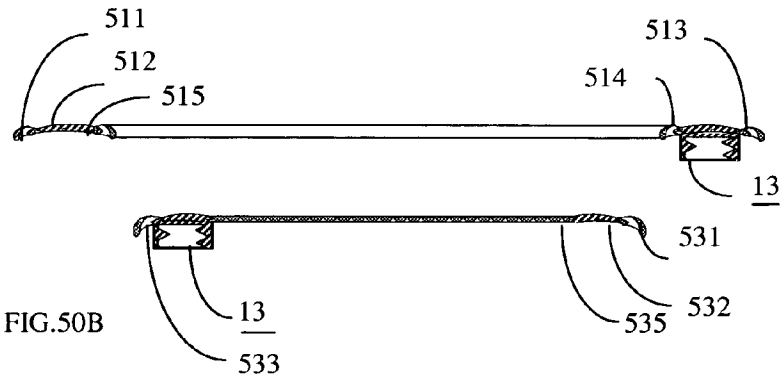

In the product phase, to reduce the production cost, the golfrisbee ring in FIG. 18C can have two rings as shown in FIG. 49A and FIG. 49B. The corresponding backbone plastic modules are shown in FIG. 49C and the foam plastic modules are shown in FIG. 49D. The golfrisbee ring in FIG. 18C and golfrisbee disk FIG. 11C are aligned as shown in FIG. 50A and FIG. 50B. The corresponding backbone plastic module is shown in FIG. 50C and the foam plastic module is shown in FIG. 50D. The golfrisbee products not only can be one set to share one package but also share one set of plastic modules. As shown in FIG. 49C and FIG. 50C, the backbone plastic module is one module with three cavities: the launching screw cavity 1*rk*, the large golfrisbee backbone cavity 1*mk* and the small golfrisbee backbone cavity 1*nk*. To minimize the number of plastic modules, the FIG. 49C is the same as FIG. 50C. The sub-module 1*p* for the ring in FIG. 49D is replaced with the sub-module 1*q* in FIG. 50D. With this approach, the plastic modules are reduced from 7 modules to be 2 modules. The plastic injection is reduced from 7 times to be 2 times. The production cost reduces two thirds. Furthermore, the gaps 513, 514, 523, 524, 533 reduce the material, reduce the weight and increase the aerodynamic performance. The golfrisbee is made of the composite material of backbone and skirt. The backbone 512 in the large golfrisbee ring is corresponding to polycarbonate plate 1*mk* in the module injected with tube 1*mh*. The backbone 522 in the small golfrisbee ring and the backbone 532 in the golfrisbee disk are corresponding to polycarbonate plate 1*nk* in the module injected with tube 1*nh*. The female screw 13 of the golfrisbee is corresponding to 1*nk* injected with the tube 1*nh* injecting over the male screw 13*s* driven by the rod 13*t*. The male screw 34 of the launch screw is corresponding to 1*rk* is injected with the tube 1*rh* injecting into the female screw 34 driven by the rod 34*t*. As shown in FIG. 27E, to have the frictional material coating 13 to be coated inside the female screw 13R, as shown in FIG. 49E, the friction material injection 13*cj* is injected into the module after the plastic material 1*mh* being injected. As shown in FIG. 27F, to have the frictional material coating 13 to be coated outside the male screw 3R, as shown in FIG. 49E, the friction material injection 3*cj* is injected into the module after the plastic material 1*rh* being injected. As shown in FIG. 49A, FIG. 49B and FIG. 49D, the external skirt 511 in the large golfrisbee ring is corresponding to the foam envelop in the module injected with tube 1*meo*. The internal skirt 515 in the large golfrisbee ring is corresponding to the foam envelop in the module injected with tube 1*mei*. The external skirt 521 in the small golfrisbee ring is corresponding to foam envelop in the module injected with tube 1*neo*. The internal skirt 525 in the small golfrisbee ring is corresponding to the foam envelop in the module injected with tube 1*nei*. As shown in FIG. 50A, FIG. 50B and FIG. 50D, the external skirt 531 in the golfrisbee disk is corresponding to the foam envelop in the module injected with tube 1*neo*. The internal pan 535 in the golfrisbee disk is corresponding to foam envelop in the module injected with tube 1*nei*.

The killer applications of the golh include the golfishing, golh-gun, golh grenade, etc. The golh sport comprises the three key technologies of golh club, golfrisbee disk and the golfrisbee basket. While the invention has been particularly shown and described with reference to the preferred embodiments thereof, it will be understood by those skilled in the art that various changes in form and details may be made therein without departing from the spirit and scope of the invention.

We claim:

1. A golfrisbee killer application of golfishing means comprising a golfishing rod means, golfishing golfrisbee means and reel means for wrapping fishing line, said golfishing rod means comprising a pole means and golh club head means, said golfishing golfrisbee means being pivotally rotating mounted on said golh club head means and said golfishing golfrisbee being able to float in water; a fishing line attached to golfishing golfrisbee means, swiveling said golfishing rod means, said golfishing golfrisbee means taking off from said golh club head means; as said golfrisbee means taking off from golfishing rod, said golfrisbee means carrying an end of said fishing line to a substantial distance from said golfishing rod.

2. A golfrisbee killer application of golfishing means according to claim 1 of which said golfishing rod further comprises a golh club means and a fishing rod means, said fishing rod means being mounted on an end of said golh club means; said fishing rod means having elasticity being for fishing; said golh club means being for throwing said golfrisbee means; said fishing line passing through guiding rings of said fishing rod then folding back to attach on said golfrisbee means which being pivotally mounted on said golh head of said golh club means; swiveling said golh club means, said golfrisbee means taking off and carrying said fish line to fly farther.

3. A golfrisbee killer application of golfishing means according to claim 1 further comprises a fishing monitor means being carried to fly with said golfishing golfrisbee means, said fishing monitor means comprising a sensor means, transmitter means, receiver means, signal processing means and displaying means, said sensor means being mounted beneath said golfrisbee means and monitoring activities under water; said transmitter means transmitting monitoring signals generated by said sensor means back to said receiver means, said receiver means receiving said monitoring signals and send said monitor signal means to signal processing means to process said monitoring signal to be processed signal; said processed signal being sent to said display means to monitor fishing activity under said golfishing golfrisbee means, on said golfishing golfrisbee means there being sensor means and transmitter means of said monitor means to monitor fishing activities under water surface, said transmitter means of said monitor means being carried with said golfishing golfrisbee means, monitoring signal of said monitor means being transmitted back and displaying on said display means.

4. A golfrisbee killer application of golfishing means according to claim 1 of which said fishing lines further comprises an insulate layer and core means including conductive core means to transmit electricity, said insulate layer wrapping around said conductive core means; said core means having a plural connection patterns of single line, dual lines in parallel, twisted pairs and multiple wires of more than three; said fishing line transmitting power from said golfishing rod means to said golfishing golfrisbee means and transmitting high-speed data transmission from said golfishing golfrisbee means back to said golfishing rod means.

5. A golfrisbee killer application of golfishing means according to claim 3 of which said receiver means and display means being embedded with said reel to be a smart reel, said smart reel further comprising a rotor means and control panel means, said display means being preferred to be flat panel means being integrated with said control panel means; said rotor means driving said reel to rotate to rewind said fishing line to tow said golfing golfrisbee across water surface, as said flat panel display means detecting fishing activities, fisher using control panel means to stop said rotor means and using hand to crank a handle means to rotate said reel rewind said fishing line means.

6. A golfrisbee killer application of golfishing means according to claim 3 of which said sensor means being an image sensor of video camera means, said image sensor of said video camera means taking picture of underwater fishing activities beneath water surface and sending video signal of image picture through said transmitter back to said receiver means to display underwater fishing activities.

7. A golfrisbee killer application of golfishing means according to claim 1 of which golfishing golfrisbee further comprises lure means to attract fishes, said lure means further comprising light means; said light means preferring to be a LED means, said LED means being controlled to flash and light in different mode.

8. A golfrisbee killer application of golfishing means according to claim 1 of which said golfishing golfrisbee being fluorescent buoyant golfrisbee to be lighting in dark and floating in water, to optically charge up said fluorescent buoyant golfrisbee, inserting said fluorescent buoyant golfrisbee in an optical-charging box optically charge said golfrisbee; said optical-charging box comprising light means to emit photons to optically pumping said fluorescent buoyant golfrisbee; to provide electricity to fishing activities, said golfishing means further comprises a fishing power station to supply power to said optical-charging box, etc, said fishing power station converting AC power and automotive power to store in battery of said fishing power station.

9. A golfrisbee killer application of golfishing means according to claim 1 further comprises a towing-pushing-seating-baggage of which said golfishing golfrisbee means being carried with said towing-pushing-seating-baggage, said towing-pushing-seating-baggage comprising a wheeled baggage means and a seating stick means said wheeled baggage means further comprising two wheels and a droppable third wheel means, said seating stick having three legs, two legs having lock rings being engaged with axles of said two wheels of said wheeled baggage means; said seating stick means being able to separate from said wheeled baggage means, as said seating stick being separated from said wheeled baggage means, said seating stick being unfolded, said seating stick serving as a stick in a stick mode; as said seating stick being folded, said seating stick serving as a chair in a seat mode; as said seating stick means being engaged with said wheeled baggage means with, two legs having lock rings being engaged with axles of said two wheels of said wheeled baggage means, as said droppable third wheel means dropping to contact with ground, said towing-pushing-seating-baggage being able to push forward in a pushing mode; as said droppable third wheel means retracting in said wheeled baggage means, said towing-pushing-seating-bag-gage being able to tow forward in a towing mode; as said seating stick being folded, said seating stick serving as a chair in a rest mode; said golfishing means comprising said towing-pushing-seating-baggage being able to smart golfishing in any tough environment.

* * * * *